US009389523B2

(12) United States Patent
Nakata et al.

(10) Patent No.: US 9,389,523 B2
(45) Date of Patent: Jul. 12, 2016

(54) ELECTROPHOTOGRAPHIC PHOTOSENSITIVE MEMBER, AND ELECTROPHOTOGRAPHIC APPARATUS AND PROCESS CARTRIDGE EACH INCLUDING THE ELECTROPHOTOGRAPHIC PHOTOSENSITIVE MEMBER

(71) Applicant: CANON KABUSHIKI KAISHA, Tokyo (JP)

(72) Inventors: Koichi Nakata, Kashiwa (JP); Shinji Takagi, Yokohama (JP); Nobuo Kosaka, Gotemba (JP); Koichi Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/191,414

(22) Filed: Feb. 26, 2014

(65) Prior Publication Data

US 2014/0255837 A1 Sep. 11, 2014

(30) Foreign Application Priority Data

Mar. 7, 2013 (JP) ..... 2013-045715
Feb. 24, 2014 (JP) ..... 2014-032962

(51) Int. Cl.
*G03G 5/06* (2006.01)
*G03G 21/18* (2006.01)
*G03G 5/147* (2006.01)

(52) U.S. Cl.
CPC ..... *G03G 5/0607* (2013.01); *G03G 5/0605* (2013.01); *G03G 5/0609* (2013.01); *G03G 5/0629* (2013.01); *G03G 5/14708* (2013.01); *G03G 21/1803* (2013.01)

(58) Field of Classification Search
CPC ..... G03G 5/0517; G03G 7/0026
See application file for complete search history.

(56) References Cited

U.S. PATENT DOCUMENTS 5,665,500 A 9/1997 Suzuki
7,364,824 B2 4/2008 Kikuchi et al.

(Continued)

FOREIGN PATENT DOCUMENTS

EP 1 182 183 A1 2/2002
EP 2 469 341 A1 6/2012

(Continued)

OTHER PUBLICATIONS

Nakata, et al., U.S. Appl. No. 14/191,413, filed Feb. 26, 2014.
European Search Report dated Oct. 27, 2014 in European Application No. 14000812.9.

*Primary Examiner* — Hoa V Le
(74) *Attorney, Agent, or Firm* — Fitzpatrick, Cella, Harper and Scinto

(57) ABSTRACT

Provided is an electrophotographic photosensitive member excellent in suppression of image deletion and electric potential variation. The surface layer of the electrophotographic photosensitive member comprises a hole transporting substance. The hole transporting substance is one of a compound consisting of a carbon atom and a hydrogen atom, or a compound consisting of a carbon atom, a hydrogen atom, and an oxygen atom. The hole transporting substance comprises a conjugate structure containing 24 or more $sp^2$ carbon atoms. The conjugate structure comprises a condensed polycyclic structure comprising 12 or more $sp^2$ carbon atoms. A ratio of a number of $sp^2$ carbon atoms is 55% or more based on a total number of carbon atoms in the hole transporting substance, and a ratio of a number of $sp^3$ carbon atoms is 10% or more based on a total number of carbon atoms in the hole transporting substance.

8 Claims, 2 Drawing Sheets

(56) References Cited

U.S. PATENT DOCUMENTS

| | | | | |
|---|---|---|---|---|
| 8,354,210 | B2 | 1/2013 | Takaki et al. | |
| 8,632,931 | B2 | 1/2014 | Sekido et al. | |
| 2006/0183042 | A1* | 8/2006 | Huang | C07C 13/567 430/58.05 |
| 2008/0138725 | A1* | 6/2008 | Fujiwara | G03G 5/0525 430/48 |
| 2009/0278446 | A1 | 11/2009 | Igawa et al. | |
| 2011/0180791 | A1 | 7/2011 | Pan et al. | |

FOREIGN PATENT DOCUMENTS

| | | | |
|---|---|---|---|
| JP | 8-272126 | A | 10/1996 |
| JP | 2001-242656 | A | 9/2001 |
| JP | 2007-279446 | A | 10/2007 |
| JP | 2012-502304 | A | 1/2012 |

* cited by examiner

ELECTROPHOTOGRAPHIC PHOTOSENSITIVE MEMBER, AND ELECTROPHOTOGRAPHIC APPARATUS AND PROCESS CARTRIDGE EACH INCLUDING THE ELECTROPHOTOGRAPHIC PHOTOSENSITIVE MEMBER

BACKGROUND OF THE INVENTION

1. Field of the Invention

The present invention relates to an electrophotographic photosensitive member, and an electrophotographic apparatus and a process cartridge each including the electrophotographic photosensitive member.

2. Description of the Related Art

Technologies for improving the material, physical properties, and the like of the surface of the electrophotographic photosensitive member (photosensitive member) containing an organic photoconductive substance have been investigated in order that the durability of the electrophotographic photosensitive member may be improved.

However, the improvement of the durability of the electrophotographic photosensitive member tends to be liable to cause image deletion or electric potential variation.

The image deletion is considered to be caused by: the deterioration of a material in the surface layer of the electrophotographic photosensitive member due to, for example, ozone or a nitrogen oxide produced by charging of the electrophotographic photosensitive member; or the reduction in surface resistance of the surface layer due to the adsorption of moisture to the surface of the electrophotographic photosensitive member. The image deletion is liable to remarkably occur particularly under a high-temperature and high-humidity environment.

Similarly, the electric potential variation is liable to occur owing to the deterioration of a constituent material caused by repeated use of the electrophotographic photosensitive member.

Japanese Patent Application Laid-Open No. H08-272126 and Japanese Patent Application Laid-Open No. 2001-242656 each describe that the gas permeability and ozone resistance of the electrophotographic photosensitive member are improved, and the image density variation thereof is alleviated, by incorporating a specific additive into the electrophotographic photosensitive member.

Japanese Patent Application Laid-Open No. 2007-279446 describes that the incorporation of a specific additive into a photosensitive layer can improve the stability of electrical characteristics and hence suppresses the occurrence of an image failure such as a memory.

In recent years, an improvement in durability of an electrophotographic apparatus has been progressed, and hence a demand for additional alleviation of the image deletion and the electric potential variation has been growing.

SUMMARY OF THE INVENTION

In view of the foregoing, the present invention is directed to providing an electrophotographic photosensitive member excellent in suppression of image deletion and electric potential variation. Further, the present invention is directed to providing an electrophotographic apparatus and a process cartridge each including the electrophotographic photosensitive member.

According to one aspect of the present invention, there is provided an electrophotographic photosensitive member comprising: a support; and a photosensitive layer formed on the support, wherein a surface layer of the electrophotographic photosensitive member comprises a hole transporting substance, wherein, the hole transporting substance is one of: a compound consisting of a carbon atom and a hydrogen atom; and a compound consisting of a carbon atom, a hydrogen atom and an oxygen atom, the hole transporting substance comprises a conjugate structure comprising 24 or more $sp^2$ carbon atoms, wherein, the conjugate structure comprises a condensed polycyclic structure comprising 12 or more $sp^2$ carbon atoms, a ratio of a number of $sp^2$ carbon atoms is 55% or more based on a total number of carbon atoms in the hole transporting substance, and a ratio of a number of $sp^3$ carbon atoms is 10% or more based on a total number of carbon atoms in the hole transporting substance.

According to another aspect of the present invention, there is provided a process cartridge detachably mountable to a main body of an electrophotographic apparatus, wherein the process cartridge integrally supports: the above-described electrophotographic photosensitive member; and at least one device selected from the group consisting of a charging device, a developing device, and a cleaning device.

According to further aspect of the present invention, there is provided an electrophotographic apparatus comprising: the above-described electrophotographic photosensitive member; a charging device; an exposing device; a developing device; and a transferring device.

According to the present invention, there is provided the electrophotographic photosensitive member excellent in suppression of image deletion and electric potential variation. Further, according to the present invention, provided are the electrophotographic apparatus and the process cartridge each including the above-described electrophotographic photosensitive member.

Further features of the present invention will become apparent from the following description of exemplary embodiments with reference to the attached drawings.

DESCRIPTION OF THE EMBODIMENTS

Figure 1:
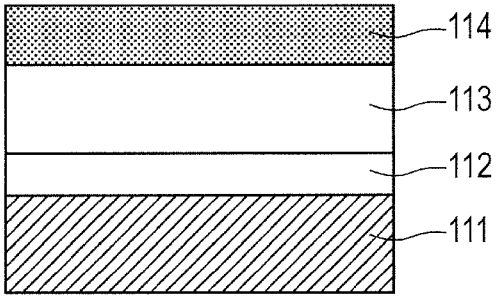
FIG. 1 is a view illustrating an example of a layer construction of an electrophotographic photosensitive member.

A surface layer of an electrophotographic photosensitive member of the present invention includes a hole transporting substance, and the hole transporting substance is a compound consisting of a carbon atom and a hydrogen atom, or consisting of a carbon atom, a hydrogen atom, and an oxygen atom. Further, the hole transporting substance includes a conjugate structure containing 24 or more $sp^2$ carbon atoms and the conjugate structure includes a condensed polycyclic structure containing 12 or more $sp^2$ carbon atoms. In addition to those characteristics, the electrophotographic photosensitive member of the present invention is characterized in that the ratio of the number of the $sp^2$ carbon atoms to the total number of carbon atoms in the hole transporting substance is 55% or more, and the ratio of the number of the $sp^3$ carbon atoms to the total number of carbon atoms in the hole transporting substance is 10% or more.

The inventors of the present invention have considered that one cause for image deletion is that an aromatic amine compound that has heretofore been used as a hole transporting substance is excellent in hole injecting performance and hole transporting performance, but tends to be susceptible to deterioration such as oxidation. The surface of the electrophotographic photosensitive member is considered to be susceptible to deterioration such as oxidation particularly due to ozone or a nitrogen oxide produced in a process for the charging of the surface of the electrophotographic photosensitive member.

The inventors of the present invention have considered that one cause for the image deletion is that the amine structure of the hole transporting substance to be incorporated into the surface layer of an ordinary electrophotographic photosensitive member causes a chemical change. In view of the foregoing, the inventors of the present invention have searched for a hole transporting substance for the electrophotographic photosensitive member independent of an amine structure, and have reached the present invention.

Specifically, the substance is a compound (hole transporting substance) consisting of a carbon atom and a hydrogen atom, or consisting of a carbon atom, a hydrogen atom, and an oxygen atom, and is a compound having a good hole transporting performance even when used in the electrophotographic photosensitive member.

The molecular structure of the hole transporting substance needs to be such a structure that a conjugated double bond system has a certain spread in the molecule and an electron is delocalized. Further, the substance may need to have a large number of condensed polycyclic structures (condensed polycyclic aromatic structures) each having specific planarity in order that the giving and receiving of holes may be efficiently performed and the stability of a cation in a transition state may be improved.

Japanese Patent Translation Publication No. 2012-502304 describes an example in which a polymer of an aromatic hydrocarbon compound is used as a hole transporting substance. However, when the polymer is used as it is in the surface layer, the durability of the electrophotographic photosensitive member is not sufficient and hence a binder resin may need to be used in combination. In view of the foregoing, the ratio of the $sp^3$ carbon atom such as an alkyl group needs to be increased in order that the compatibility of the polymer with the binder resin may be improved. On the other hand, however, the following demerit arises: the $sp^3$ carbon atom is not involved in a conjugate system and reduces a hole transporting performance. Accordingly, it cannot be said that the control of both the ratio and the hole transporting performance has been sufficient.

The hole transporting substance of the present invention needs to be such that the ratio of the number of $sp^2$ carbon atoms in the hole transporting substance falls within a certain range in order that a high hole transporting performance may be secured. In addition, the presence of the $sp^3$ carbon atom at a moderate abundance ratio in the molecule contributes to the improvement of the hole transporting performance, the increase in hole mobility, and the adjustment of the energy level of the hole transporting substance. On the other hand, as described above, the ratio of the number of the $sp^3$ carbon atoms needs to be controlled to the ratio of the number described above because a hole transporting performance is inhibited when the ratio is excessively large.

That is, the hole transporting substance of the present invention is a compound having the following features.

The hole transporting substance has a molecular structure having a conjugate structure containing 24 or more $sp^2$ carbon atoms. The term "conjugate structure" refers to such a structure that the $sp^2$ carbon atoms are continuously bonded, and the conjugated double bonds in each of which a double bond and a single bond are alternately present are continuously present. The conjugate structure means a structure that enables the delocalization of an electron in the molecule.

The conjugate structure is more preferably a conjugate structure containing a structure in which 28 or more $sp^2$ carbon atoms are continuously linked. The structure is still more preferably a conjugate structure containing 36 or more $sp^2$ carbon atoms.

The number of the $sp^2$ carbon atoms of the hole transporting substance is preferably 120 or less, more preferably 60 or less from the viewpoints of, for example, a film forming ability, its compatibility with a material for forming the surface layer, and film strength.

In addition, at the same time, the hole transporting substance of the present invention has, in the conjugate structure, a condensed polycyclic structure containing 12 or more $sp^2$ carbon atoms. The term "condensed polycyclic structure" means a structure in which two or more cyclic structures like benzene rings are adjacent to each other.

The hole transporting substance of the present invention preferably has two condensed polycyclic structures and more preferably has three or more condensed polycyclic structures. The number of the $sp^2$ carbon atoms in each condensed polycyclic structure is preferably 14 or more, more preferably 16 or more from the viewpoint of the hole transporting performance. When the hole transporting substance has two or more condensed polycyclic structures, at least one condensed polycyclic structure preferably contains 16 or more $sp^2$ carbon atoms.

The number of the $sp^2$ carbon atoms forming each condensed polycyclic structure is preferably 20 or less, more preferably 18 or less from the viewpoints of the film forming ability and the compatibility with the material for forming the surface layer.

With regard to a ring structure forming each condensed polycyclic structure, it is suitable that a conjugate structure spreads in a planar manner. Therefore, the condensed polycyclic structure is preferably formed of a five-membered ring or a six-membered ring in order that a planar structure may be formed. The number of the ring structures forming the condensed polycyclic structure, which is 2 or more, is preferably 3 or more in order that the hole transporting performance may be made additionally suitable.

With regard to the ring structures forming each condensed polycyclic structure, the condensed polycyclic structure is preferably formed of 6 or less rings and is more preferably formed of 5 or less rings from the viewpoints of film formability and the flexibility of the molecule. That is, a condensed polycyclic structure formed of 3 or 4 rings is most preferred.

The hole transporting substance of the present invention has at least one unit (one) of the condensed polycyclic structure as a partial structure. The hole transporting substance preferably has two or more units of the condensed polycyclic structures and more preferably has three or more units of the condensed polycyclic structures from the viewpoint of additionally expressing the hole transporting performance. In addition, the number of the units of the condensed polycyclic structures in one molecule of the hole transporting substance is preferably 10 or less, more preferably 4 or less. Those condensed polycyclic structures preferably have a structure in which the condensed polycyclic structures are bonded to each other through a single bond (the condensed polycyclic structures are directly bonded to each other).

The ratio of the number of the $sp^2$ carbon atoms to the total number of carbon atoms in the hole transporting substance of the present invention is 55% or more in order that the hole transporting substance may express good hole transporting performance.

When the ratio of the $sp^2$ carbon atoms becomes smaller than 55%, sufficient hole transportability is not obtained owing to the inhibitory action of an $sp^3$ carbon atom, which is not directly involved in the hole transporting performance, on hole transport. The ratio of the number of the $sp^2$ carbon atoms to the total number of carbon atoms is preferably 55% or more and 90% or less, and the ratio of the number of the $sp^2$ carbon atoms is more preferably 65% or more and 85% or less.

Most of the carbon atoms of the hole transporting substance of the present invention are formed of the $sp^3$ carbon atom and the $sp^2$ carbon atom. The hole transporting substance of the present invention is such that the ratio of the number of the $sp^3$ carbon atoms to the total number of carbon atoms in the hole transporting substance is 10% or more, preferably 10% or more and 45% or less, more preferably 12% or more.

When the ratio of the number of the $sp^3$ carbon atoms falls within the range, the hole mobility increases and the energy level of the entire molecule of the hole transporting substance is moderately adjusted by moderate electron donating property of an alkyl substituent, whereby the hole transporting performance improves. In addition, the ratio contributes to the suppression of excessive stacking property between the molecules of the hole transporting substance, an improvement in dispersibility of the hole transporting substance in the layer at the time of film formation, and uniform presence of the hole transporting substance in the layer, whereby the hole transportability is improved.

The ratio is more preferably 15% or more and 35% or less, still more preferably 15% or more and 30% or less from the viewpoint of the hole transporting performance.

The hole transporting substance of the present invention is preferably a compound represented by the following formula (1).

(1)

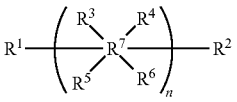

In the formula (1), $R^1$ and $R^2$ each independently represent a hydrogen atom, a substituted or unsubstituted alkyl group, a substituted or unsubstituted aralkyl group, or a substituted or unsubstituted alkoxy group, $R^3$ to $R^6$ each independently represent a hydrogen atom, a substituted or unsubstituted alkyl group, a substituted or unsubstituted aralkyl group, a substituted or unsubstituted alkoxy group, or a substituted or unsubstituted aryl group, $R^7$ represents a group derived from a substituted or unsubstituted arene by loss of 6 hydrogen atoms, and n represents an integer of from 1 to 10, and when n represents from 2 to 10, partial structures each represented by the following formula (2) in the formula (1) may be identical to or different from each other.

(2)

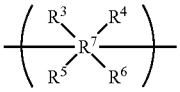

The hole transporting substance of the present invention represented by the formula (1) is described below.

Examples of the alkyl group include a methyl group, an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, a cyclopentyl group, an n-hexyl group, a 1-methylpentyl group, a 4-methyl-2-pentyl group, a 3,3-dimethylbutyl group, a 2-ethylbutyl group, a cyclohexyl group, a 1-methylhexyl group, a cyclohexylmethyl group, a 4-tert-butylcyclohexyl group, an n-heptyl group, a cycloheptyl group, an n-octyl group, a cyclooctyl group, a tert-octyl group, a 1-methylheptyl group, a 2-ethylhexyl group, a 2-propylpentyl group, an n-nonyl group, a 2,2-dimethylheptyl group, a 2,6-dimethyl-4-heptyl group, a 3,5,5-trimethylhexyl group, an n-decyl group, an n-undecyl group, a 1-methyldecyl group, an n-dodecyl group, an n-tridecyl group, a 1-hexylheptyl group, an n-tetradecyl group, an n-pentadecyl group, an n-hexadecyl group, an n-heptadecyl group, an n-octadecyl group, and an n-eicosyl group.

Examples of the aralkyl group include a benzyl group, a phenethyl group, an α-methylbenzyl group, an α,α-dimethylbenzyl group, a 1-naphthylmethyl group, a 2-naphthylmethyl group, an anthracenylmethyl group, a phenanthrenylmethyl group, a pyrenylmethyl group, a furfuryl group, a 2-methylbenzyl group, a 3-methylbenzyl group, a 4-methylbenzyl group, a 4-ethylbenzyl group, a 4-isopropylbenzyl group, a 4-tert-butylbenzyl group, a 4-n-hexylbenzyl group, a 4-n-nonylbenzyl group, a 3,4-dimethylbenzyl group, a 3-methoxybenzyl group, a 4-methoxybenzyl group, a 4-ethoxybenzyl group, a 4-n-butyloxybenzyl group, a 4-n-hexyloxybenzyl group, and a 4-n-nonyloxybenzyl group.

Examples of the alkoxy group include a methoxy group, an ethoxy group, an n-propoxy group, an isopropoxy group, an n-butoxy group, an isobutoxy group, a sec-butoxy group, an n-pentyloxy group, a neopentyloxy group, a cyclopentyloxy group, an n-hexyloxy group, a 3,3-dimethylbutyloxy group, a 2-ethylbutyloxy group, a cyclohexyloxy group, an n-heptyloxy group, an n-octyloxy group, a 2-ethylhexyloxy group, an n-nonyloxy group, an n-decyloxy group, an n-undecyloxy group, an n-dodecyloxy group, an n-tridecyloxy group, an n-tetradecyloxy group, an n-pentadecyloxy group, an n-hexadecyloxy group, an n-heptadecyloxy group, an n-octadecyloxy group, and an n-eicosyloxy group.

Examples of the aryl group include: a phenyl group, a biphenyl group, a naphthyl group, a fluorenyl group, an anthracenyl group, a phenanthrenyl group, a fluoranthenyl group, a pyrenyl group, a triphenylenyl group; a monovalent group derived from tetracene; a monovalent group derived from chrysene; a monovalent group derived from pentacene; a monovalent group derived from acenaphthene; an acenaphthylenyl group; a monovalent group derived from perylene; a monovalent group derived from corannulene; and a monovalent group derived from coronene. Further, the aryl group may be a compound with structure in which those condensed polycyclic structures each having a conjugate structure are linked to each other directly or through a conjugated double bond group.

$R^7$ represents a group obtained by removing 6 hydrogen atoms from a substituted or unsubstituted arene. An arene with structure in which multiple rings typified by a benzene structure further linked can be applied as the structure of the arene in $R^7$. Of such arene structures, a condensed polycyclic structure having a conjugate structure and having a planar structure is suitable as described above. The following structure is preferred as the arene structure: a naphthalene structure, a fluorene structure, an anthracene structure, a phenanthrene structure, a fluoranthene structure, a pyrene structure, a triphenylene structure, a tetracene structure, a chrysene structure, a pentacene structure, an acenaphthene structure, an acenaphthylene structure, a perylene structure, a corannulene structure, a coronene structure, or the like. Further, the arene structure may be a structure in which those arenes are linked to each other directly or through a conjugated double bond group. Of those, the following structure is particularly suitable: a fluorene structure, an anthracene structure, a phenanthrene structure, a fluoranthene structure, or a pyrene structure.

At least one of $R^3$ to $R^7$ represents a condensed polycyclic structure, and it is preferred that two or more thereof each represent a condensed polycyclic structure.

As a substituent that any one of $R^1$ to $R^7$ may have, for example, the following groups may be given: alkyl groups such as a methyl group, an ethyl group, an n-propyl group, an n-butyl group, an isobutyl group, a tert-butyl group, an n-pentyl group, an isopentyl group, an n-hexyl group, a 1-methylpentyl group, a 3,3-dimethylbutyl group, a cyclohexyl group, an n-heptyl group, a 1-methylhexyl group, and a cyclohexylmethyl group; aralkyl groups such as a benzyl group, a phenethyl group, a naphthylmethyl group, an anthracenylmethyl group, a phenanthrenylmethyl group, a pyrenylmethyl group, and a furfuryl group; alkoxy groups such as a methoxy group, an ethoxy group, a propoxy group, a butoxy group, and a pentyloxy group; hydroxyalkyl groups such as a hydroxymethyl group, a 1-hydroxyethyl group, a 2-hydroxyethyl group, a 1-hydroxypropyl group, a 2-hydroxypropyl group, a 3-hydroxypropyl group, a 1-hydroxy-1-methylethyl group, a 1-hydroxybutyl group, a 2-hydroxybutyl group, a 3-hydroxybutyl group, a 4-hydroxybutyl group, a 2-hydroxy-2,2-dimethylethyl group, a 2-hydroxy-1,1-dimethylethyl group, a 2-hydroxy-1,2-dimethylethyl group, a 3-hydroxy-3-methylpropyl group, a 3-hydroxy-2-methylpropyl group, a 3-hydroxy-1-methylpropyl group, a 1-hydroxypentyl group, a 2-hydroxypentyl group, a 3-hydroxypentyl group, a 4-hydroxypentyl group, a 5-hydroxypentyl group, a 3-hydroxy-3,3-dimethylpropyl group, a 3-hydroxy-2,2-dimethylpropyl group, a 3-hydroxy-1,1-dimethylpropyl group, a 3-hydroxy-1,2-dimethylpropyl group, a 3-hydroxy-1,3-dimethylpropyl group, a 4-hydroxy-4-methylbutyl group, a 4-hydroxy-3-methylbutyl group, a 4-hydroxy-2-methylbutyl group, a 4-hydroxy-1-methylbutyl group, a 1-hydroxyhexyl group, a 2-hydroxyhexyl group, a 3-hydroxyhexyl group, a 4-hydroxyhexyl group, a 5-hydroxyhexyl group, a 6-hydroxyhexyl group, a 4-hydroxy-4,4-dimethylbutyl group, a 1-hydroxyheptyl group, a 2-hydroxyheptyl group, a 3-hydroxyheptyl group, a 4-hydroxyheptyl group, a 5-hydroxyheptyl group, a 6-hydroxyheptyl group, a 7-hydroxyheptyl group, and a 5-hydroxy-5,5-dimethylpentyl group; hydroxyalkoxy groups such as a methoxymethyl group, a methoxyethyl group, a methoxypropyl group, a methoxybutyl group, a methoxypentyl group, an ethoxymethyl group, an ethoxyethyl group, an ethoxypropyl group, an ethoxybutyl group, an ethoxypentyl group, a propoxymethyl group, a propoxyethyl group, a propoxypropyl group, a propoxybutyl group, a propoxypentyl group, a butoxymethyl group, a butoxyethyl group, a butoxypropyl group, a butoxybutyl group, and a butoxypentyl group; ester groups (alkoxycarbonyl groups) such as a formic acid ester group, an acetic acid ester group, a propionic acid ester group, a butanoic acid ester group, an acrylic acid ester group, and a methacrylic acid ester group; and various alkyl ester groups obtained by subjecting the hydroxyalkyl groups to esterification such as: a methyl formate group, an ethyl formate group, a propyl formate group, an isopropyl formate group, a butyl formate group, a pentyl formate group, and a hexyl formate group, a methyl acetate group, an ethyl acetate group, an n-propyl acetate group, an isopropyl acetate group, an n-butyl acetate group, an isobutyl acetate group, a sec-butyl acetate group, a tert-butyl acetate group, an n-pentyl acetate group, an isopentyl acetate group, a neopentyl acetate group, a tert-pentyl acetate group, an n-hexyl acetate group, an n-heptyl acetate group, an n-octyl acetate group, a methyl propionate group, an ethyl propionate group, an n-propyl propionate group, an isopropyl propionate group, an n-butyl propionate group, an isobutyl propionate group, a sec-butyl propionate group, a tert-butyl propionate group, an n-pentyl propionate group, an isopentyl propionate group, a neopentyl propionate group, a tert-pentyl propionate group, an n-hexyl propionate group, an n-heptyl propionate group, and an n-octyl propionate group; a methyl butanoate group, an ethyl butanoate group, an n-propyl butanoate group, an isopropyl butanoate group, an n-butyl butanoate group, an isobutyl butanoate group, a sec-butyl butanoate group, a tert-butyl butanoate group, an n-pentyl butanoate group, an isopentyl butanoate group, a neopentyl butanoate group, a tert-pentyl butanoate group, an n-hexyl butanoate group, an n-heptyl butanoate group, and an n-octyl butanoate group; a methyl acrylate group, an ethyl acrylate group, an n-propyl acrylate group, an isopropyl acrylate group, an n-butyl acrylate group, an isobutyl acrylate group, a sec-butyl acrylate group, a tert-butyl acrylate group, an n-pentyl acrylate group, an isopentyl acrylate group, a neopentyl acrylate group, a tert-pentyl acrylate group, an n-hexyl acrylate group, an n-heptyl acrylate group, and an n-octyl acrylate group; and a methyl methacrylate group, an ethyl methacrylate group, an n-propyl methacrylate group, an isopropyl methacrylate group, an n-butyl methacrylate group, an isobutyl methacrylate group, a sec-butyl methacrylate group, a tert-butyl methacrylate group, an n-pentyl methacrylate group, an isopentyl methacrylate group, a neopentyl methacrylate group, a tert-pentyl methacrylate group, an n-hexyl methacrylate group, an n-heptyl methacrylate group, and an n-octyl methacrylate group. In addition, the substituent may be a substituent obtained by combining a plurality of these substituents with each other.

The molecular weight of the hole transporting substance of the present invention is preferably 300 or more, more preferably 400 or more in order to express a further satisfactory hole transporting ability.

From the viewpoints of, for example, the hole transporting ability, the film forming ability, and the compatibility, the molecular weight of the hole transporting substance is preferably 3,000 or less, more preferably 2,000 or less. That is, the molecular weight is preferably 300 or more and 3,000 or less, more preferably 400 or more and 2,000 or less.

The ratio of the number of oxygen atoms in the hole transporting substance of the present invention to the number of atoms obtained by summing the number of the oxygen atoms and the number of carbon atoms is preferably 20% or less, more preferably 10% or less from the viewpoint of the hole transporting ability.

A photosensitive layer, in particular, a hole transporting layer containing the hole transporting substance of the present invention is mainly produced by an application process.

The surface layer preferably contains a binder resin in addition to the hole transporting substance. The binder resin is preferably a resin having no hole transporting function, more preferably at least one kind of resin selected from a polycarbonate resin and a polyester resin.

The hole transporting substance of the present invention is used in the surface layer of the electrophotographic photosensitive member. The hole transporting substance of the present invention may be used in a laminated electrophotographic photosensitive member or may be used in a single-layer electrophotographic photosensitive member. In the case of the laminated photosensitive member, when a hole transporting layer is positioned on a surface side, the hole transporting substance of the present invention is used in the hole transporting layer.

When the hole transporting layer is formed by further laminating two or more layers, the hole transporting substance of the present invention is incorporated into at least a hole transporting layer positioned on the surface layer.

When the hole transporting substance of the present invention is used in the single-layer photosensitive member, the hole transporting substance can be used in its photosensitive layer together with a charge generating substance.

The content (mass ratio) of the hole transporting substance of the present invention in the surface layer is preferably 50 mass % or more and 100 mass % or less, more preferably 80 mass % or more, still more preferably 90 mass % or more with respect to all hole transporting substances from the viewpoint of the suppression of deterioration due to oxidation. A layer forming the surface layer is preferably formed of a compound containing as small an amount of a heteroatom such as an amine structure as possible.

Further, the hole transporting substance of the present invention is more preferably selected from hole transporting substances each consisting of a carbon atom and a hydrogen atom for the prevention of the deterioration of the surface of the electrophotographic photosensitive member.

With regard to the electrophotographic photosensitive member, to which the hole transporting substance of the present invention is applied, the total thickness of its electrophotographic photosensitive layer has only to fall within the range of from 5 μm to 50 μm. Further, the thickness of the photosensitive layer is preferably 30 μm or less. The same thickness range applies to the single-layer photosensitive member.

In addition, the thickness of the surface layer containing the hole transporting substance of the present invention is preferably 10 μm or less, more preferably 8 μm or less.

When the thickness of the surface layer becomes 10 μm or less, the electrostatic capacity of the electrophotographic photosensitive member increases, and particularly when the photosensitive member is used in a contact charging-type electrophotographic apparatus, discharge deterioration of the photosensitive member in association with charging tends to increase. The hole transporting substance of the present invention is additionally suitable for a system in which such discharge deterioration due to charging frequently occurs.

<Electrophotographic Photosensitive Member>

Next, the entire construction of the electrophotographic photosensitive member of the present invention is described.

Figure 2:
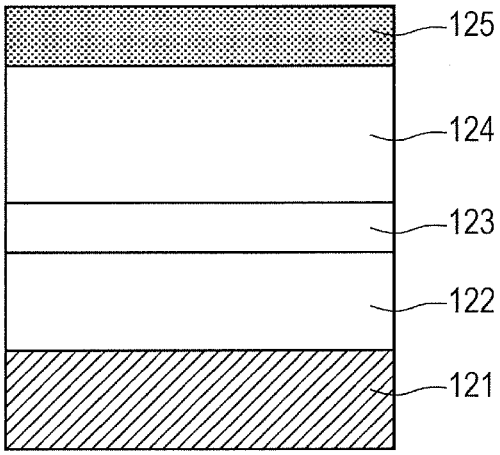
FIG. 2 is a view illustrating an example of a layer construction of an electrophotographic photosensitive member.
Figure 3:
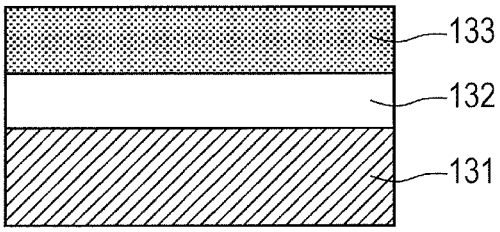
FIG. 3 is a view illustrating an example of a layer construction of an electrophotographic photosensitive member.

FIG. 1 illustrates the outline of a preferred layer construction of the electrophotographic photosensitive member in the present invention. FIG. 1 illustrates a construction in which an undercoat layer 112, a charge generating layer 113, and a hole transporting layer 114 are formed on a support 111. In this case, the hole transporting substance of the present invention is incorporated into the hole transporting layer 114 on the side closest to the surface. FIG. 2 illustrates a construction in which an undercoat layer 122, a charge generating layer 123, a hole transporting layer 124, and a surface layer 125 are formed on a support 121. In this case, the hole transporting substance of the present invention is incorporated into the surface layer 125. Further, in the case of this layer construction, in the hole transporting layer 124, the hole transporting substance of the present invention may be used or a general known hole transporting substance such as an aromatic amine compound may be used. FIG. 3 illustrates a construction in which an undercoat layer 132 and a single-layer photosensitive layer 133 that has both a charge generating ability and a hole transporting ability are formed on a support 131. In this case, the hole transporting substance of the present invention has only to be incorporated into at least the single-layer photosensitive layer 133.

A conductive support formed of a material having electroconductivity is preferred as the support to be used in the present invention. Examples of the material for the support include: metals and alloys such as iron, copper, gold, silver, aluminum, zinc, titanium, lead, nickel, tin, antimony, indium, chromium, an aluminum alloy, and stainless steel. In addition, there may be used a support made of a metal or support made of a resin having a coat formed by depositing aluminum, an aluminum alloy, an indium oxide-tin oxide alloy, or the like through vacuum evaporation. In addition, there may also be used a support obtained by impregnating a plastic or paper with conductive particles such as carbon black, tin oxide particles, titanium oxide particles, or silver particles, or a support containing a conductive resin. The shape of the support is, for example, a cylinder-like, belt-like, sheet-like, or plate-like shape.

The surface of the support may be subjected to a cutting treatment, a surface roughening treatment, an alumite treatment, or the like for the purpose of the suppression of an interference fringe due to the scattering of laser light.

A conductive layer may be provided between the support and the undercoat layer or charge generating layer to be described later for the purposes of the suppression of an interference fringe due to the scattering of laser light or the like and the covering of a flaw of the support.

The conductive layer can be formed by: applying a conductive-layer coating solution obtained by subjecting carbon black, a conductive pigment, a resistance regulating pigment, or the like to a dispersion treatment together with a binder resin; and drying the resultant coat. A compound that undergoes curing polymerization through heating, UV irradiation, radiation irradiation, or the like may be added to the conductive-layer coating solution. The surface of the conductive layer obtained by dispersing the conductive pigment or the resistance regulating pigment tends to be roughened.

The solvent of the conductive-layer coating solution is, for example, an ether-based solvent, an alcohol-based solvent, a ketone-based solvent, or an aromatic hydrocarbon solvent. The thickness of the conductive layer is preferably 0.1 μm or more and 50 μm or less, more preferably 0.5 μm or more and 40 μm or less, still more preferably 1 μm or more and 30 μm or less.

Examples of the binder resin to be used for the conductive layer include: a polymer and copolymer of a vinyl compound such as styrene, vinyl acetate, vinyl chloride, an acrylic acid ester, a methacrylic acid ester, vinylidene fluoride, or trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicone resin, an epoxy resin, and an isocyanate resin.

Examples of the conductive pigment and the resistance regulating pigment include particles of a metal (alloy) such as aluminum, zinc, copper, chromium, nickel, silver, or stainless steel, and plastic particles each having the metal deposited on its surface. In addition, there may be used particles of a metal oxide such as zinc oxide, titanium oxide, tin oxide, antimony oxide, indium oxide, bismuth oxide, tin-doped indium oxide, or antimony- or tantalum-doped tin oxide. One kind of those pigments may be used alone or two or more kinds thereof may be used in combination.

The undercoat layer (intermediate layer) may be provided between the support or the conductive layer and the charge generating layer for the purposes of, for example, an improvement in adhesiveness of the charge generating layer, an improvement in property by which a hole is injected from the support, and the protection of the charge generating layer from an electrical breakdown.

The undercoat layer can be formed by: applying an undercoat-layer coating solution obtained by dissolving a binder resin in a solvent; and drying the resultant coat.

Examples of the binder resin to be used for the undercoat layer include a polyvinyl alcohol resin, poly-N-vinylimidazole, a polyethylene oxide resin, ethyl cellulose, an ethylene-acrylic acid copolymer, casein, a polyamide resin, an N-methoxymethylated 6-nylon resin, a copolymerized nylon resin, a phenol resin, a polyurethane resin, an epoxy resin, an acrylic resin, a melamine resin, and a polyester resin.

Metal oxide particles may further be incorporated into the undercoat layer. An example of the metal oxide particles is particles containing titanium oxide, zinc oxide, tin oxide, zirconium oxide, or aluminum oxide. In addition, the metal oxide particles may be metal oxide particles each having a surface treated with a surface treatment agent such as a silane coupling agent.

Examples of the solvent to be used for the undercoat-layer coating solution include organic solvents such as an alcohol-based solvent, a sulfoxide-based solvent, a ketone-based solvent, an ether-based solvent, an ester-based solvent, an aliphatic halogenated hydrocarbon-based solvent, and an aromatic compound. The thickness of the undercoat layer is preferably 0.05 μm or more and 30 μm or less, more preferably 1 μm or more and 25 μm or less. Organic resin fine particles or a leveling agent may further be incorporated into the undercoat layer.

Next, the charge generating layer is described. The charge generating layer can be formed by: applying a charge-generating-layer coating solution obtained by subjecting a charge generating substance to a dispersion treatment together with a binder resin and a solvent; and drying the resultant coat. Alternatively, the charge generating layer may be a deposited film of the charge generating substance.

Examples of the charge generating substance to be used for the charge generating layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyestuffs, anthanthrone pigments, pyranthrone pigments, xanthene dyes, quinone imine dyes, and styryl dyes. Only one kind of those charge generating substances may be used or two or more kinds thereof may be used. Of those charge generating substances, from the viewpoint of sensitivity, phthalocyanine pigments or azo pigments are preferred, and phthalocyanine pigments are particularly more preferred.

Of the phthalocyanine pigments, in particular, oxytitanium phthalocyanines, chlorogallium phthalocyanines, or hydroxygallium phthalocyanines exhibits excellent charge generation efficiency. Further, of the hydroxygallium phthalocyanines, a hydroxygallium phthalocyanine crystal of a crystal form having peaks at Bragg angles 2θ in CuKα characteristic X-ray diffraction of 7.4°±0.3° and 28.2°±0.3° is more preferred from the viewpoint of sensitivity.

Examples of the binder resin to be used for the charge generating layer include: polymers of vinyl compounds such as styrene, vinyl acetate, vinyl chloride, an acrylic acid ester, a methacrylic acid ester, vinylidene fluoride, and trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicone resin, and an epoxy resin.

The mass ratio between the charge generating substance and the binder resin preferably falls within the range of from 1:0.3 to 1:4. As a method for the dispersion treatment, there are given, for example, methods each using a homogenizer, ultrasonic dispersion, a ball mill, a vibrating ball mill, a sand mill, an attritor, or a roll mill.

Examples of the solvent to be used for the charge-generating-layer coating solution include an alcohol-based solvent, a sulfoxide-based solvent, a ketone-based solvent, an ether-based solvent, an ester-based solvent, an aliphatic halogenated hydrocarbon-based solvent, and an aromatic compound.

Next, the hole transporting layer is described. The hole transporting layer can be formed by: applying a hole-transporting-layer coating solution obtained by dissolving a hole transporting substance and a binder resin in a solvent to form a coat; and drying the resultant coat.

When the hole transporting layer is the surface layer, the hole transporting substance of the present invention is used as the hole transporting substance to be used in the hole transporting layer. In addition, a known hole transporting substance can be used in addition to the hole transporting substance of the present invention. Examples of the known hole transporting substance include a carbazole compound, a hydrazone compound, an N,N-dialkylaniline compound, a diphenylamine compound, a triphenylamine compound, a triphenylmethane compound, a pyrazoline compound, a styryl compound, and a stilbene compound.

Examples of the binder resin to be used for the hole transporting layer include an acrylic acid ester, a methacrylic acid ester, a polyvinyl alcohol resin, a polyvinyl acetal resin, a polycarbonate resin, and a polyester resin. A polycarbonate resin or a polyester resin is preferred.

Examples of the solvent to be used for the hole-transporting-layer coating solution include an alcohol-based solvent, a sulfoxide-based solvent, a ketone-based solvent, an ether-based solvent, an ester-based solvent, an aliphatic halogenated hydrocarbon-based solvent, and an aromatic hydrocarbon-based solvent.

The thickness of the hole transporting layer is preferably 1 μm or more and 50 μm or less, more preferably 3 μm or more and 40 μm or less, still more preferably 5 μm or more and 30 μm or less.

The electrophotographic photosensitive member of the present invention may be further provided with a surface layer. In that case, the hole transporting substance of the present invention is incorporated into a protective layer.

As a binder resin to be used for the surface layer, there are given, for example, an acrylic acid ester, a methacrylic acid ester, a polyvinyl alcohol resin, a polyvinyl acetal resin, a polycarbonate resin, and a polyester resin. In addition, the surface layer may also contain a curable resin. As the curable resin, there may be used a curable phenol resin, a curable epoxy resin, a curable acrylic resin, a curable methacrylic resin, or the like.

The surface layer can be formed by: applying a surface-layer coating solution obtained by dissolving the resin in an organic solvent to form a coat; and drying the resultant coat. The thickness of the surface layer is preferably 0.1 μm or more and 30 μm or less, more preferably 0.5 μm or more and 15 μm or less. Examples of the solvent to be used for the surface-layer coating solution include an alcohol-based solvent, a sulfoxide-based solvent, a ketone-based solvent, an ether-based solvent, an ester-based solvent, an aliphatic halogenated hydrocarbon-based solvent, and an aromatic hydrocarbon-based solvent.

In addition, the following known particles or lubricant may be incorporated into the surface layer of the electrophotographic photosensitive member: conductive particles, silicone oil, wax, fluorine atom-containing resin particles such as polytetrafluoroethylene particles, silica particles, alumina particles, boron nitride, or the like.

Any of various additives may be added to each of the layers of the electrophotographic photosensitive member. Examples of the additives include: antidegradants such as an antioxidant and a UV absorber; a coating property improving agents such as a leveling agent; organic resin particles such as fluorine atom-containing resin particles and acrylic resin particles; and inorganic particles of, for example, silica, titanium oxide, and alumina.

In the application of the coating solution for each of the layers, there may be used any known application method such as a dip coating method, a spray coating method, a ring coating method, a spin coating method, a roller coating method, a Mayer bar coating method, or a blade coating method.

Figure 4:
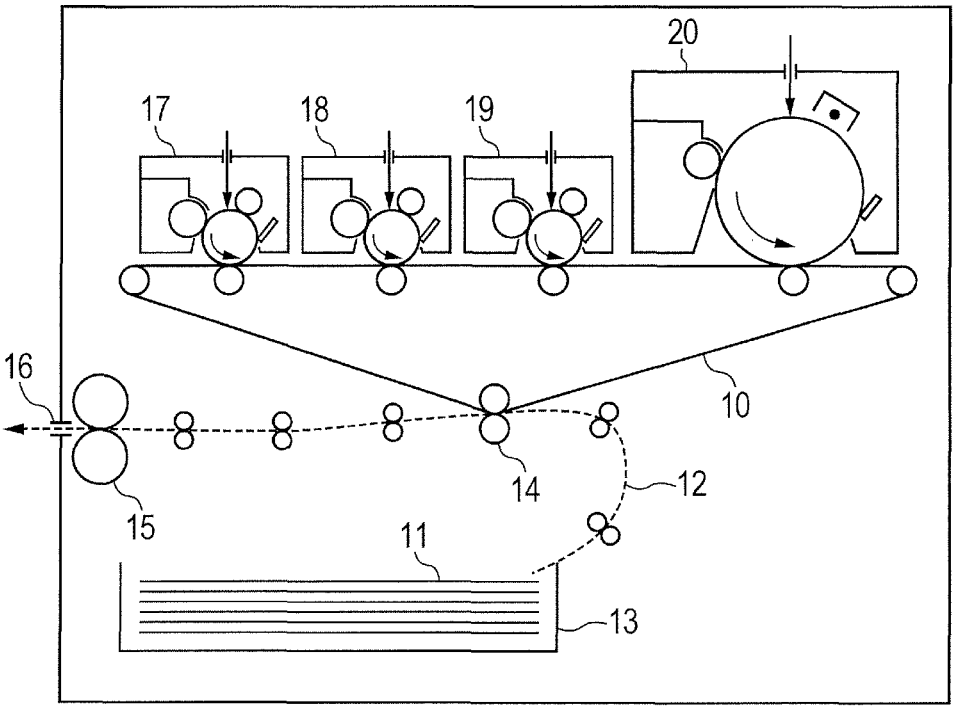
FIG. 4 is a view illustrating an example of a schematic construction of an electrophotographic apparatus including a process cartridge having an electrophotographic photosensitive member.
Figure 5:
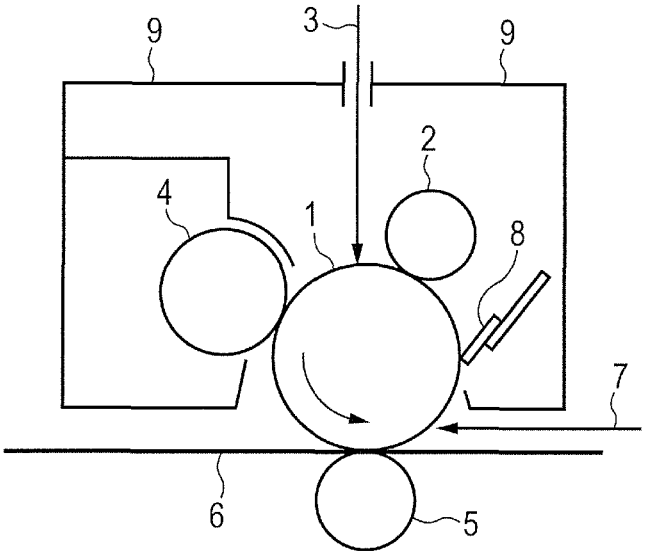
FIG. 5 is a view illustrating an example of a schematic construction of a process cartridge including an electrophotographic photosensitive member according to the present invention.

Next, FIG. 4 and FIG. 5 illustrate examples of the constructions of an electrophotographic apparatus and a process cartridge each including the electrophotographic photosensitive member of the present invention, respectively.

FIG. 4 illustrates an example of the electrophotographic apparatus. Transfer paper 11 as a medium to be output is held in a sheet feeding tray 13 and is conveyed to a secondary transferring device 14 through a sheet feeding path 12. After a secondary transfer step, image fixation is performed with a fixing device 15, and the transfer paper 11 is output from a sheet delivery portion 16. The following process cartridges, which are placed side by side along an intermediate transfer member 10, each represent a process cartridge for each color to be used for color printing: a process cartridge 17 for a yellow color, a process cartridge 18 for a magenta color, a process cartridge 19 for a cyan color, and a process cartridge 20 for a black color, corresponding to respective colors, i.e., a yellow color, a magenta color, a cyan color, and a black color. The process cartridge is illustrated in detail in FIG. 5.

In FIG. 5, a cylindrical electrophotographic photosensitive member 1 is rotationally driven about its central axis in a direction indicated by an arrow at a predetermined peripheral speed. The peripheral surface of the electrophotographic photosensitive member 1 to be rotationally driven is uniformly charged to a predetermined positive or negative potential by a charging device (primary charging device: a charging roller or the like) 2. A voltage to be applied to the charging device 2 may be any one of a voltage obtained by superimposing an AC component on a DC component, and a voltage consisting of the DC component. The charged peripheral surface of the electrophotographic photosensitive member 1 receives exposure light (image exposure light) 3 output from an exposing device (not shown) such as slit exposure or laser beam scanning exposure. Thus, electrostatic latent images corresponding to a target image are sequentially formed on the peripheral surface of the electrophotographic photosensitive member 1. The electrostatic latent images formed on the peripheral surface of the electrophotographic photosensitive member 1 are developed with toner in the developer of a developing device 4 to be turned into toner images. The toner images formed and supported on the peripheral surface of the electrophotographic photosensitive member 1 are sequentially transferred onto a transfer material (such as an intermediate transfer member) 6 by a transfer bias from a transferring device (such as a transfer roller) 5. The surface of the electrophotographic photosensitive member 1 after the transfer of the toner images is subjected to an electricity eliminating treatment with electricity eliminating light 7 from an electricity eliminating light irradiation device (not shown), and is then cleaned through the removal of transfer residual toner by a cleaning device 8. Thus, the electrophotographic photosensitive member 1 is repeatedly used in image formation. It should be noted that the electricity eliminating light irradiation step may be operated before or after a cleaning step. The electricity eliminating light irradiation device and the cleaning device 8 can be provided as required.

A process cartridge 9 illustrates a state where those devices and the like are integrally supported to form a cartridge. For example, the following may be adopted: multiple components are selected from the components such as the electrophotographic photosensitive member 1, the charging device 2, the developing device 4, and the cleaning device 8, and are integrally supported to form a process cartridge, and the process cartridge can be detachably mountable to the main body of the electrophotographic apparatus. In FIG. 5, the electrophotographic photosensitive member 1, the charging device 2, the developing device 4, and the cleaning device 8 are integrally supported to form a cartridge. Then, the cartridge is used as a process cartridge 9 detachably mountable to the main body of the electrophotographic apparatus.

Next, preferred examples of the hole transporting substance of the present invention are shown; provided that the present invention is not limited thereto.

No. 1

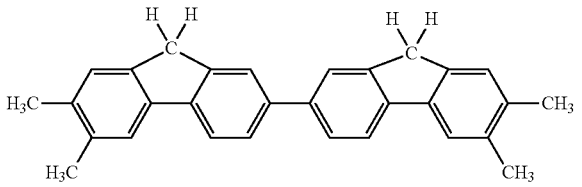

No. 2

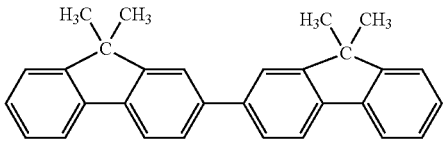

-continued
No. 3
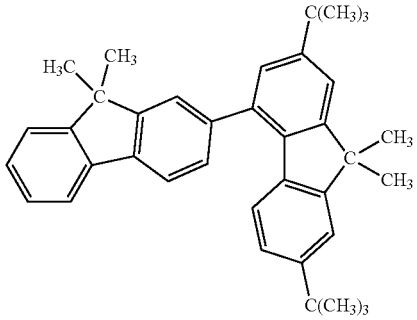
No. 4
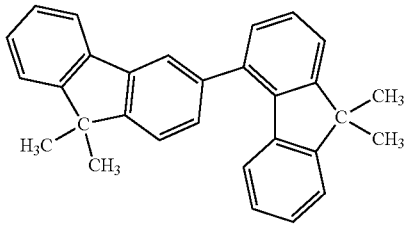
No. 5
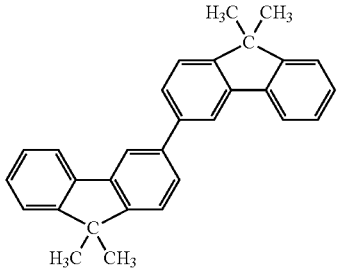
No. 6
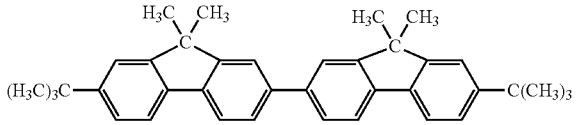
No. 7
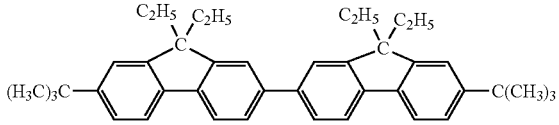
No. 8
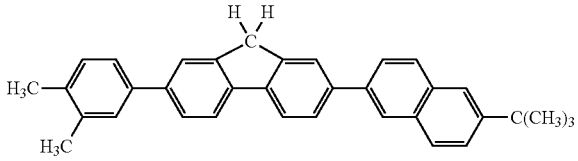
No. 9
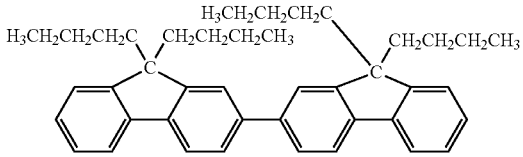
No. 10
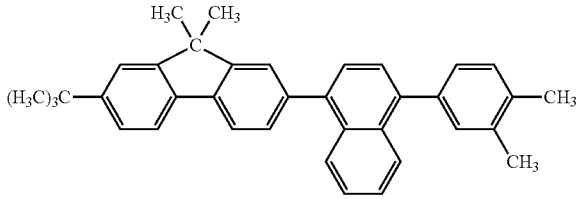
No. 11
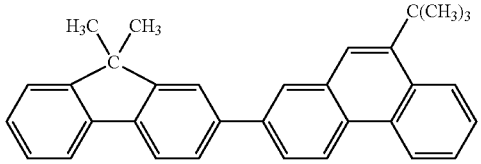
No. 12
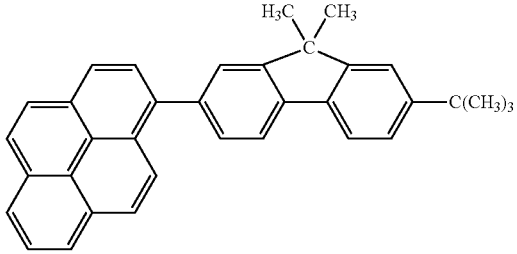
No. 13
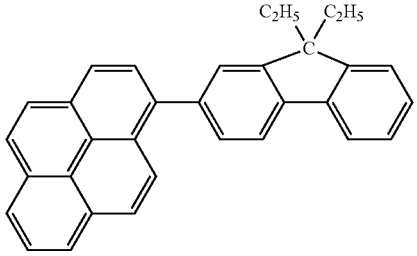
No. 14
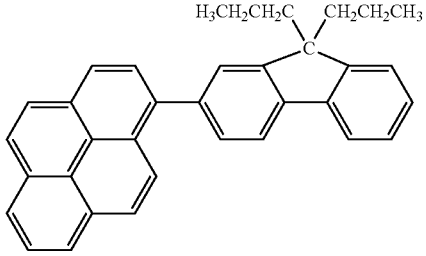

-continued
No. 15
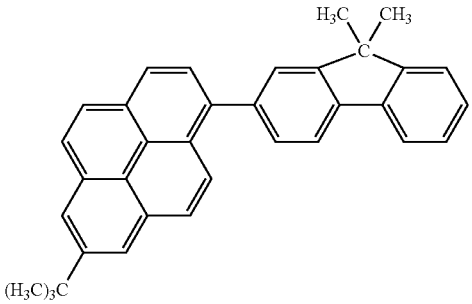
No. 16
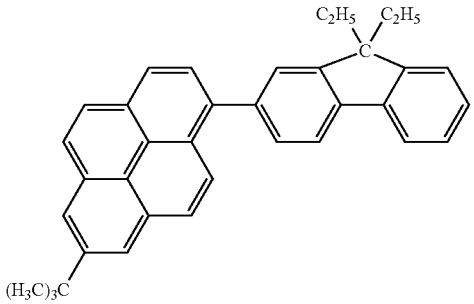
No. 17
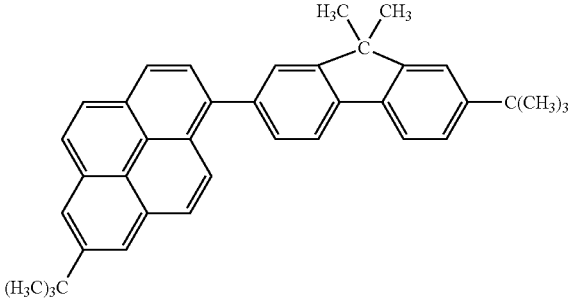
No. 18
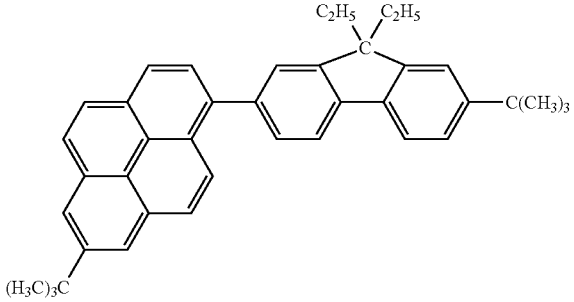
No. 19
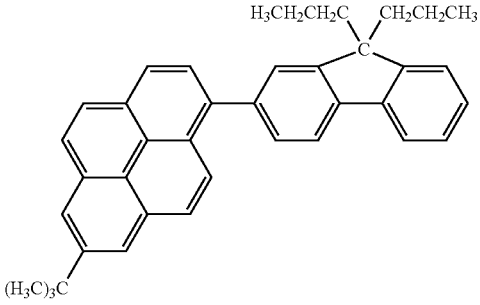
No. 20
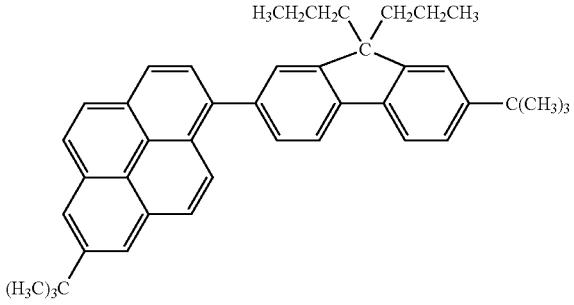
No. 21
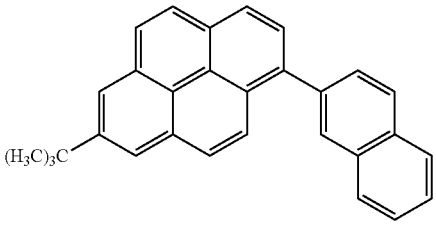
No. 22
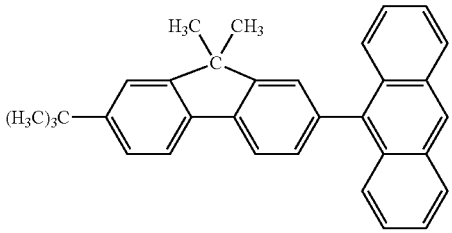
No. 23
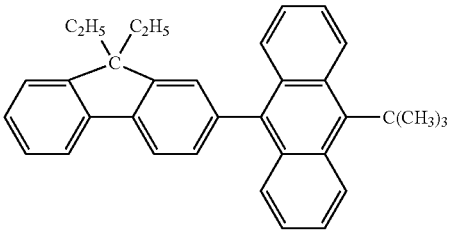
No. 24
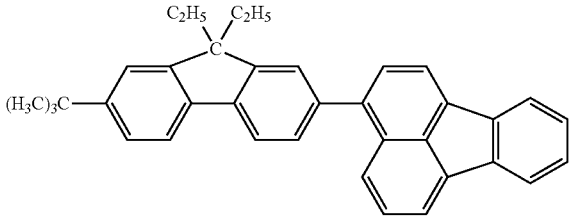

-continued
No. 25
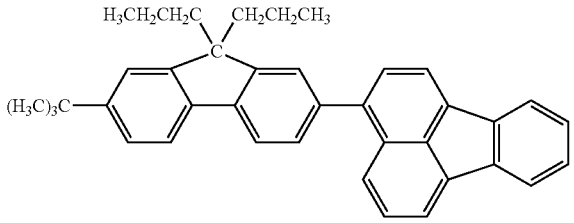
No. 26
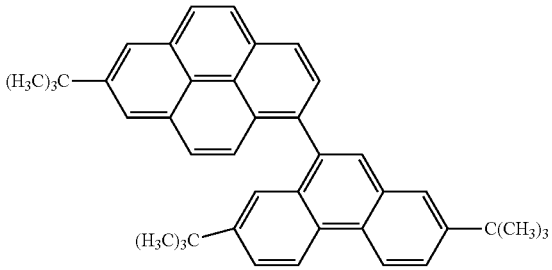
No. 27
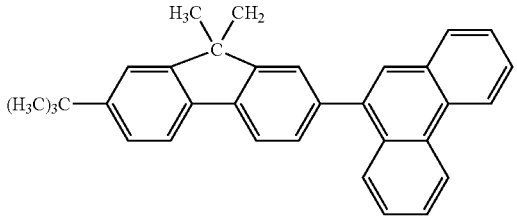
No. 28
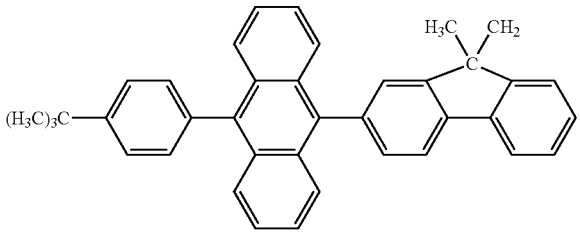
No. 29
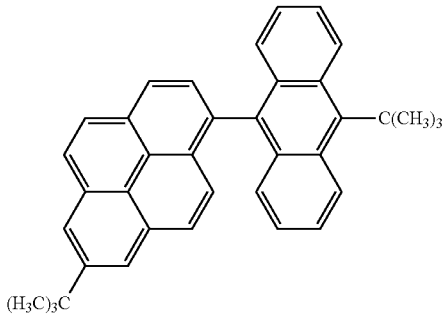
No. 30
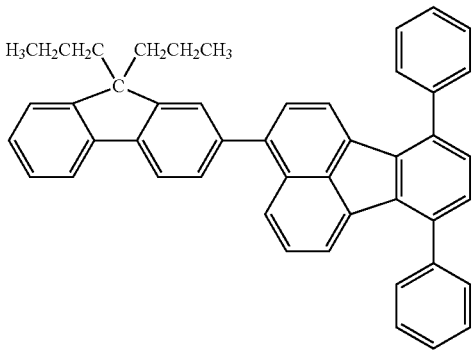
No. 31
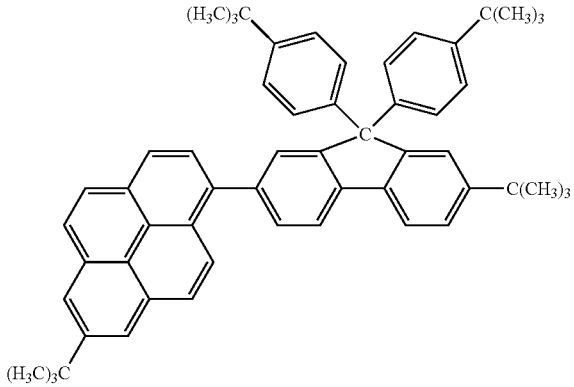
No. 32
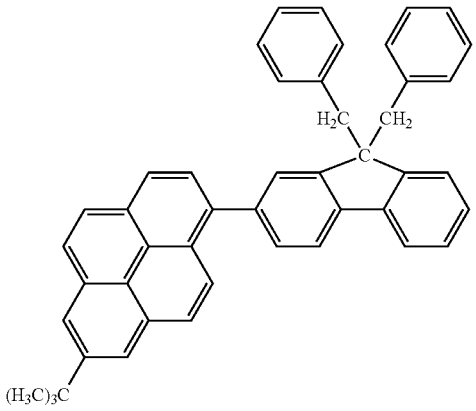
No. 33
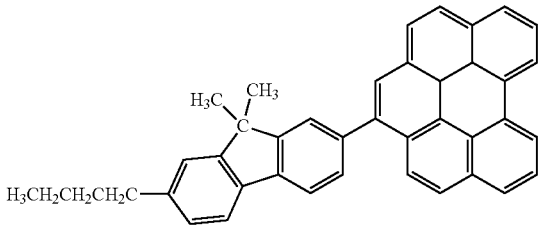
No. 34
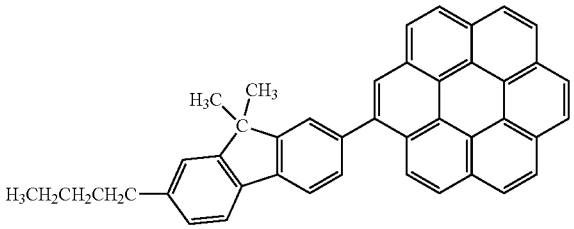

-continued
No. 35
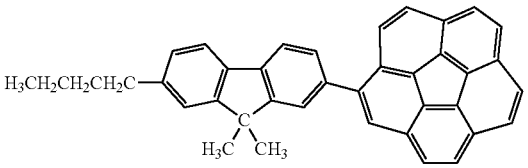
No. 36
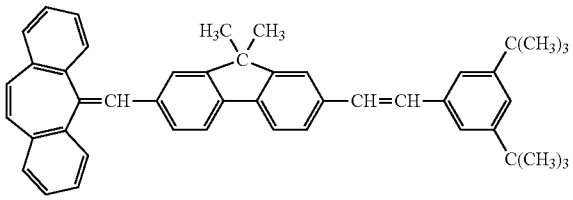
No. 37
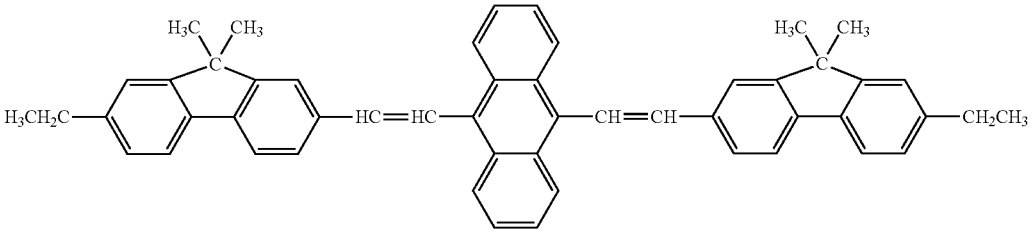
No. 38
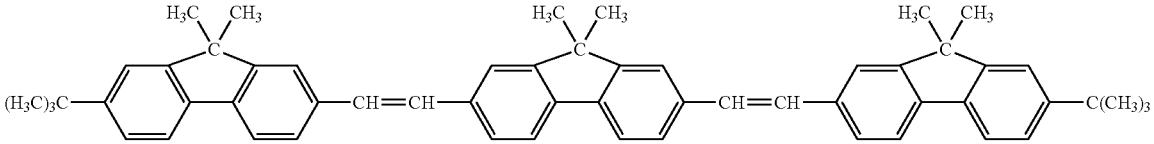
No. 39
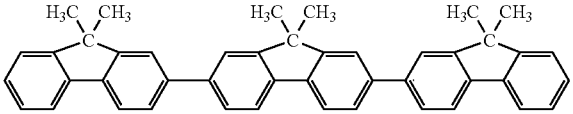
No. 40
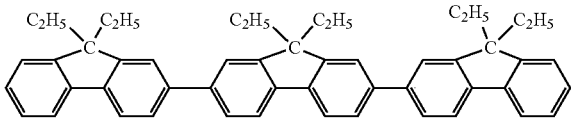
No. 41
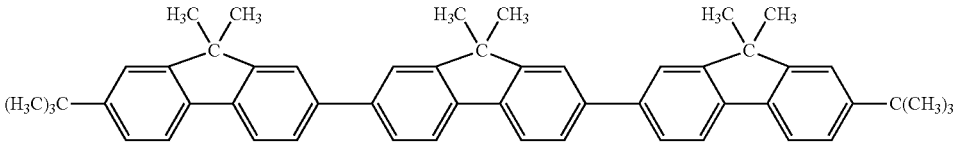
No. 42
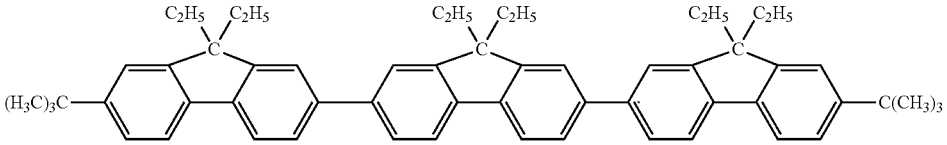
No. 43
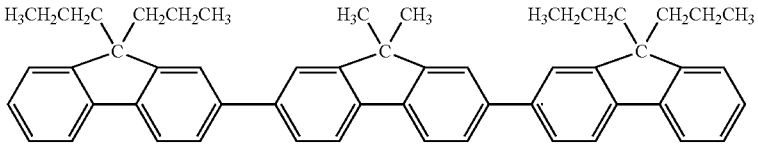
No. 44
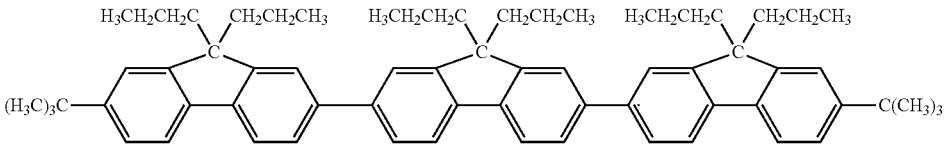

-continued
No. 45
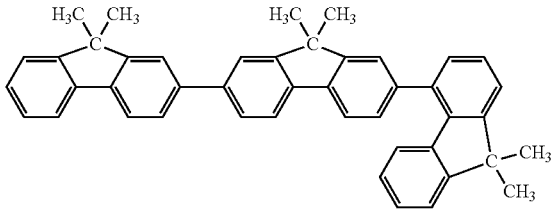
No. 46
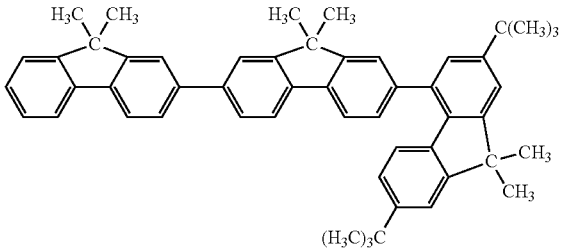
No. 47
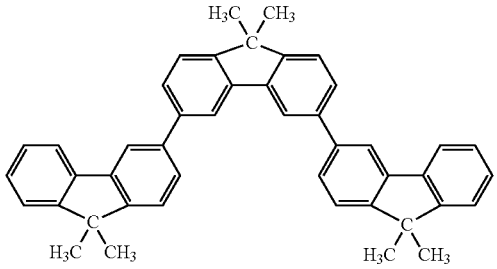
No. 48
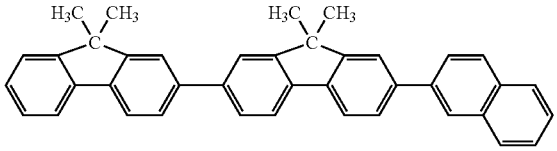
No. 49
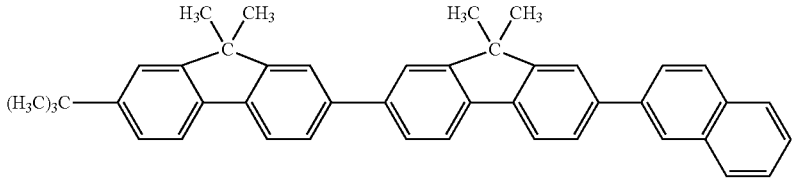
No. 50
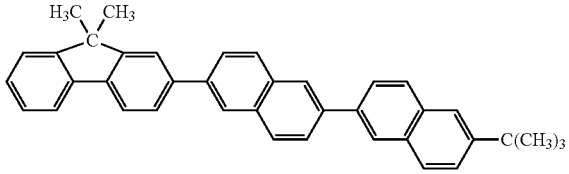
No. 51
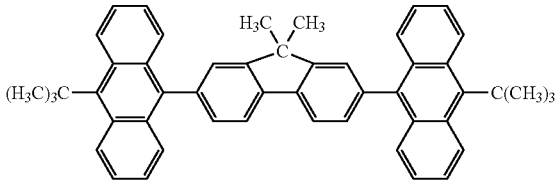
No. 52
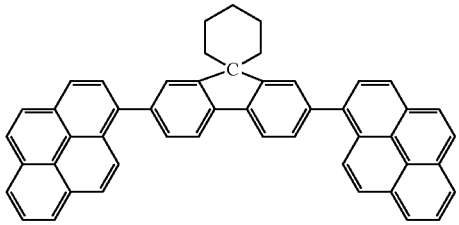
No. 53
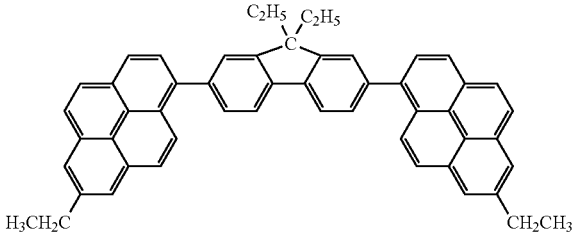
No. 54
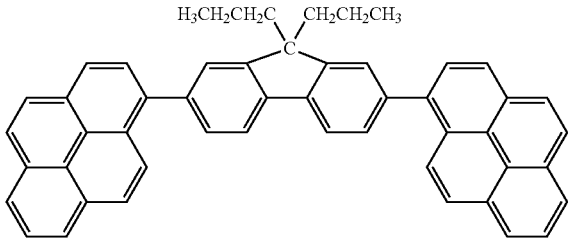
No. 55
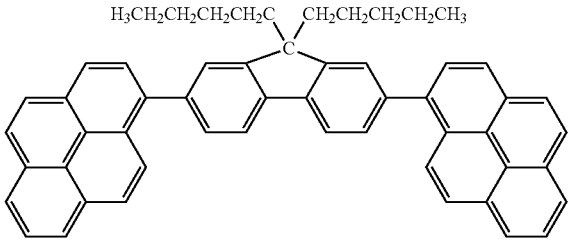

-continued
No. 56
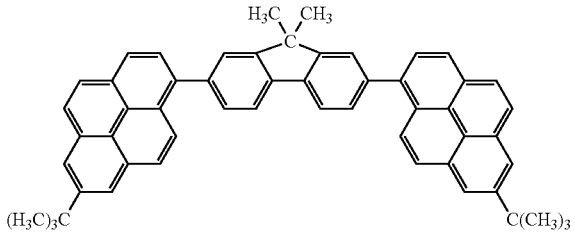
No. 57
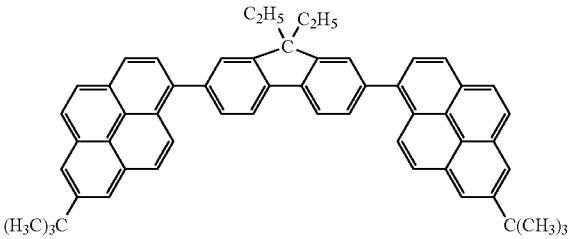
No. 58
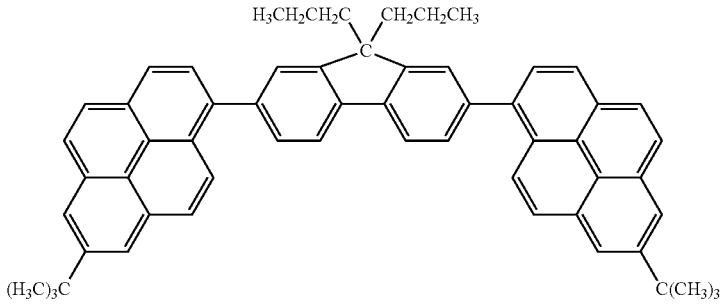
No. 59
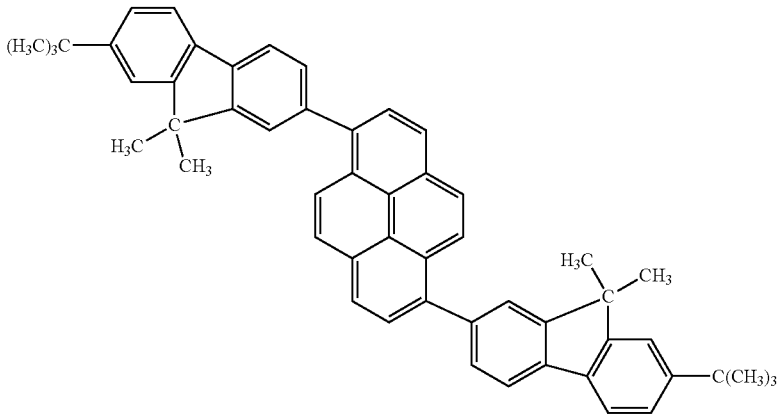
No. 60
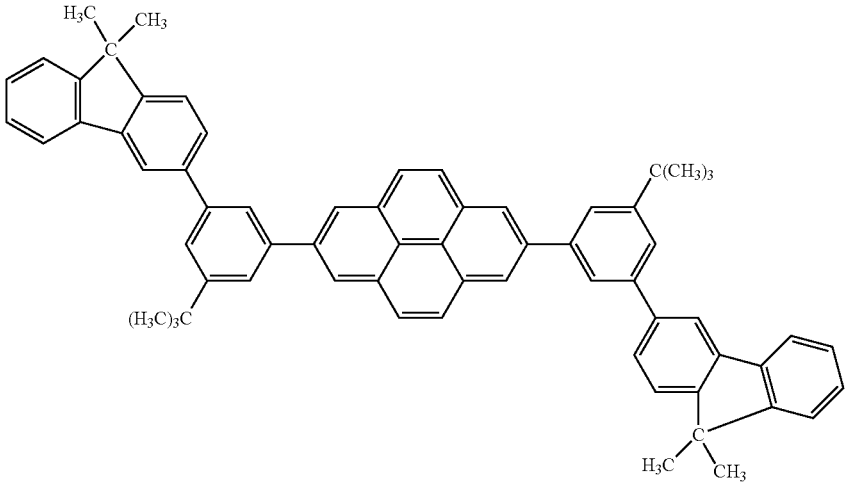

-continued
No. 61
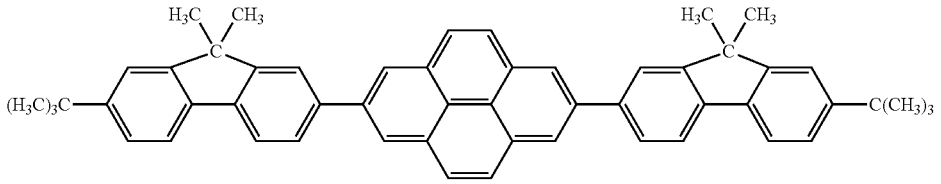
No. 62
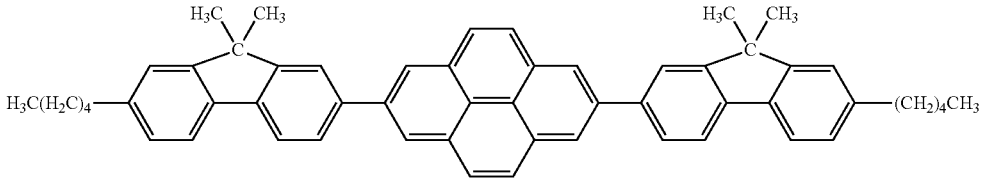
No. 63
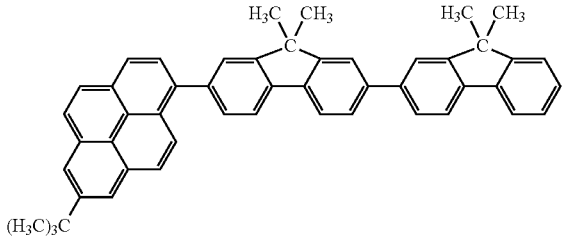
No. 64
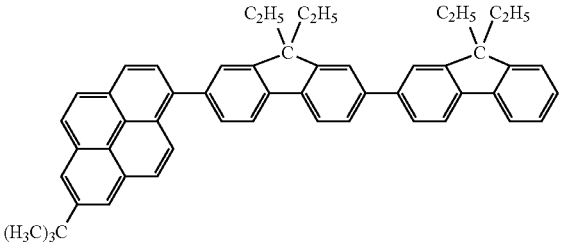
No. 65
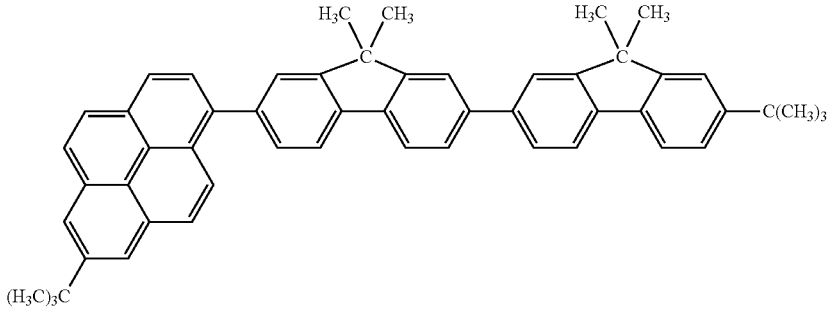
No. 66
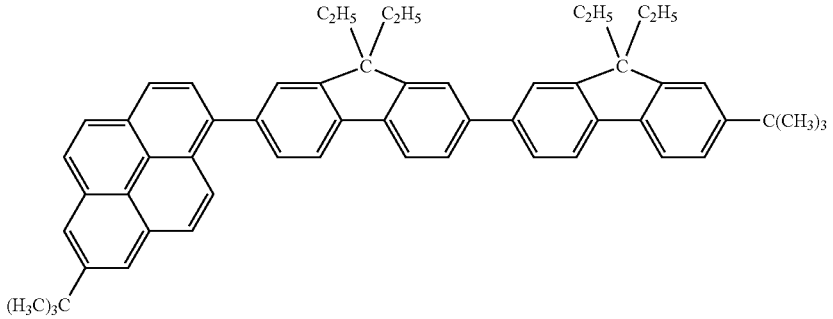
No. 67
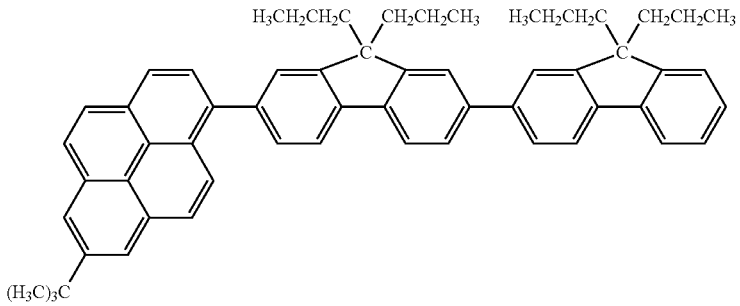

-continued
No. 68
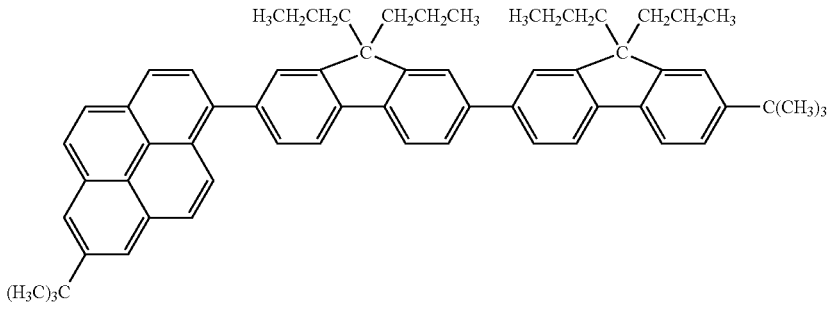
No. 69
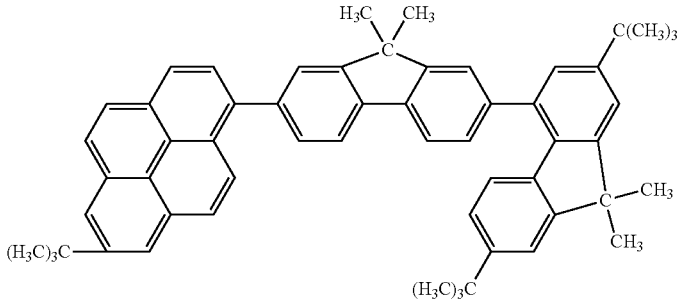
No. 70
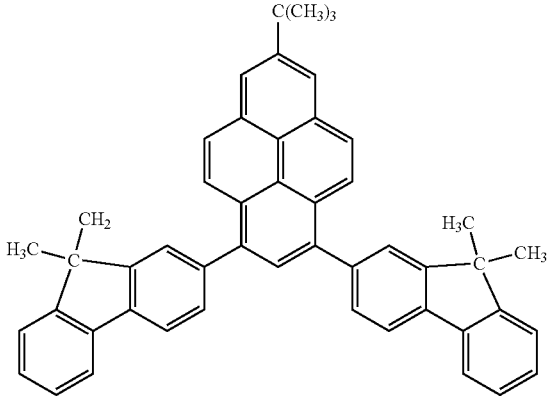
No. 71
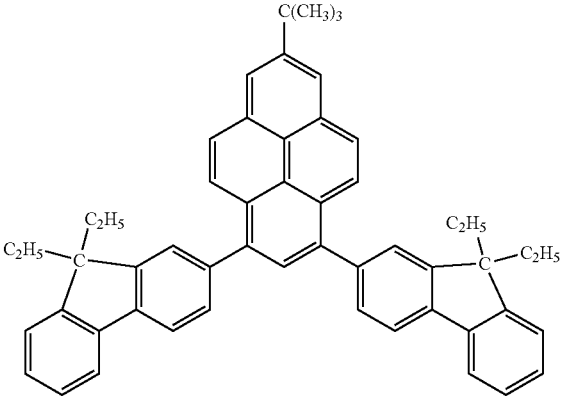
No. 72
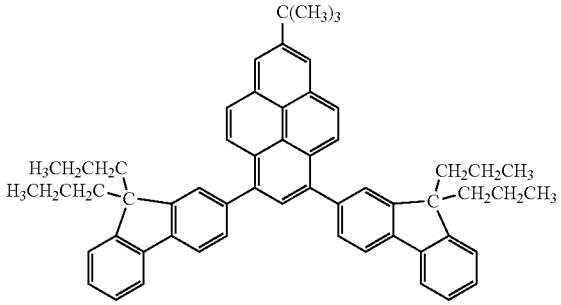
No. 73
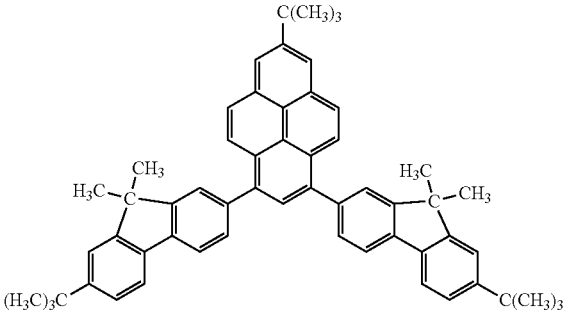

-continued
No. 74
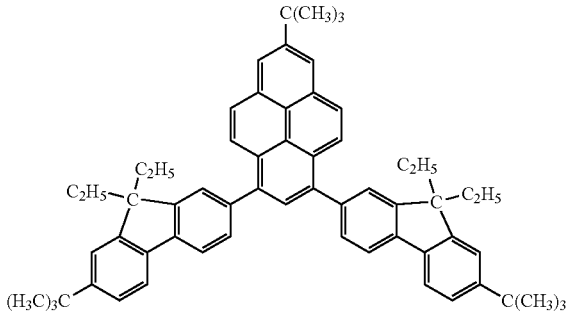
No. 75
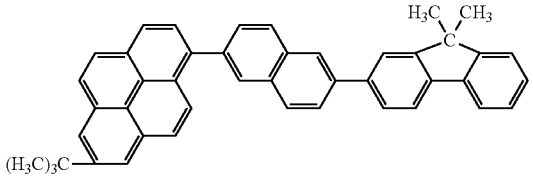
No. 76
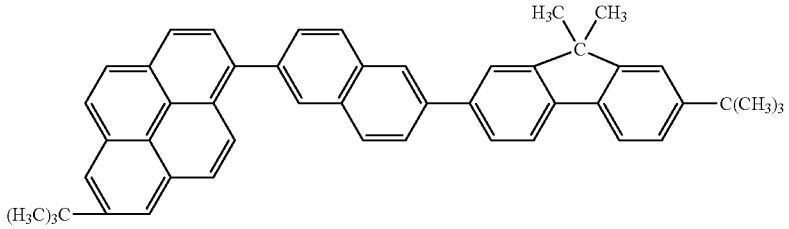
No. 77
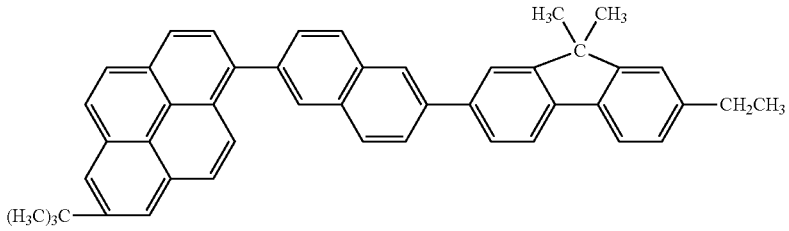
No. 78
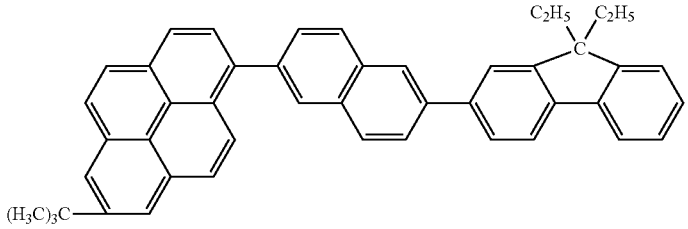
No. 79
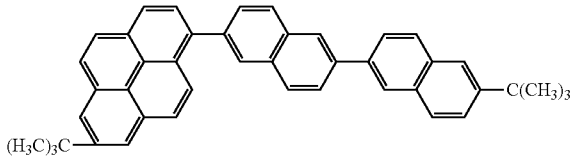
No. 80
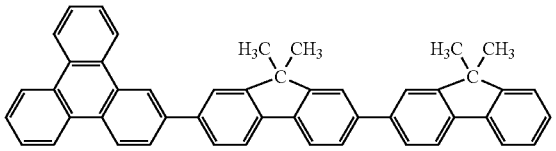
No. 81
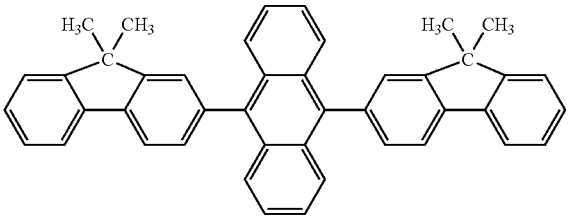
No. 82
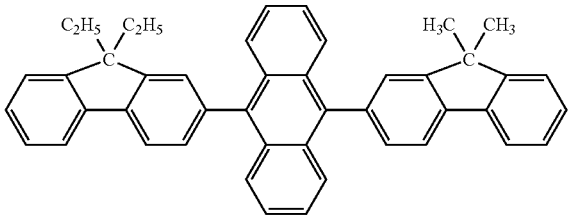

-continued
No. 83
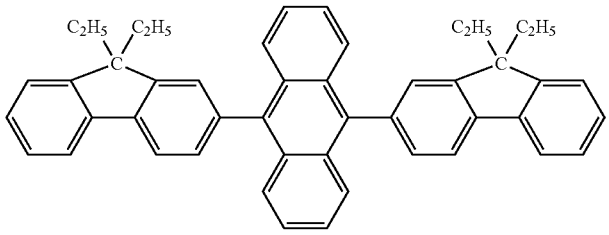
No. 84
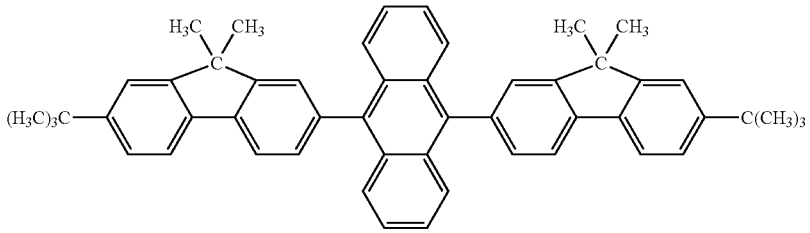
No. 85
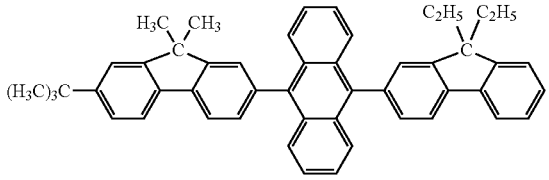
No. 86
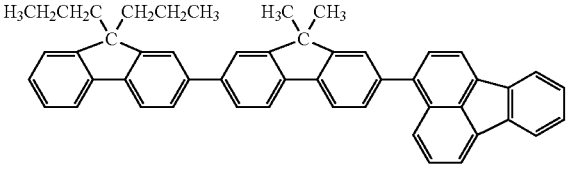
No. 87
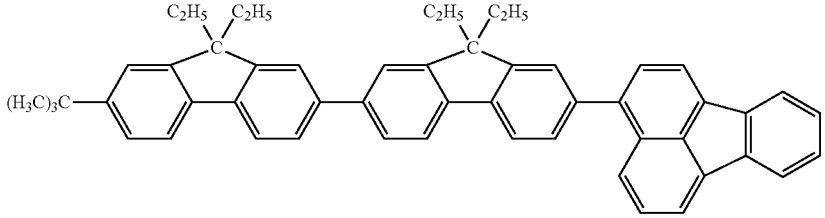
No. 88
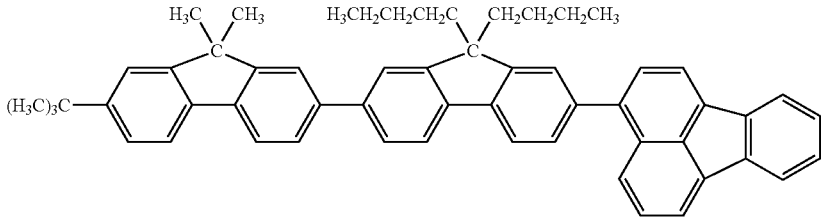
No. 89
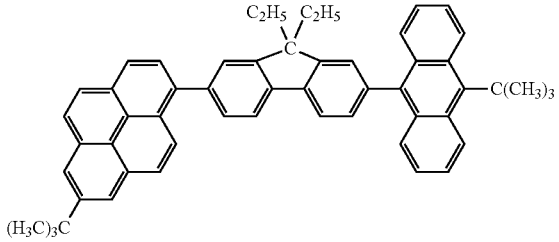
No. 90
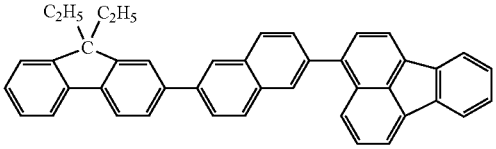

-continued
No. 91
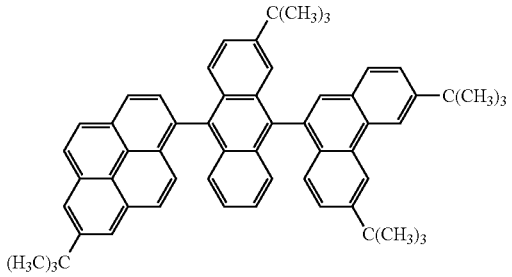
No. 92
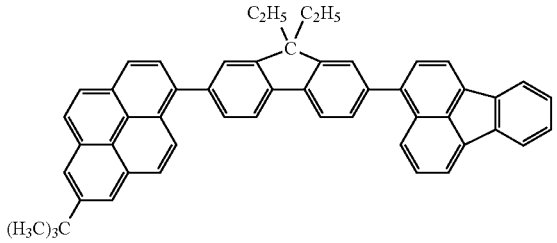
No. 93
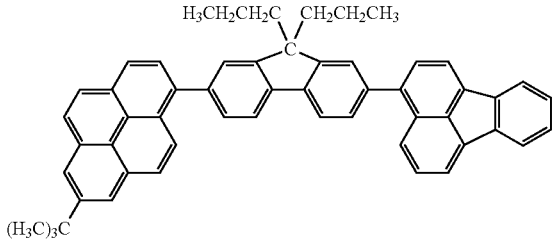
No. 94
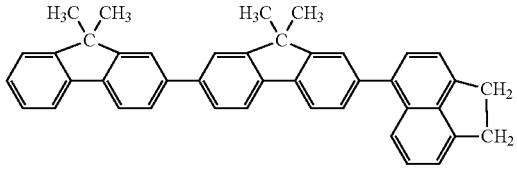
No. 95
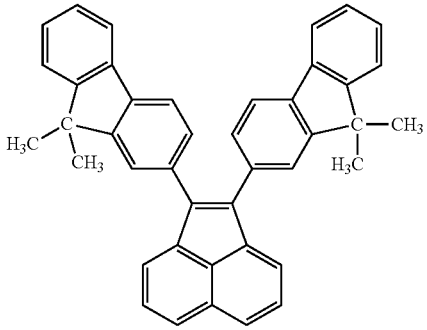
No. 96
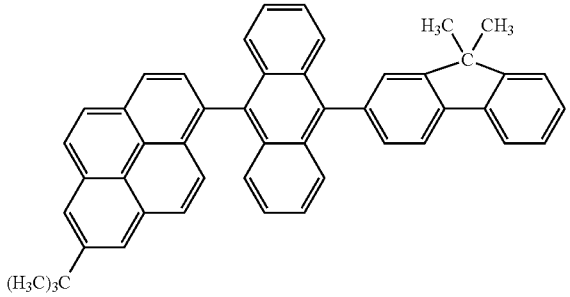
No. 97
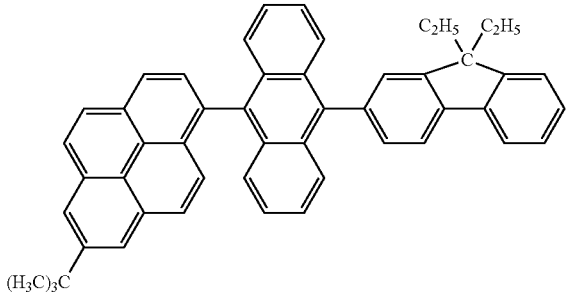
No. 98
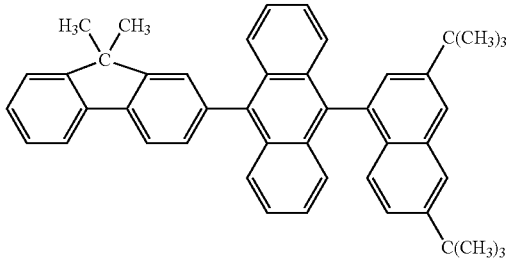
No. 99
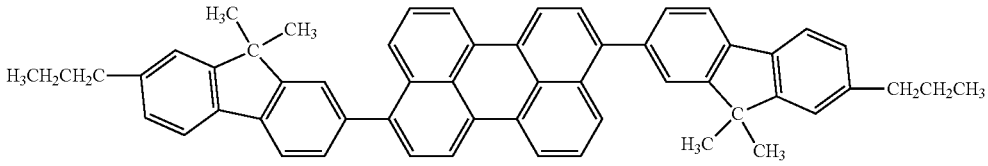

-continued
No. 100
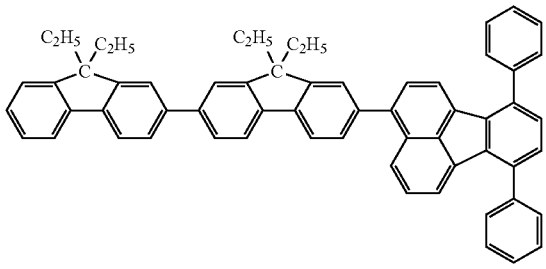
No. 101
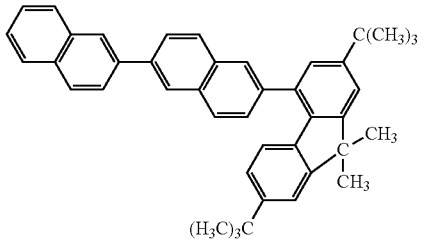
No. 102
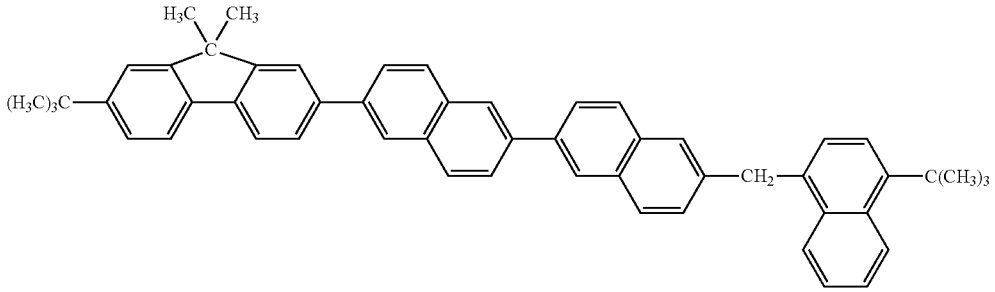
No. 103
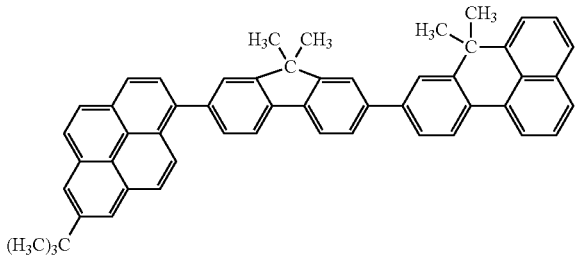
No. 104
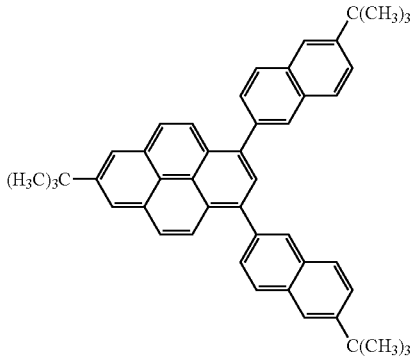
No. 105
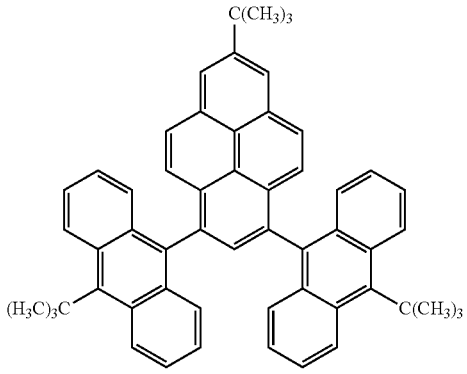
No. 106
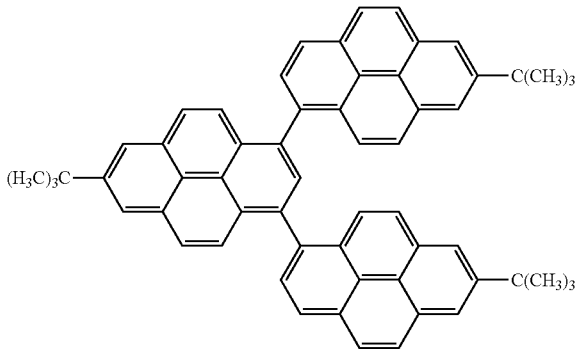

-continued
No. 107
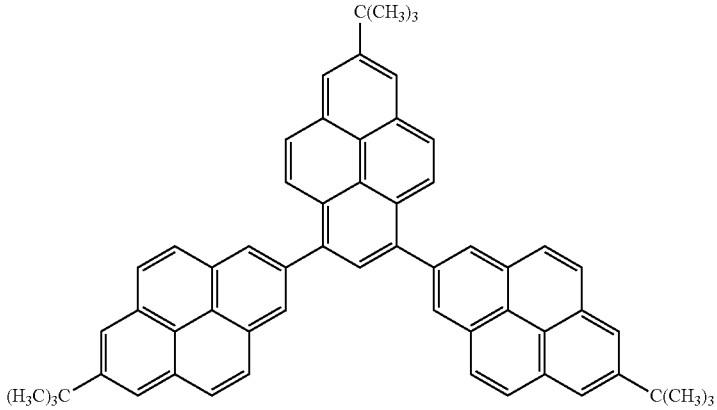
No. 108
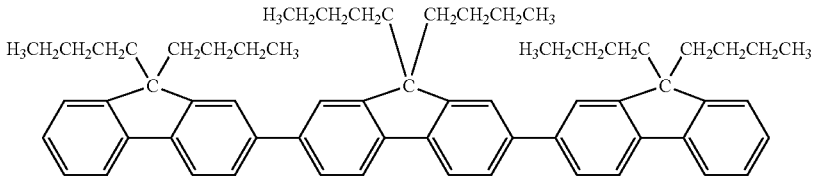
No. 109
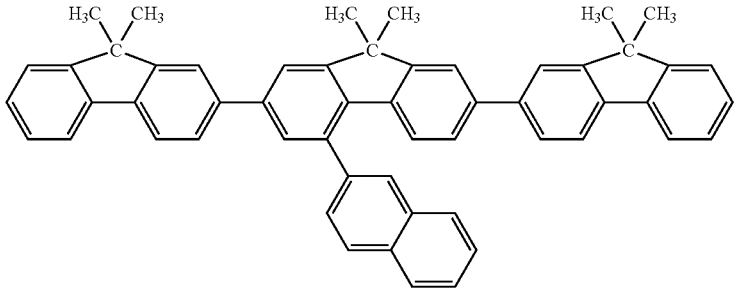
No. 110
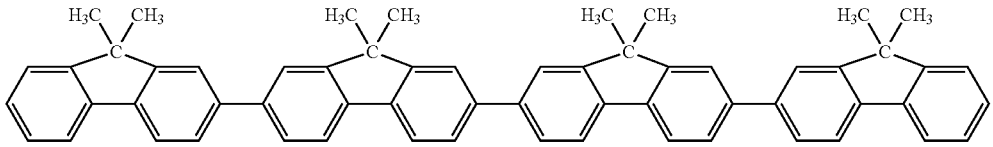
No. 111
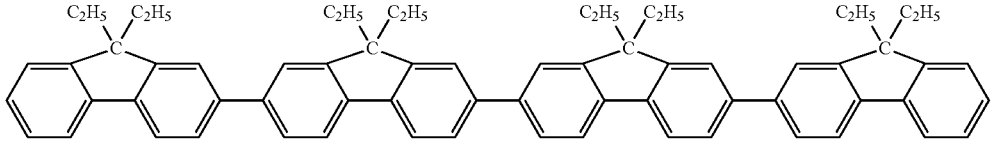
No. 112
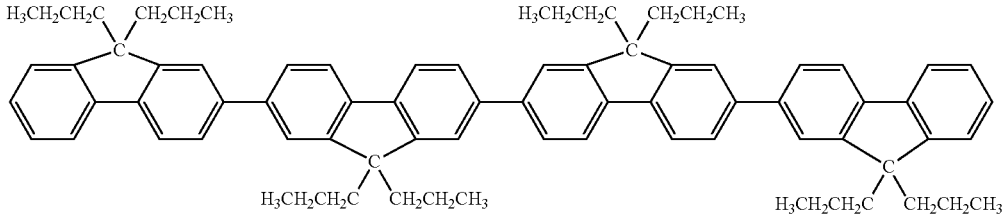
No. 113
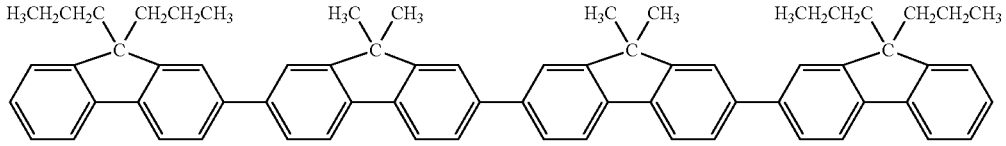

-continued
No. 114
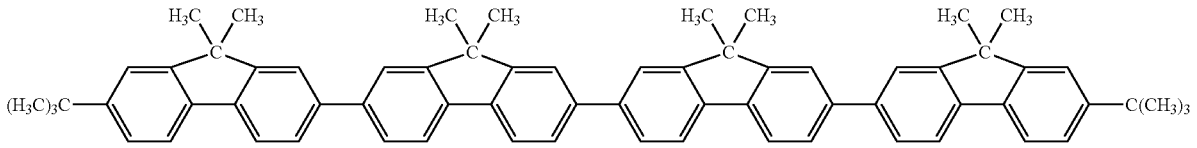
No. 115
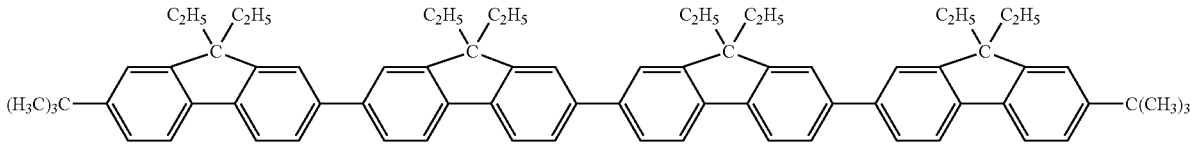
No. 116
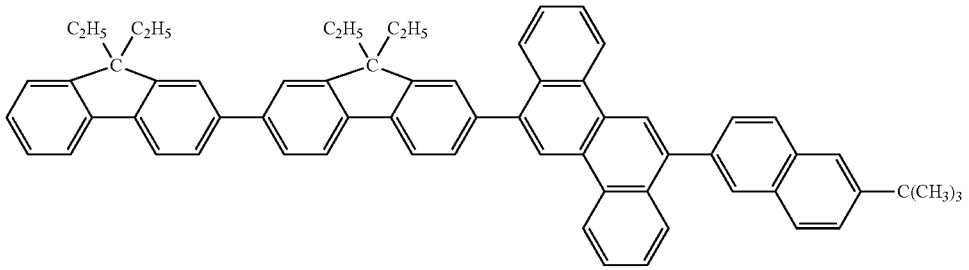
No. 117
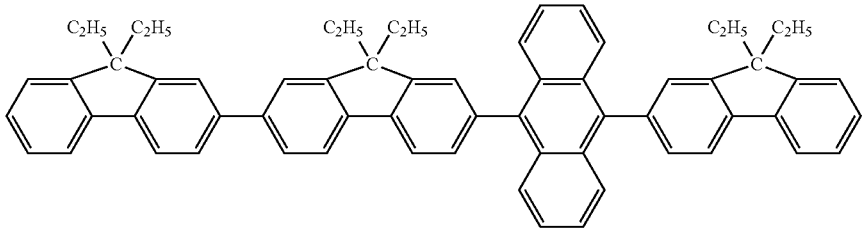
No. 118
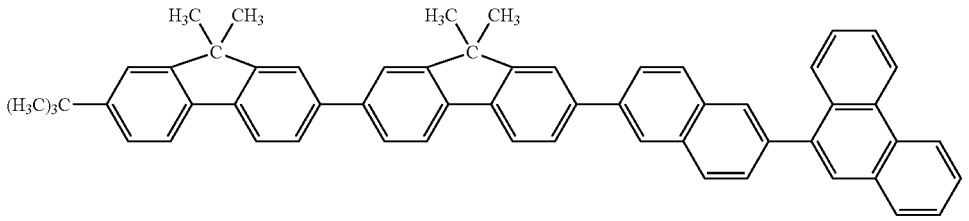
No. 119
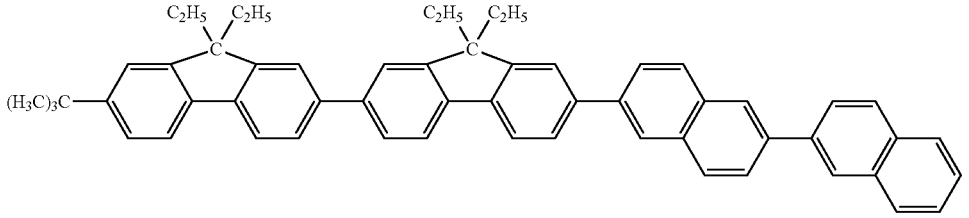

-continued
No. 120
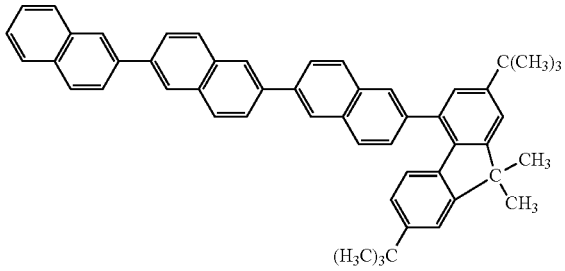
No. 121
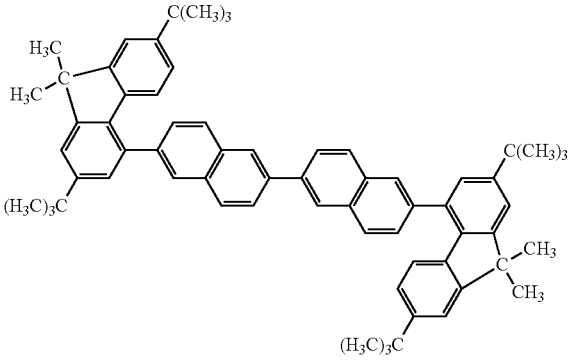
No. 122
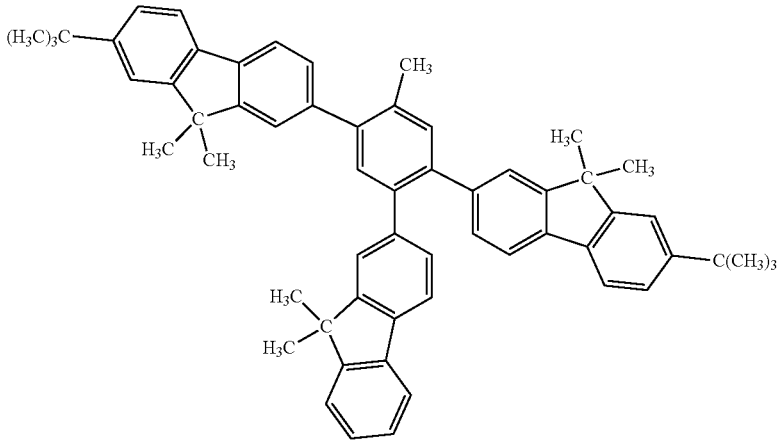
No. 123
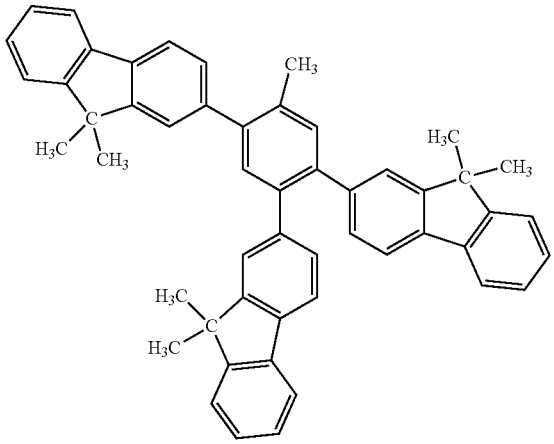
No. 124
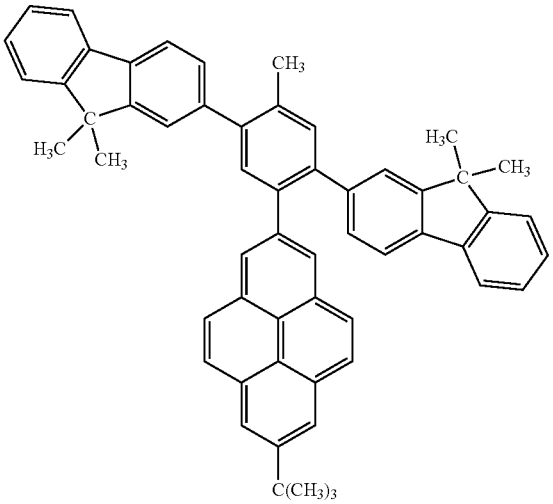

-continued
No. 125
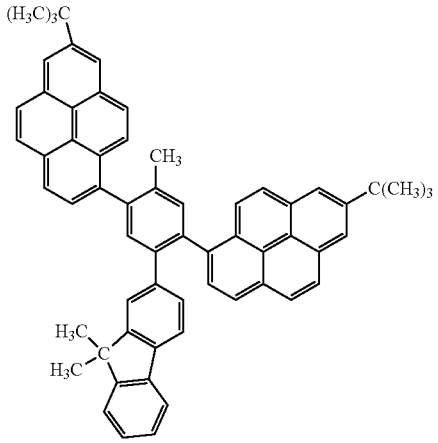
No. 126
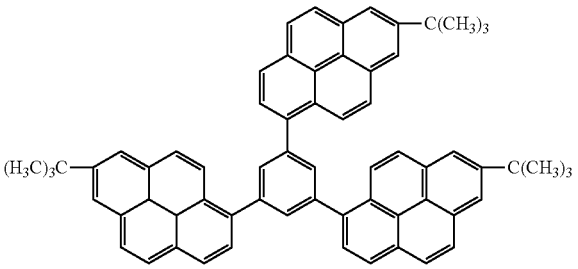
No. 127
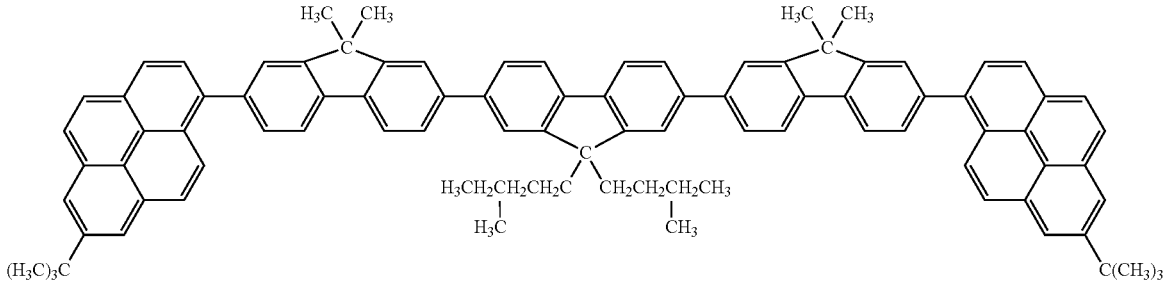
No. 128
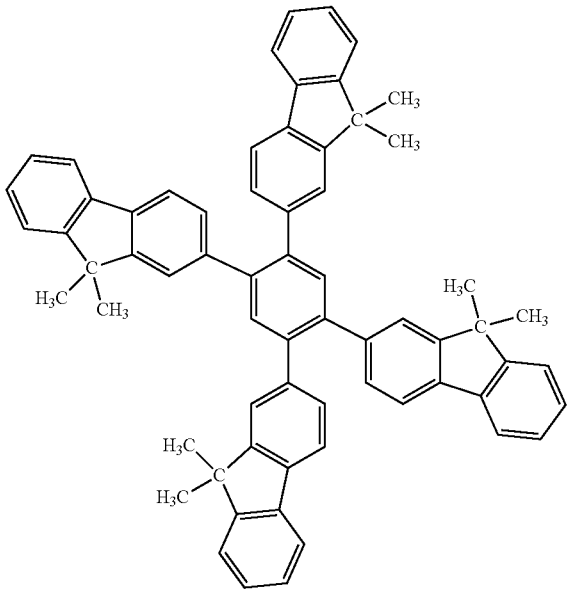

-continued
No. 129
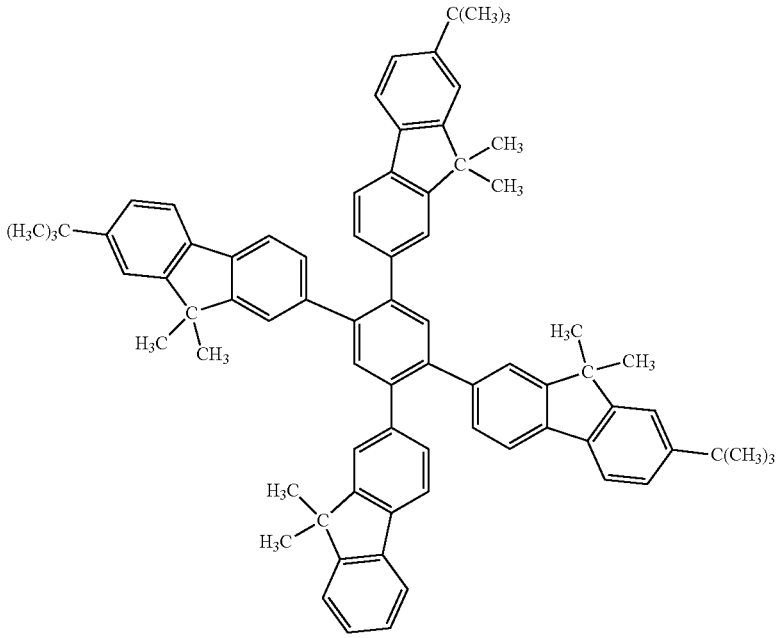
No. 130
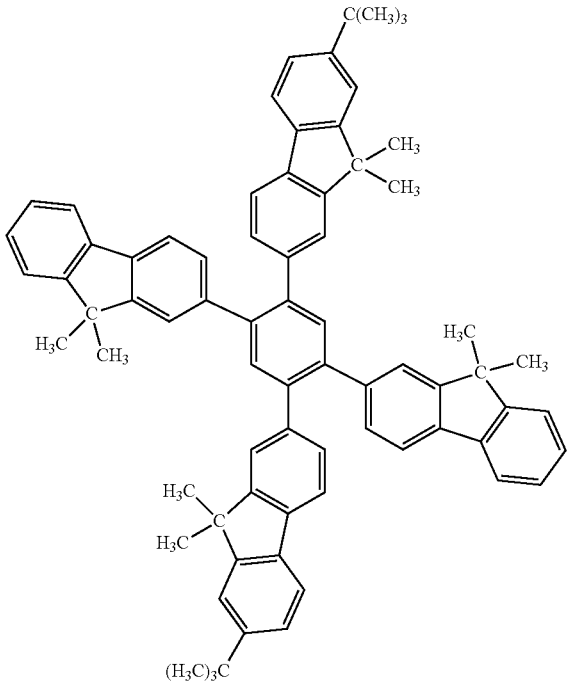

-continued
No. 131
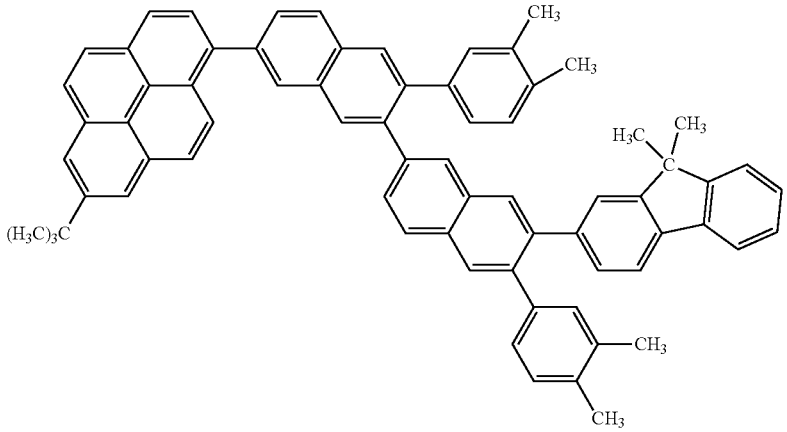
No. 132
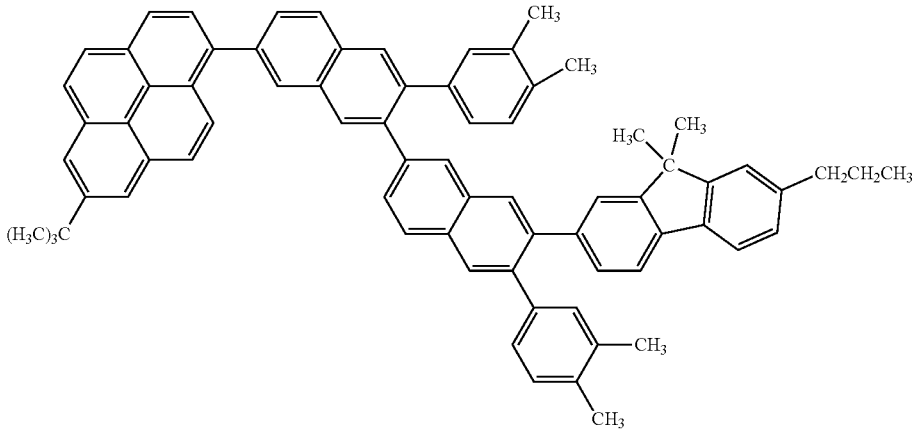
No. 133
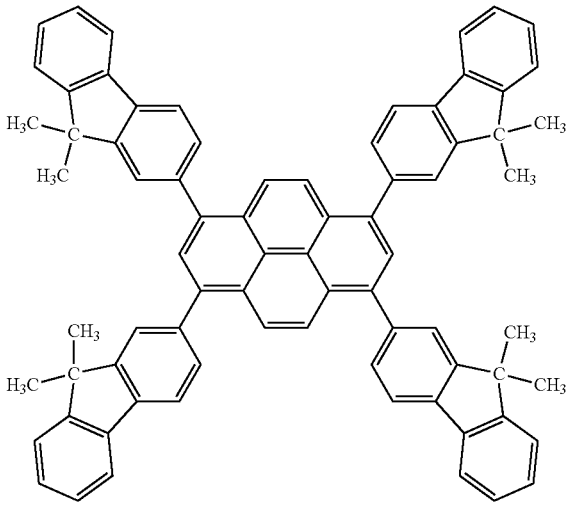

-continued
No. 134
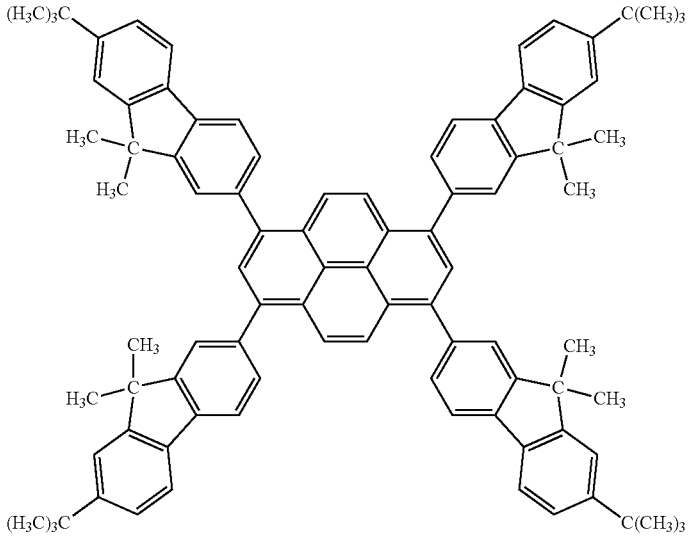
No. 135
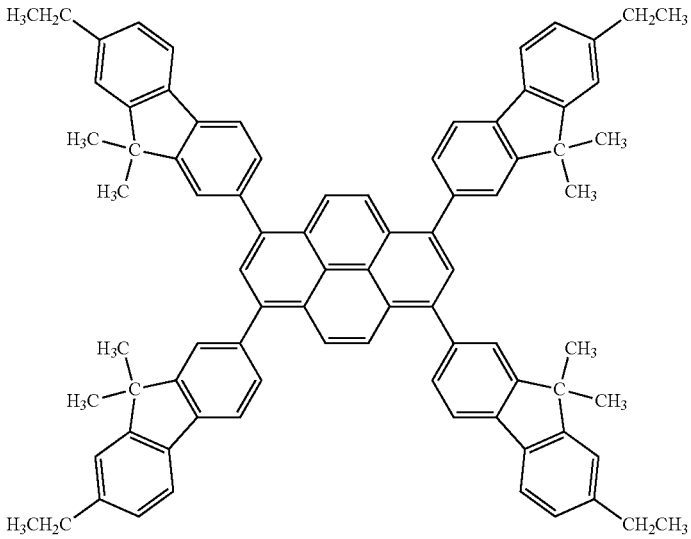
No. 136
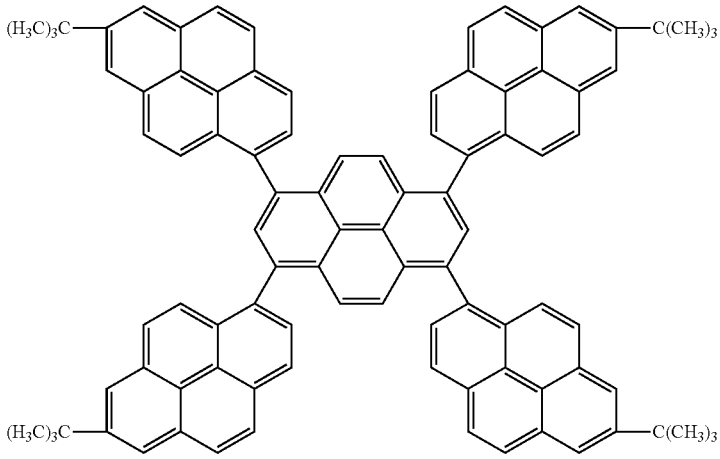

-continued
No. 137
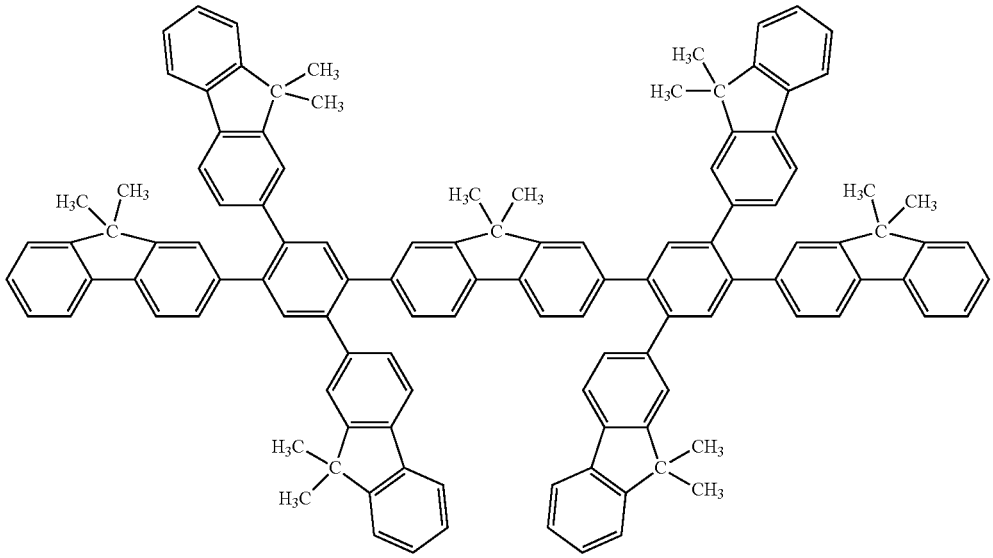
No. 138
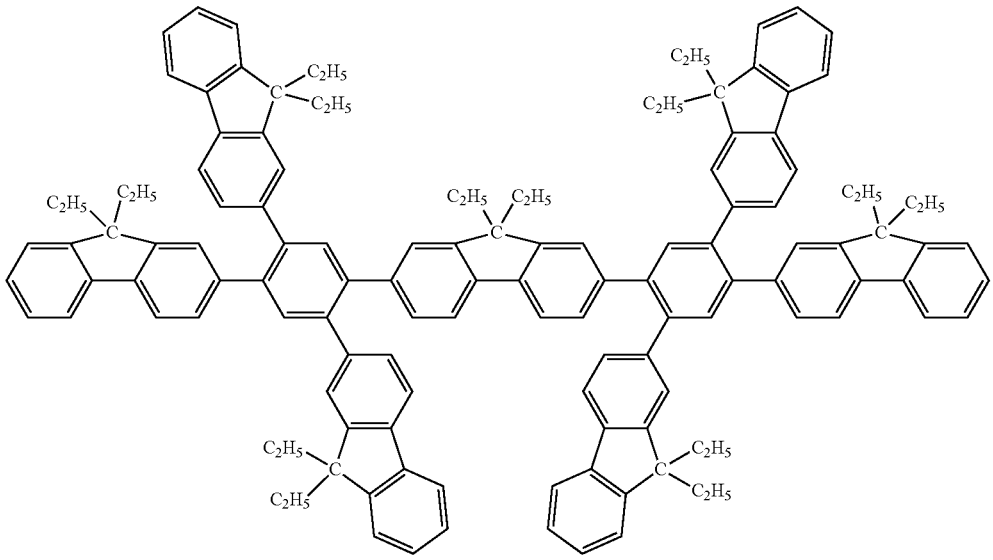
No. 139
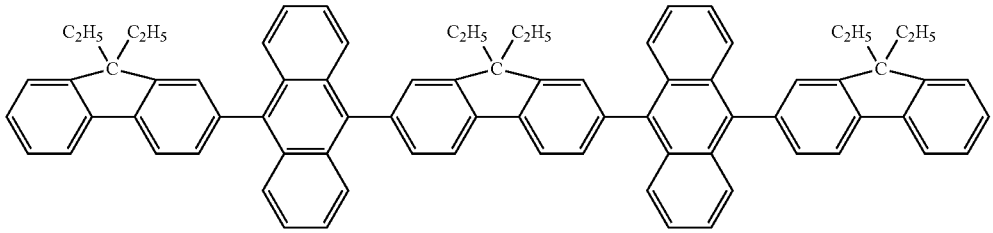

-continued
No. 140
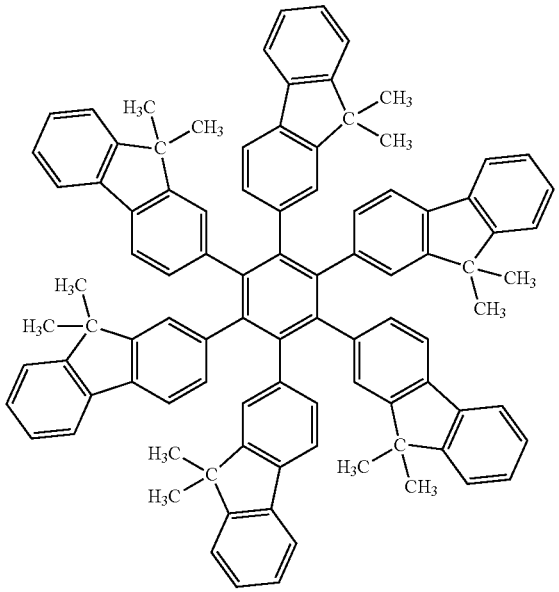
No. 141
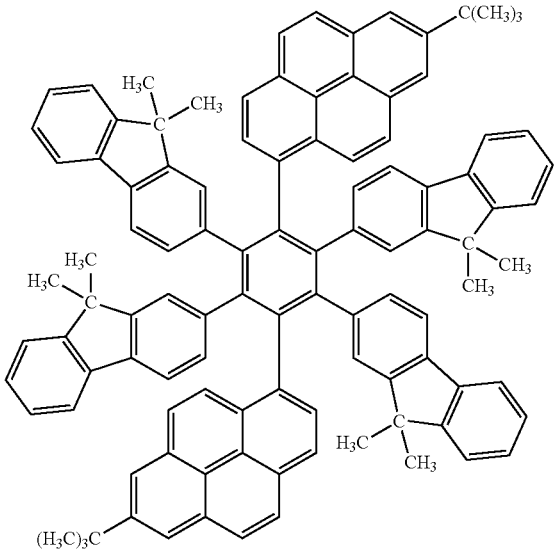
No. 142
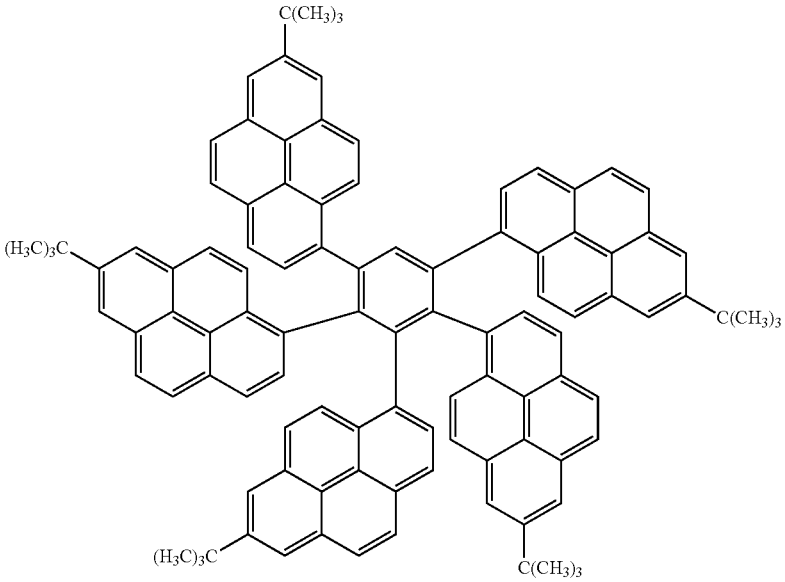

-continued
No. 143
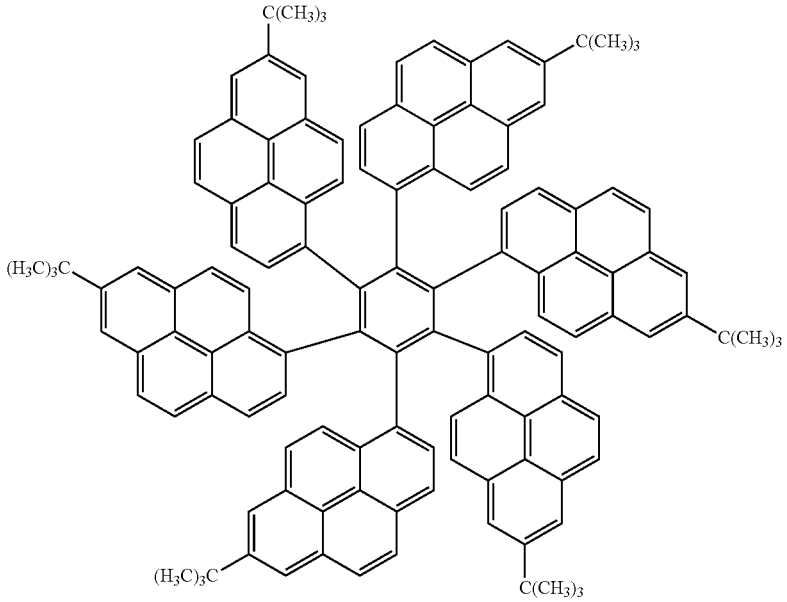
No. 144
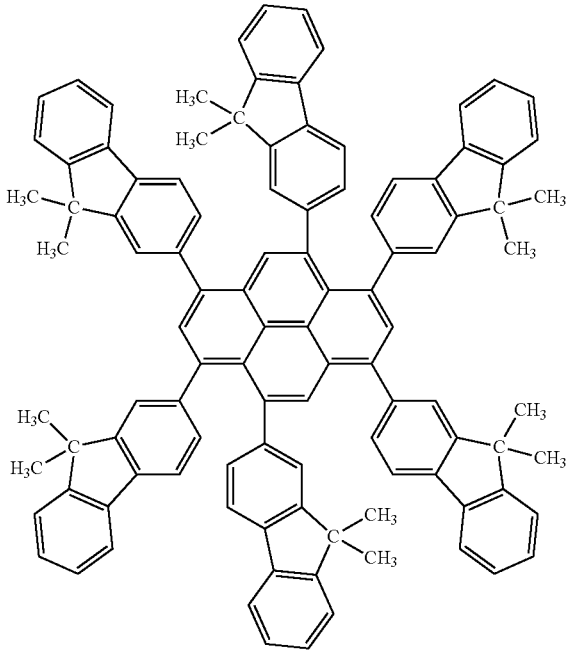
No. 145
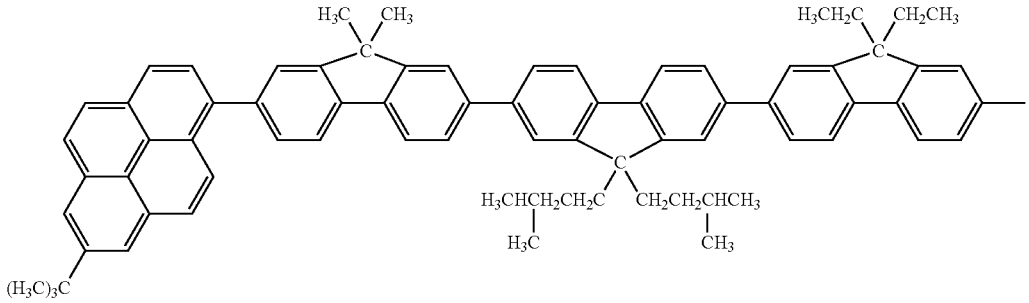

-continued
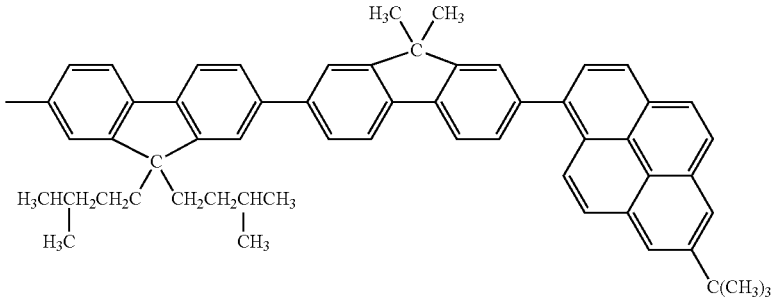
No. 146
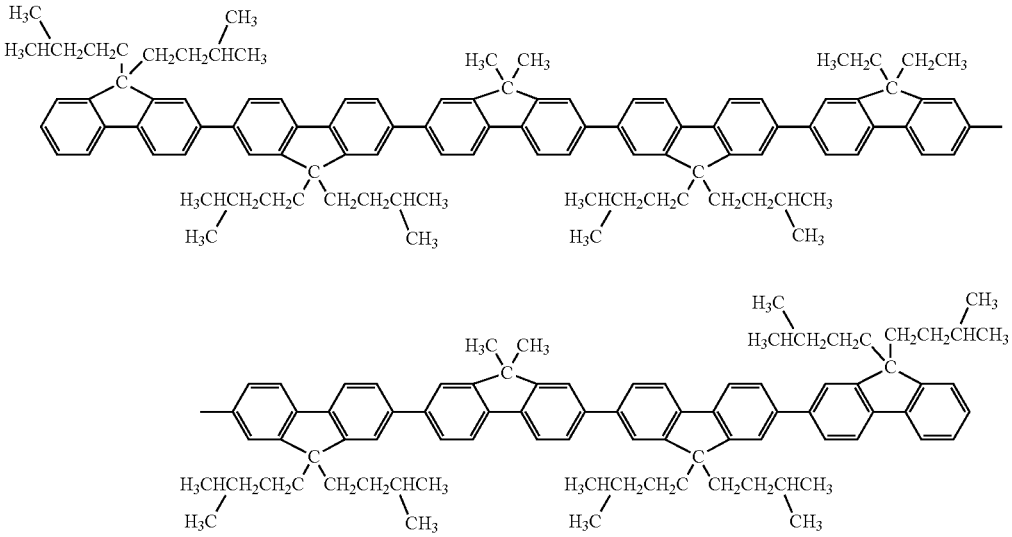
No. 147
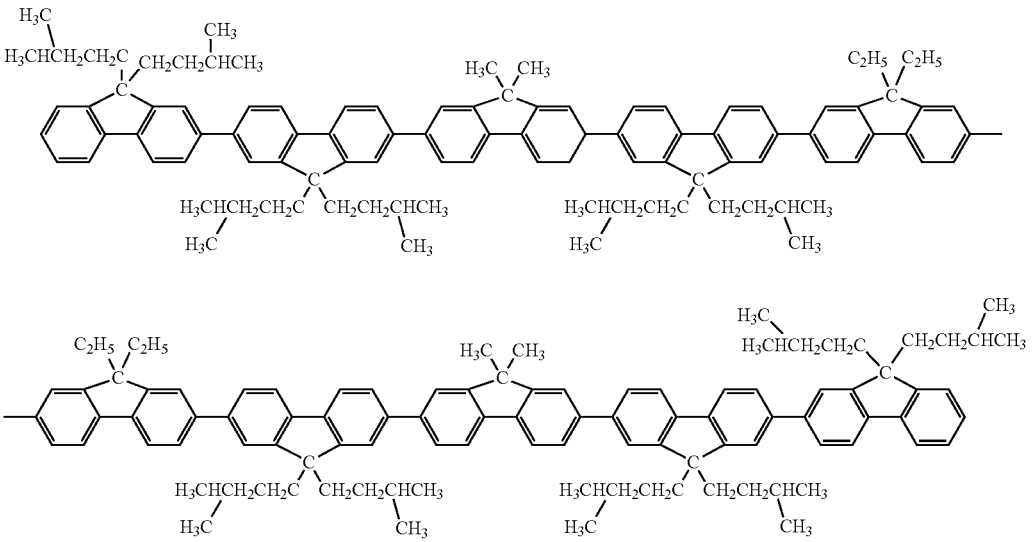
No. 148
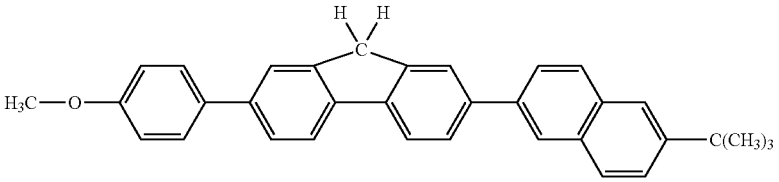

-continued
No. 149
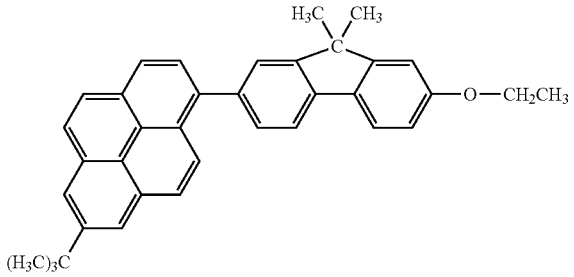
No. 150
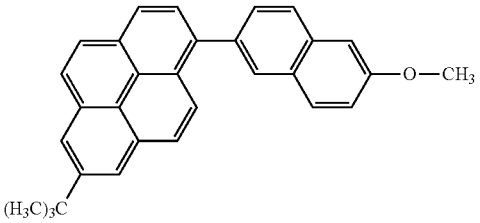
No. 151
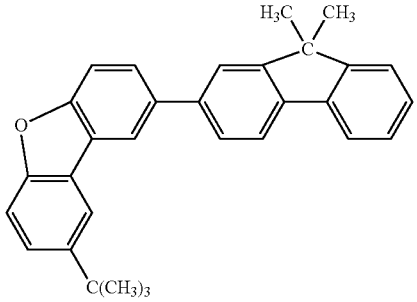
No. 152
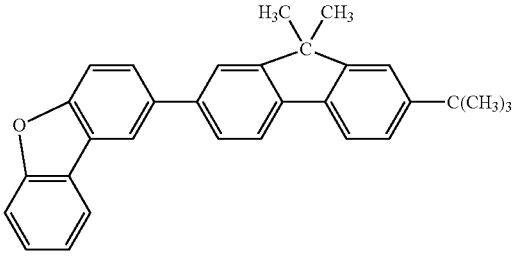
No. 153
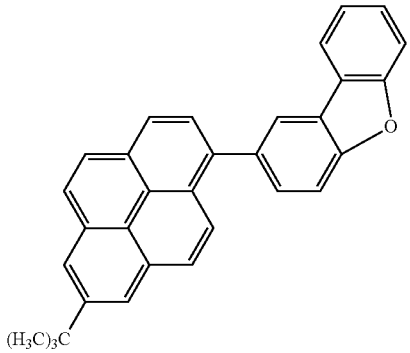
No. 154
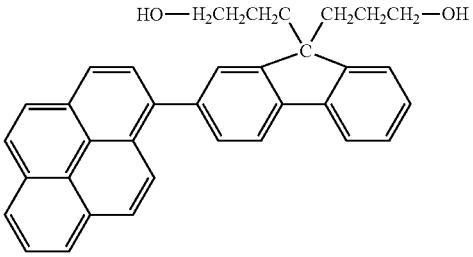
No. 155
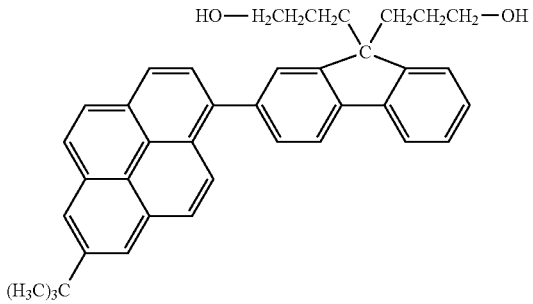
No. 156
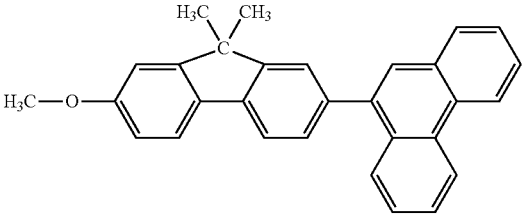
No. 157
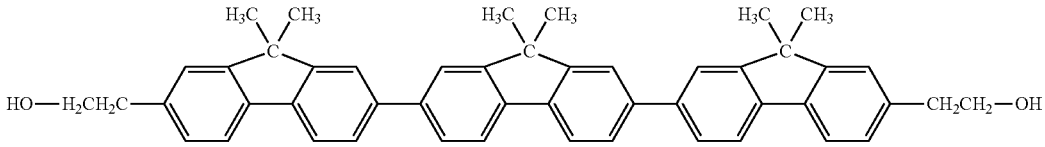

-continued
No. 158
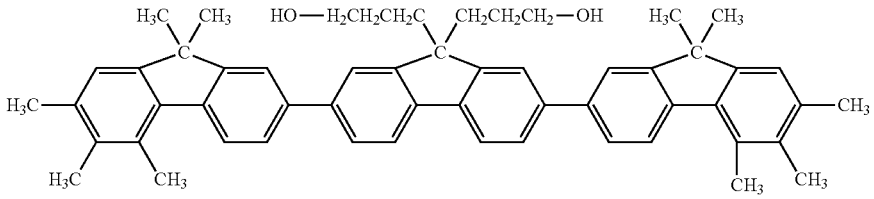
No. 159
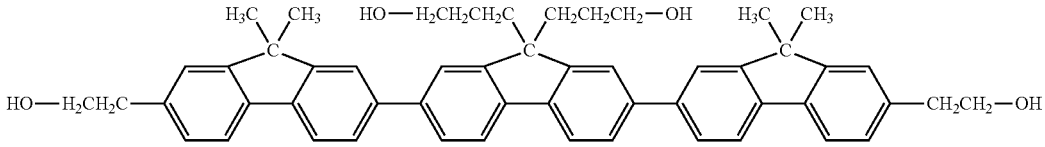
No. 160
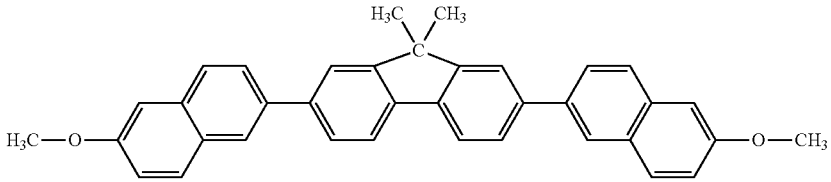
No. 161
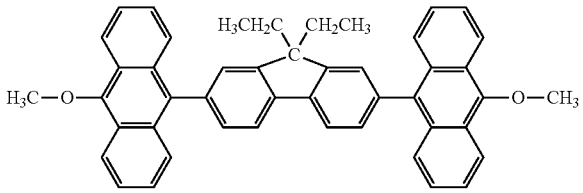
No. 162
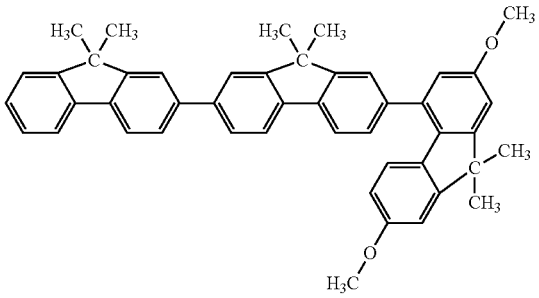
No. 163
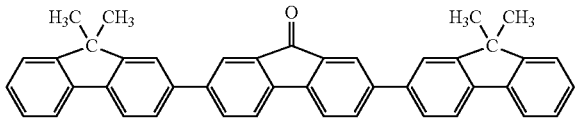
No. 164
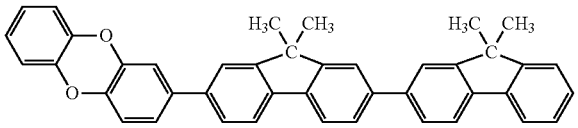
No. 165
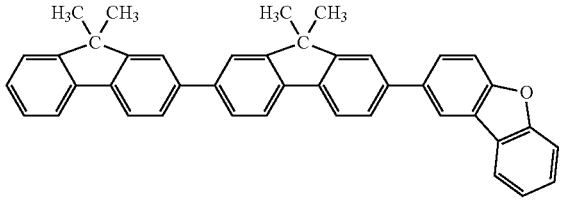
No. 166
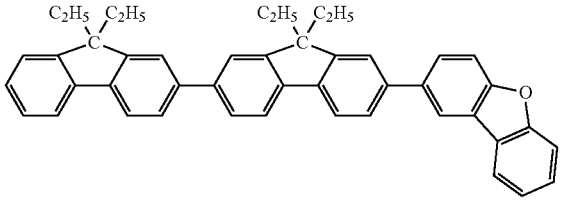
No. 167
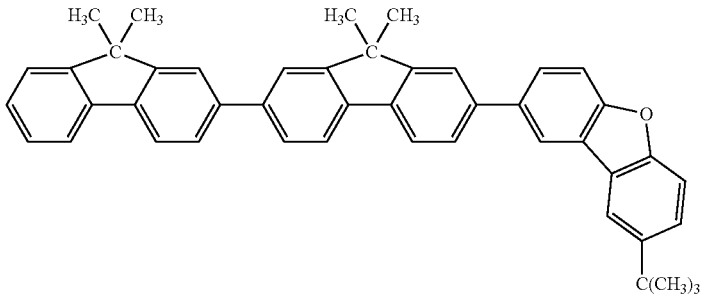

-continued
No. 168
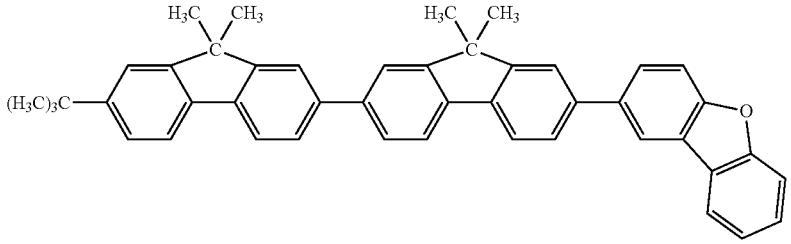
No. 169
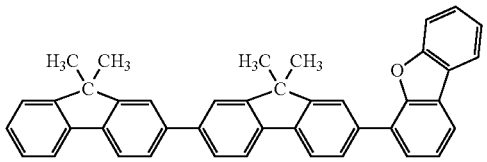
No. 170
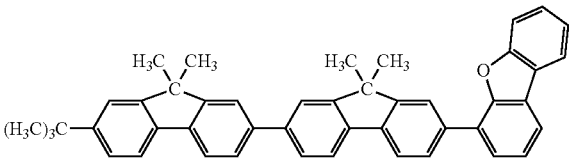
No. 171
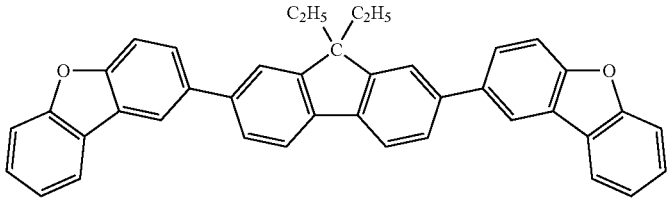
No. 172
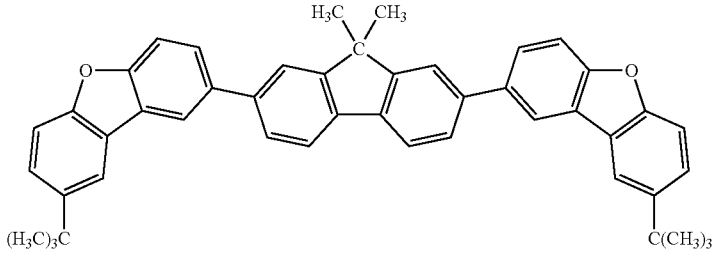
No. 173
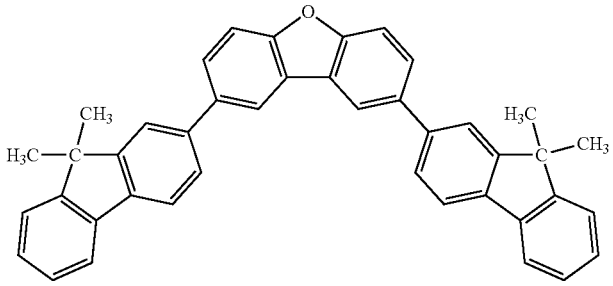
No. 174
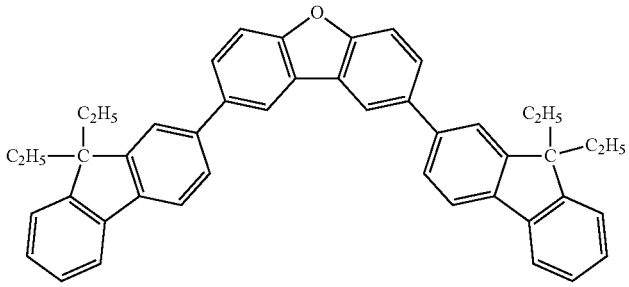

-continued
No. 175
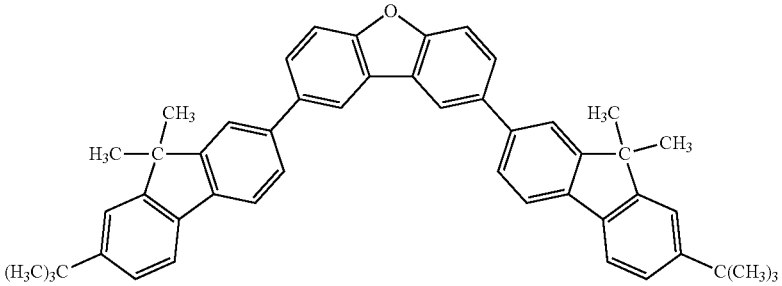
No. 176
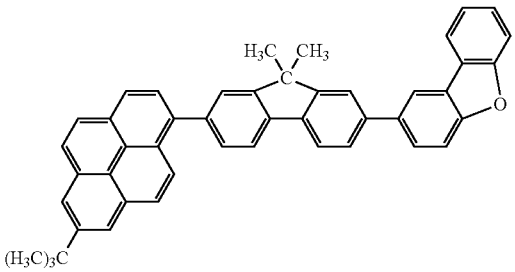
No. 177
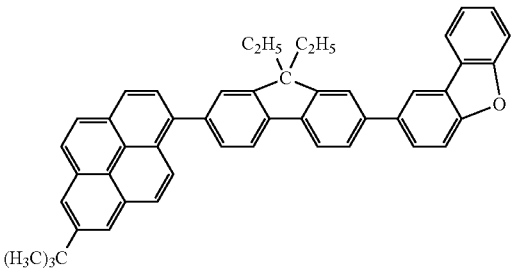
No. 178
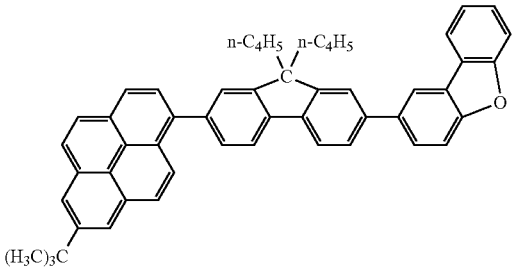
No. 179
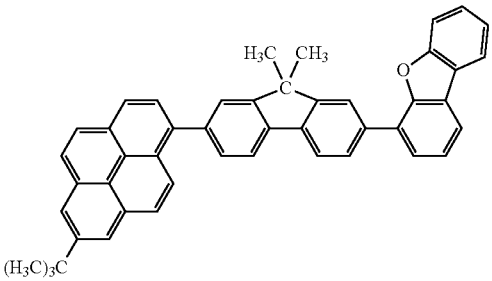
No. 180
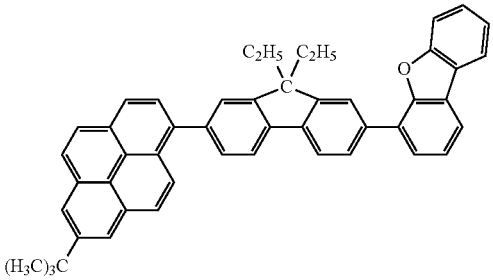
No. 181
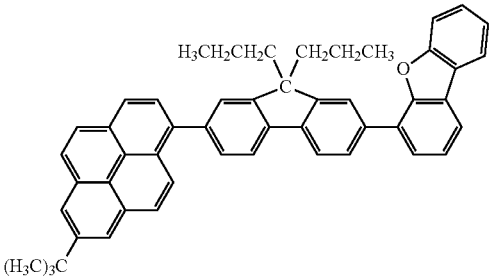
No. 182
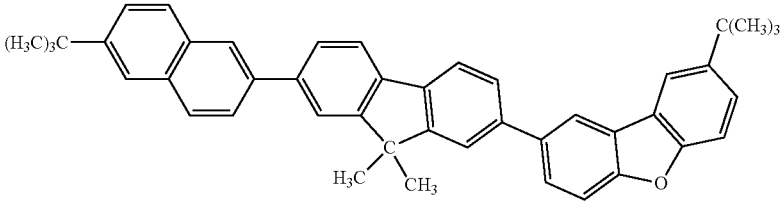
No. 183
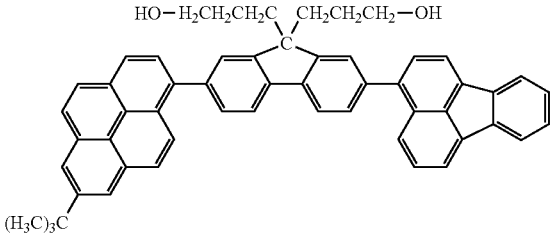
No. 184
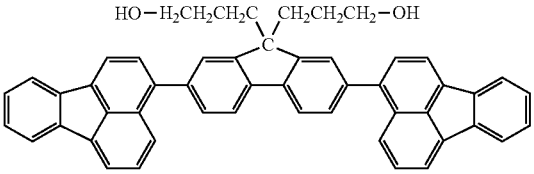

-continued
No. 185
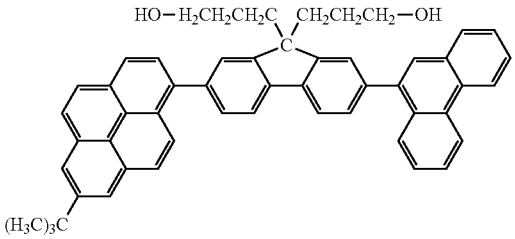
No. 186
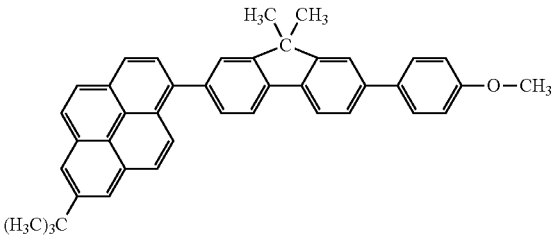
No. 187
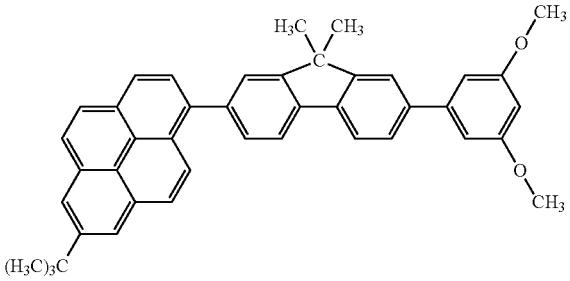
No. 188
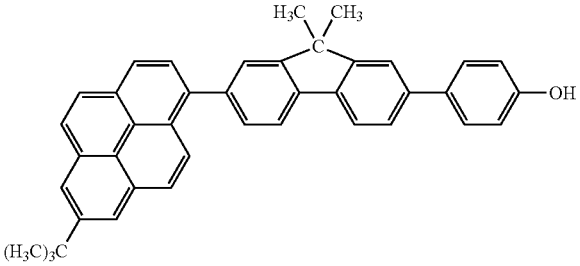
No. 189
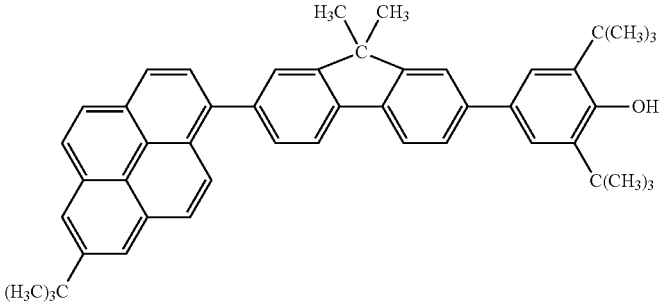
No. 190
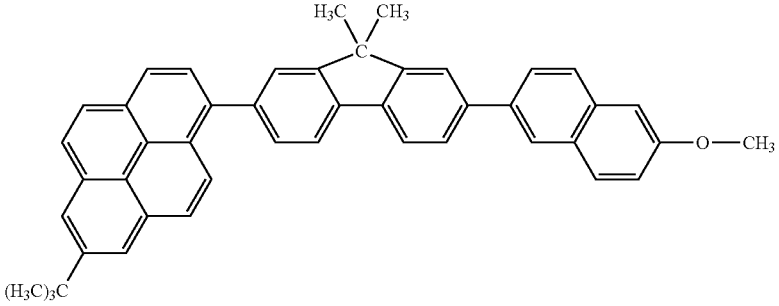
No. 191
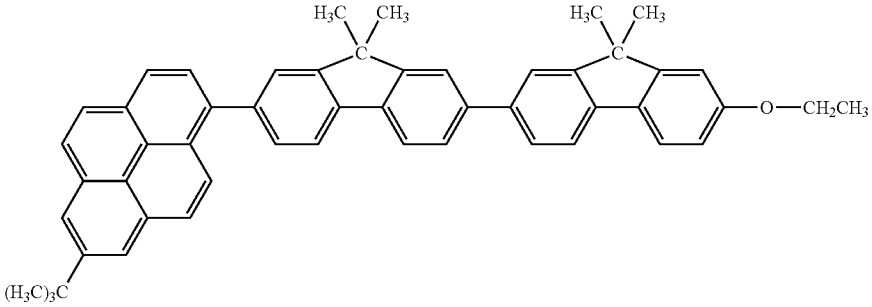

-continued
No. 192
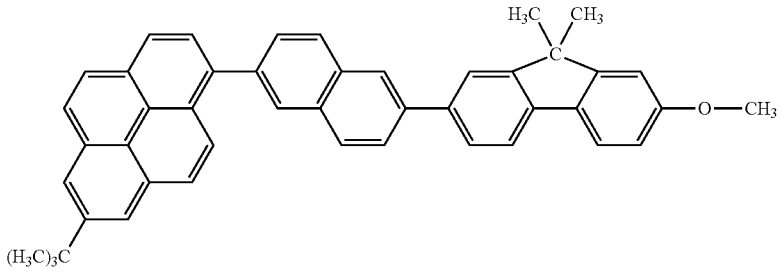
No. 193
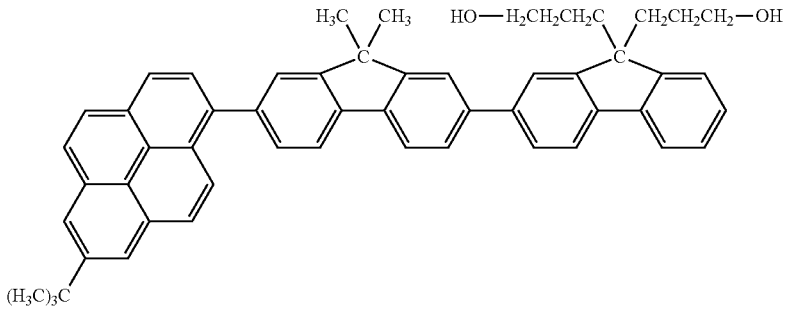
No. 194
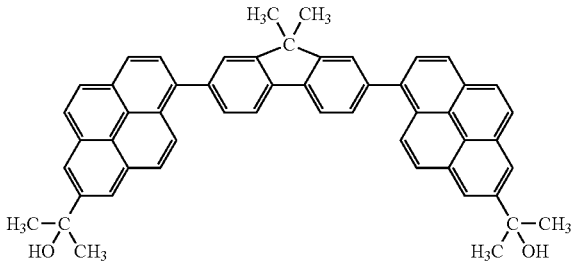
No. 195
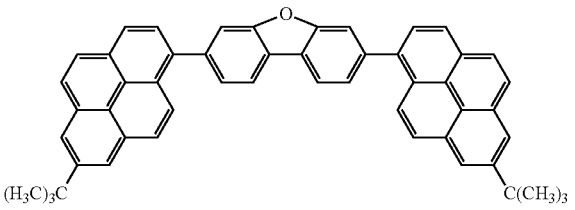
No. 196
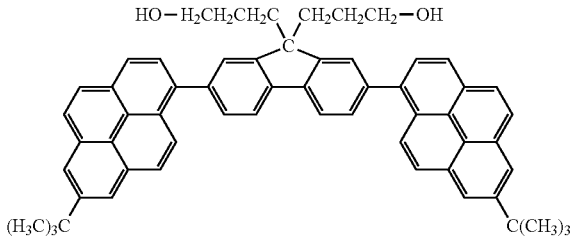
No. 197
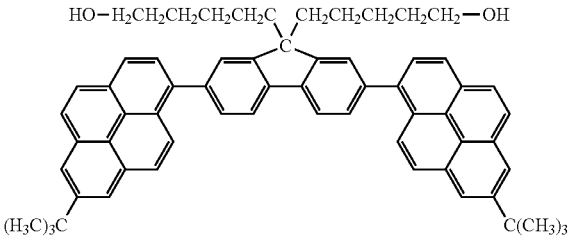
No. 198
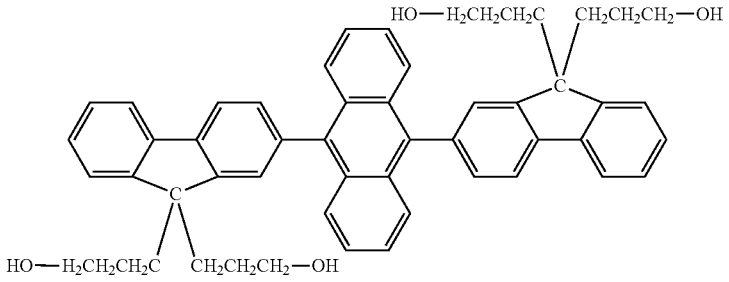

-continued
No. 199
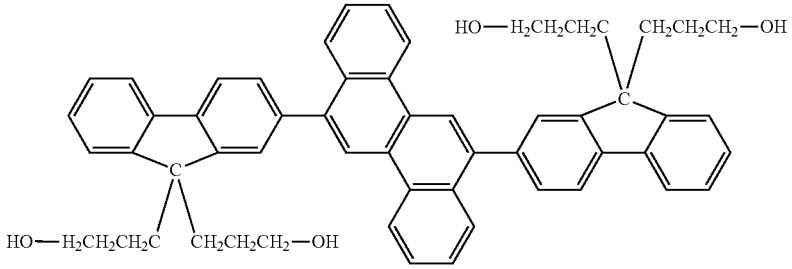
No. 200
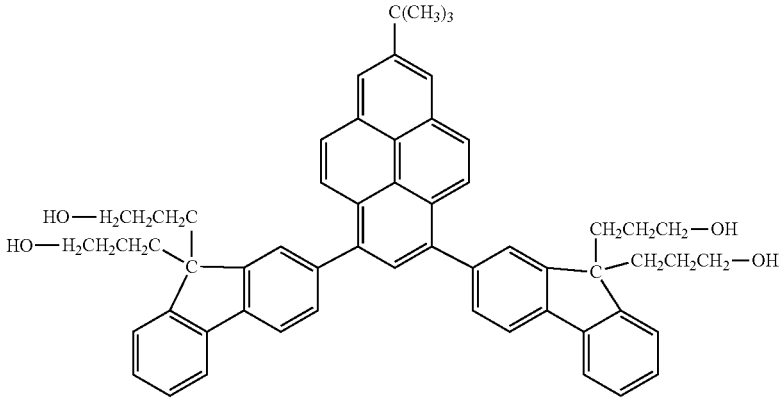
No. 201
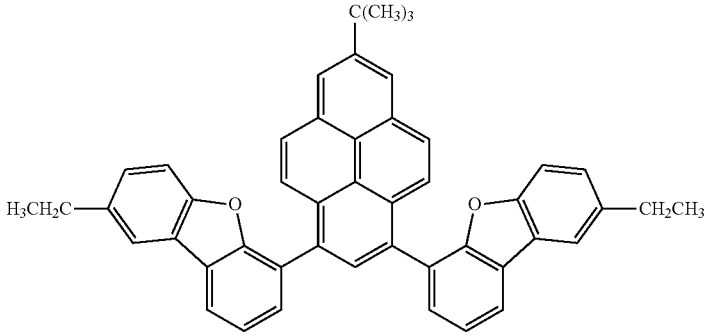
No. 202
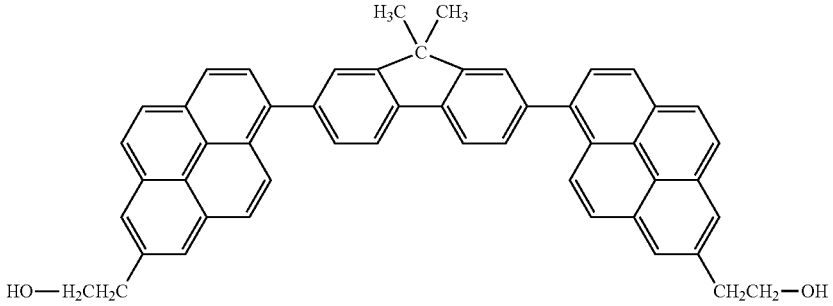
No. 203
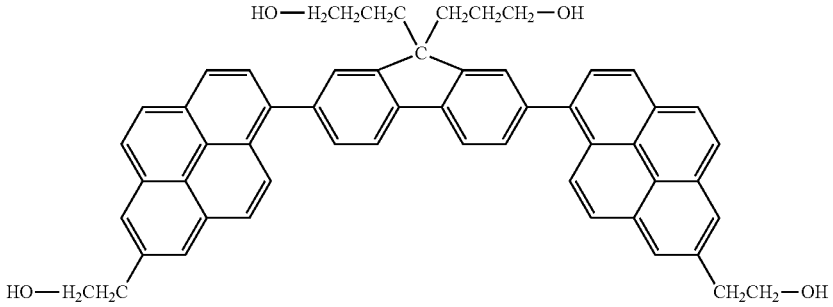

-continued
No. 204
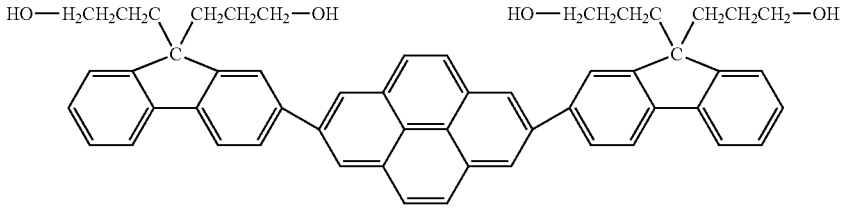
No. 205
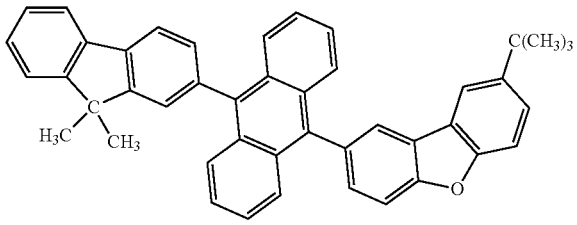
No. 206
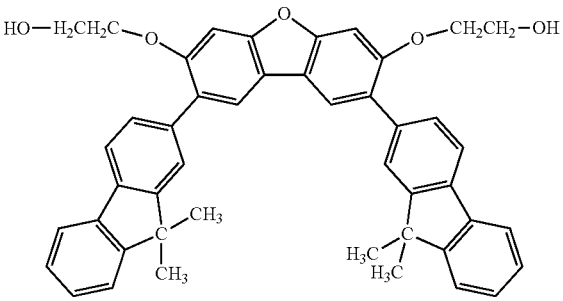
No. 207
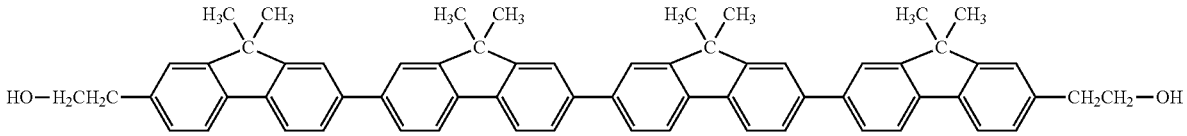
No. 208
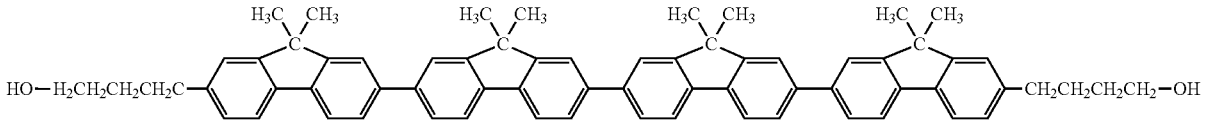
No. 209
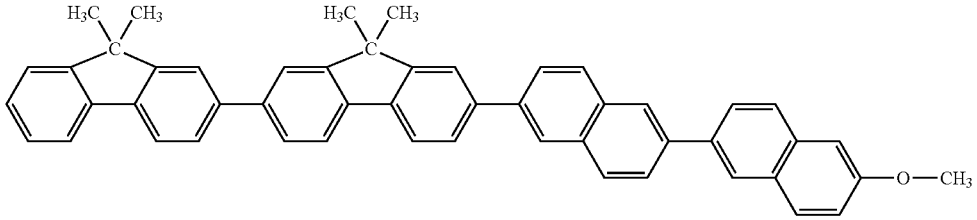
No. 210
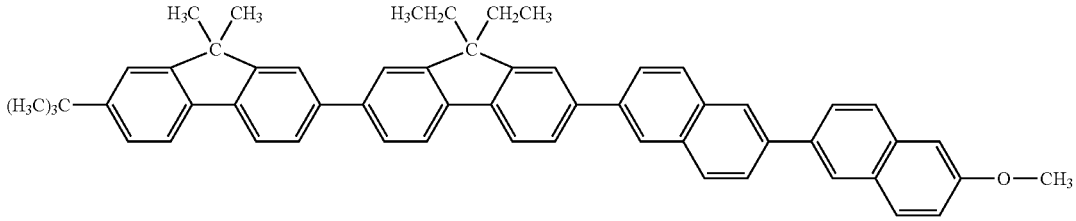
No. 211
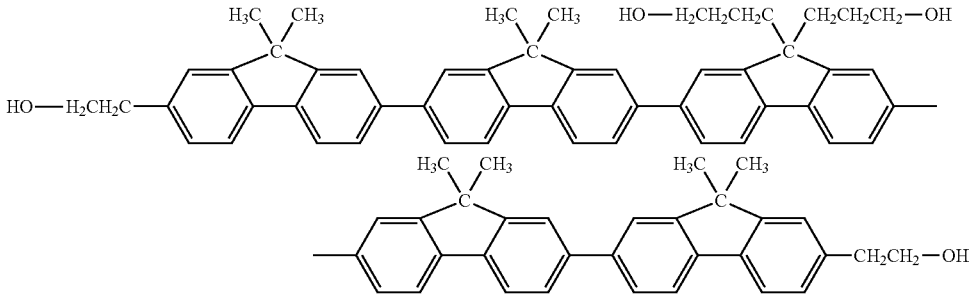

-continued
No. 212
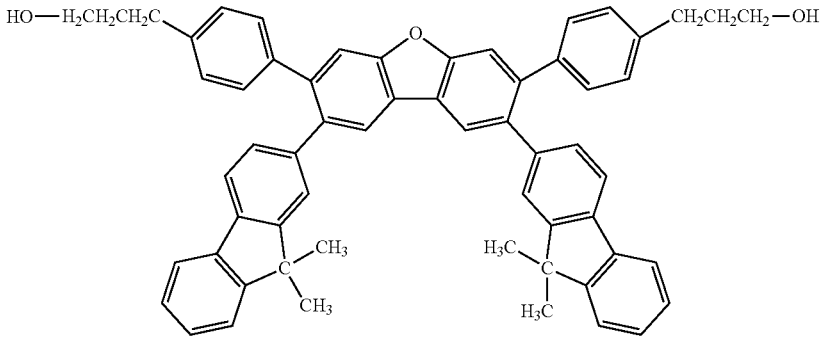
No. 213
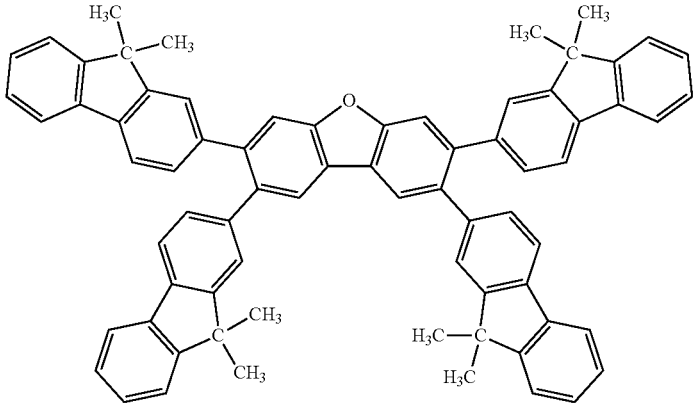
No. 214
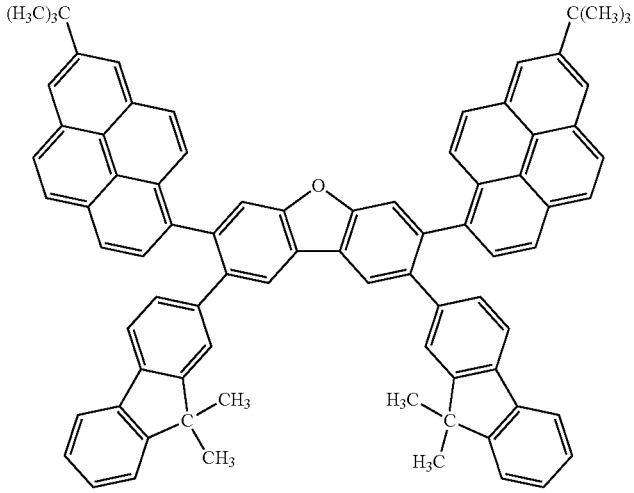
No. 215
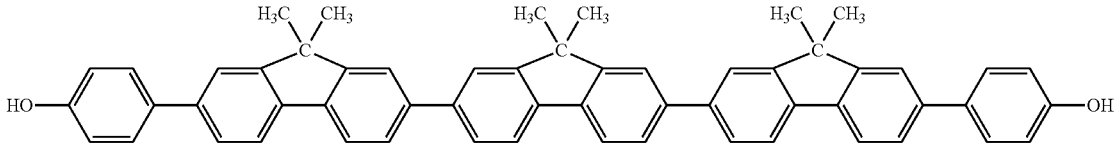
No. 216
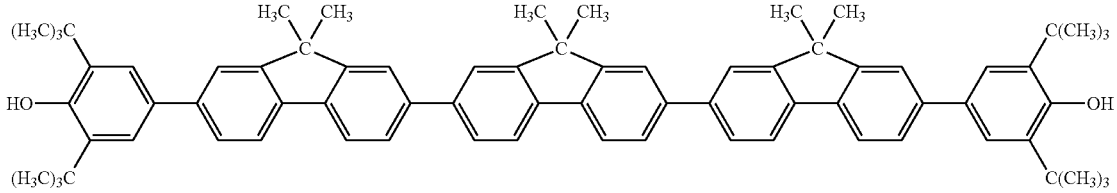

-continued
No. 217
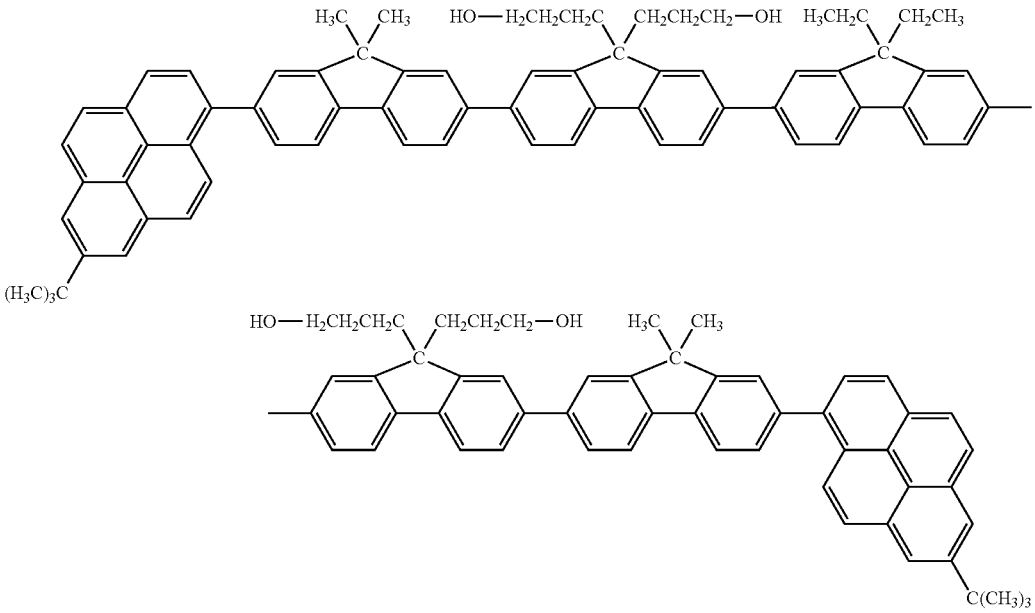
No. 218
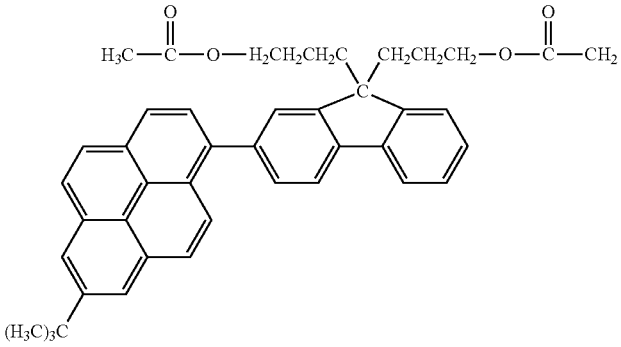
No. 219
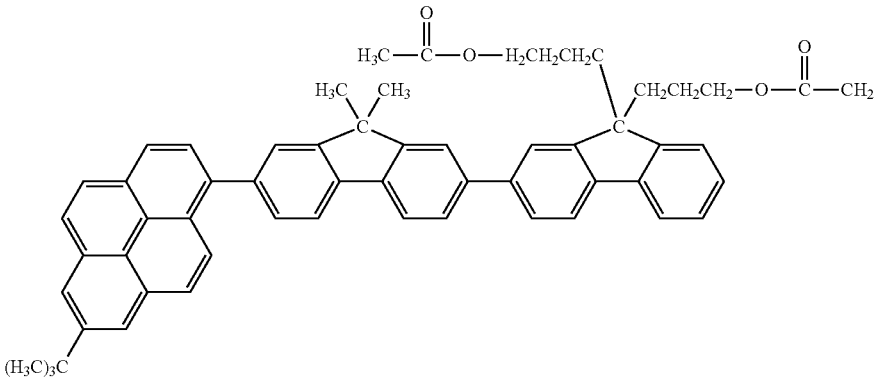
No. 220
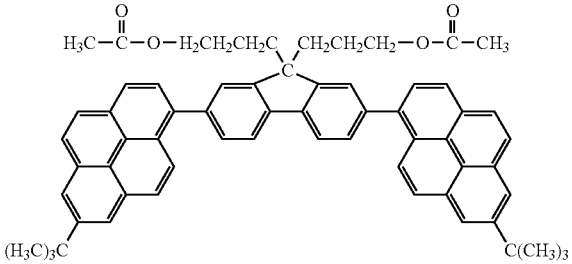
No. 221
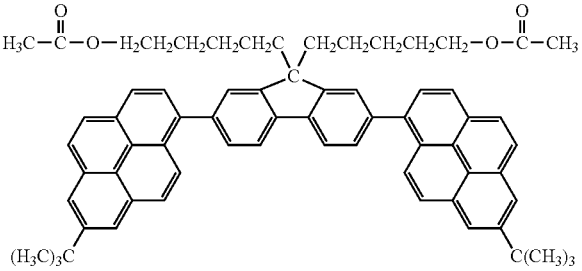

-continued
No. 222
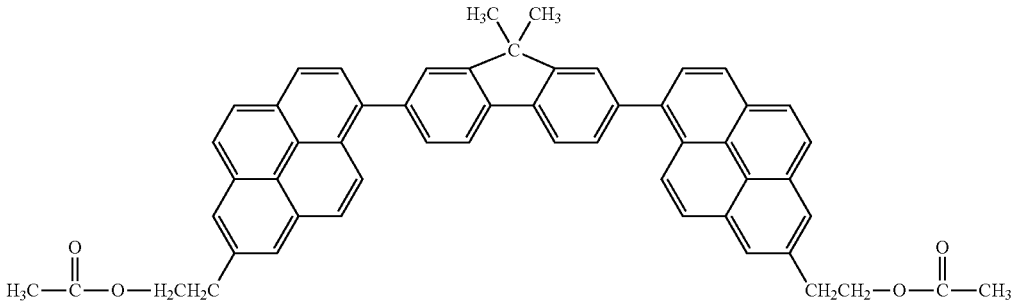
No. 223
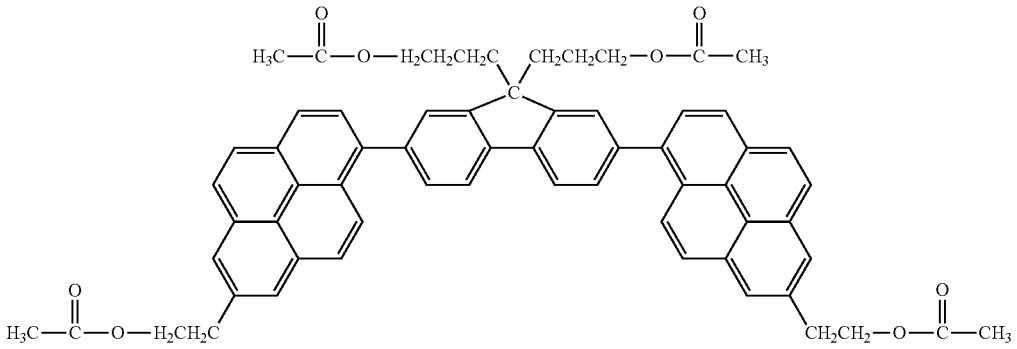
No. 224
No. 225
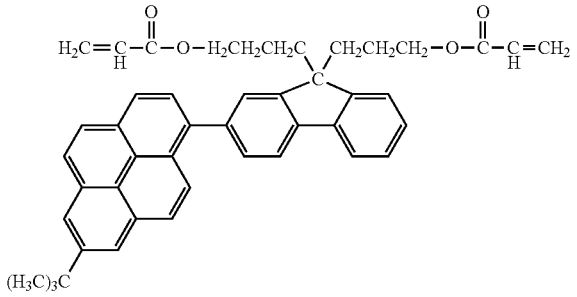
No. 226
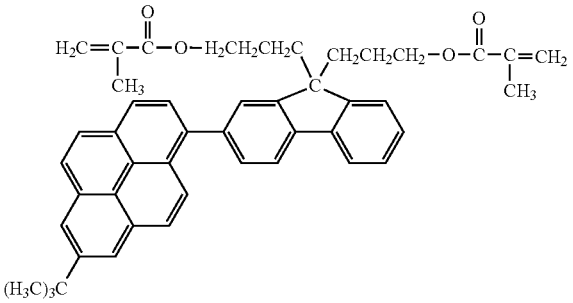
No. 227
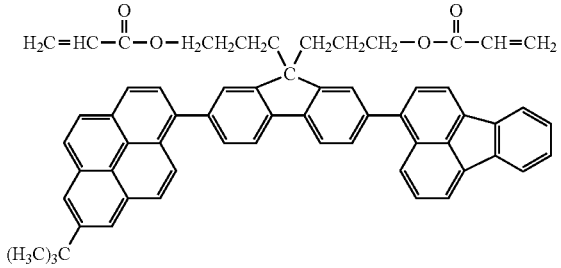
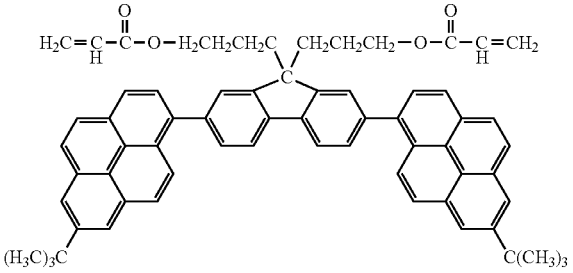
No. 228
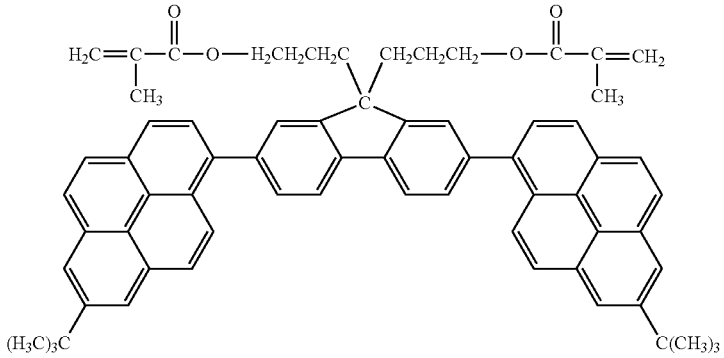

-continued
No. 229
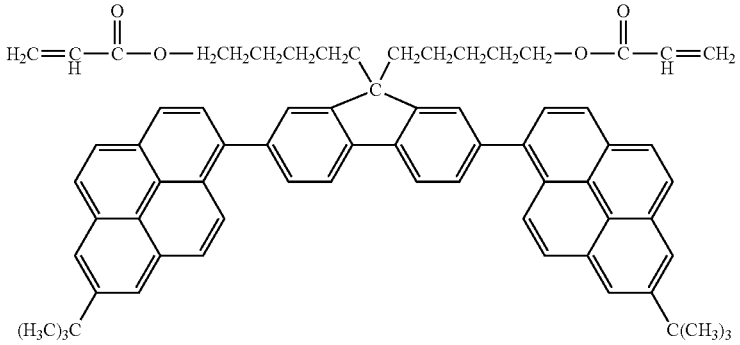
No. 230
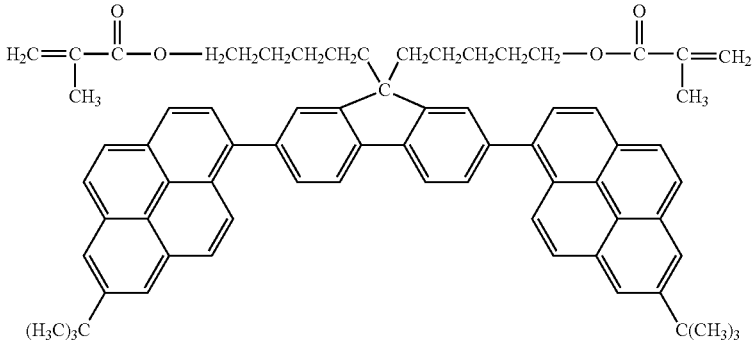
No. 231
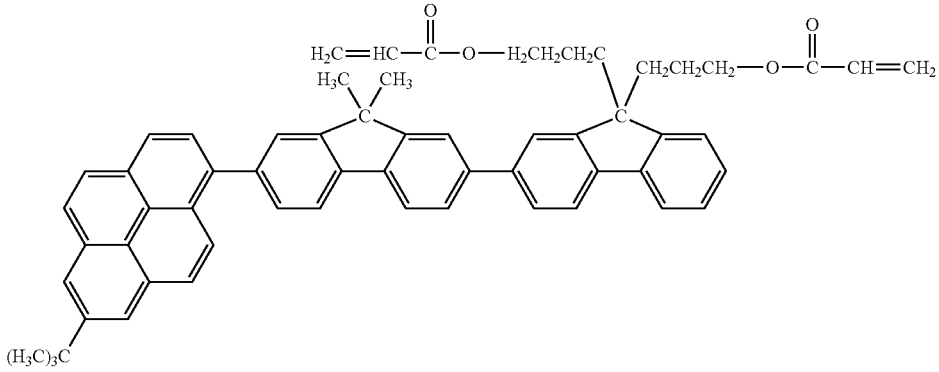
No. 232
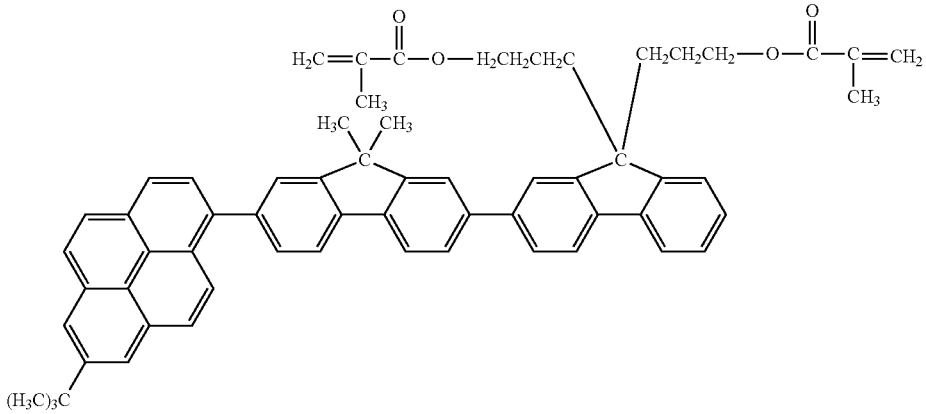

-continued
No. 233
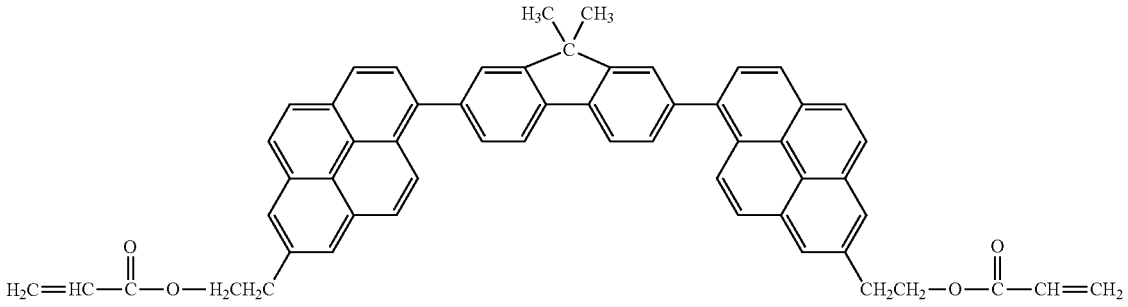
No. 234
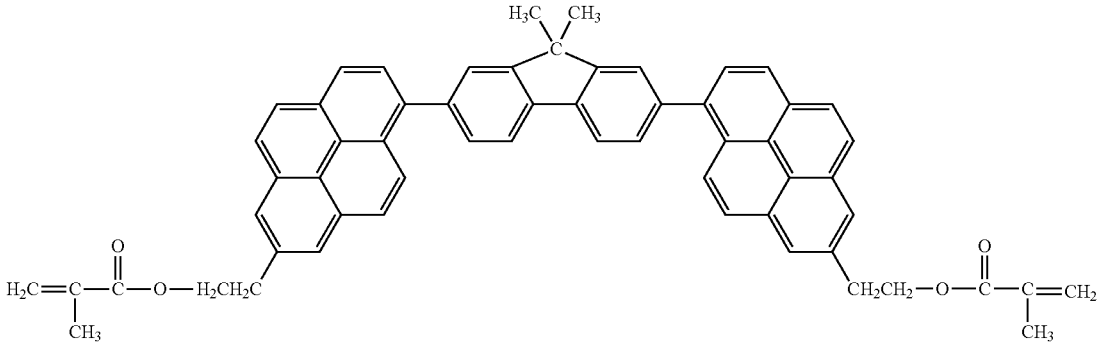
No. 235
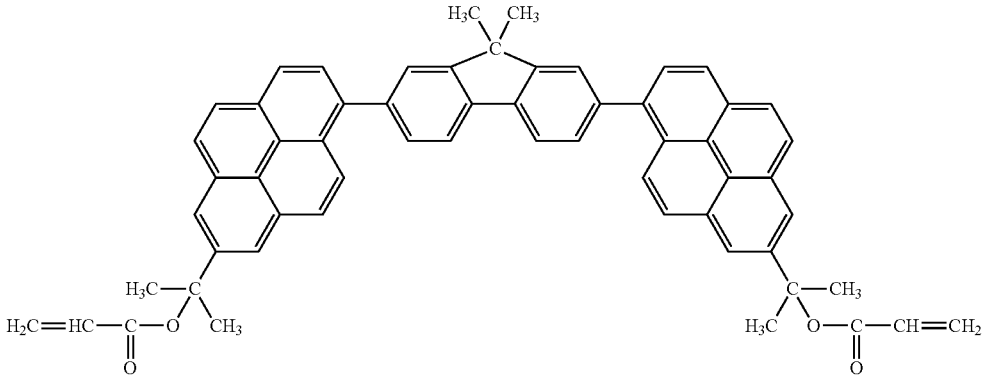
No. 236
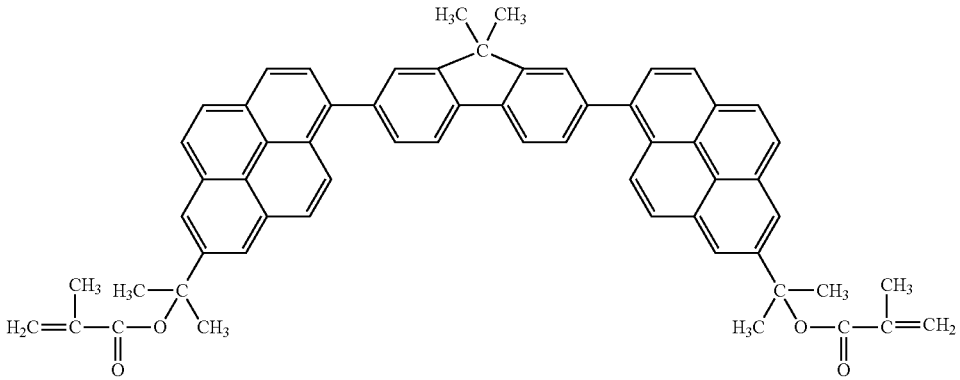

-continued
No. 237
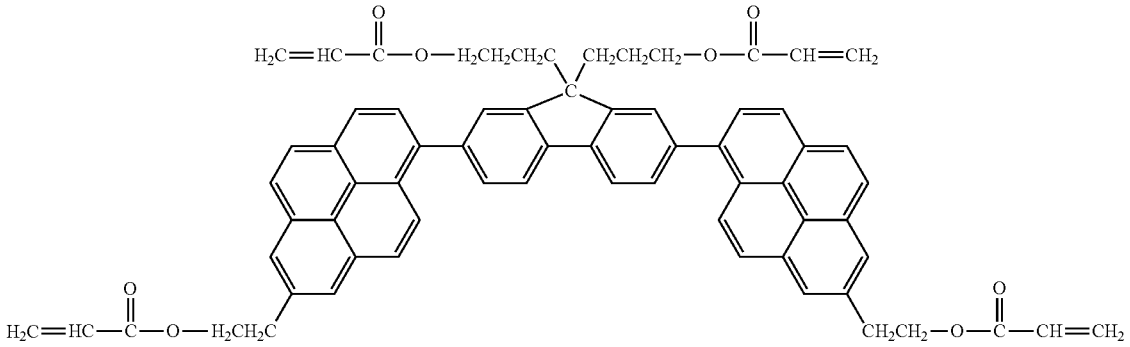
No. 238
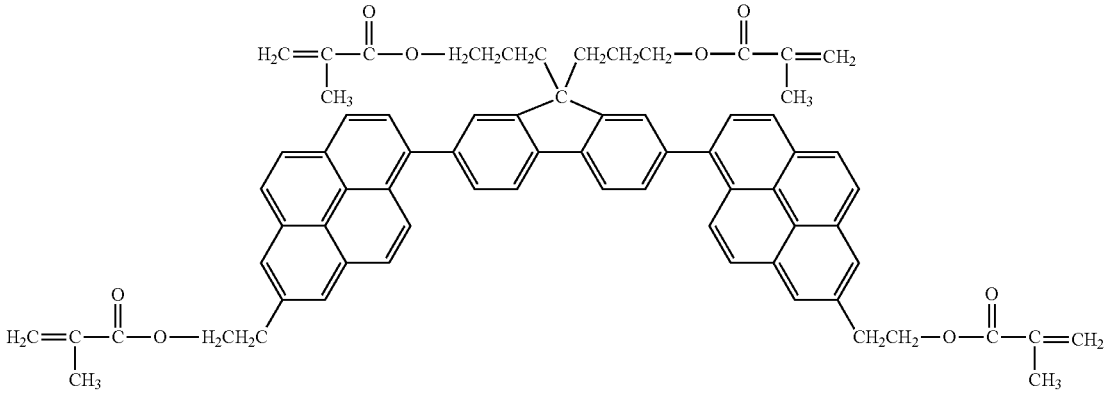
No. 239
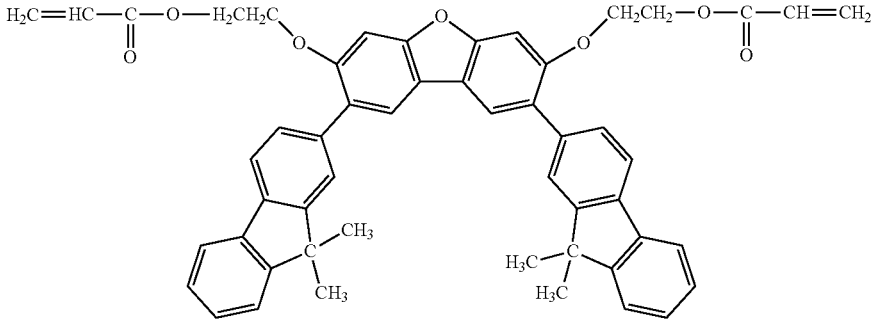
No. 240
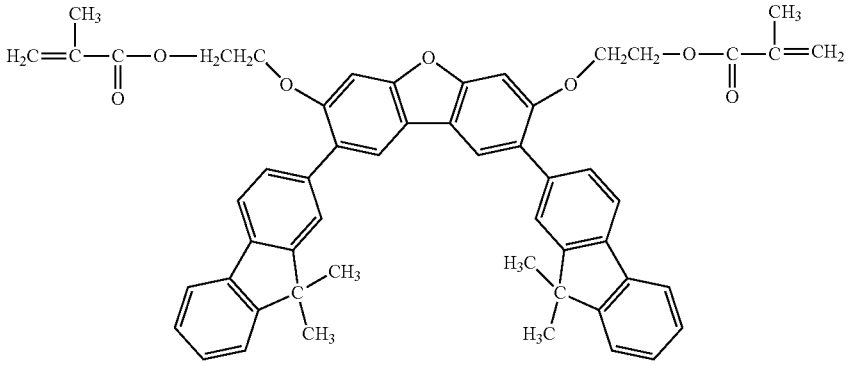

-continued
No. 241
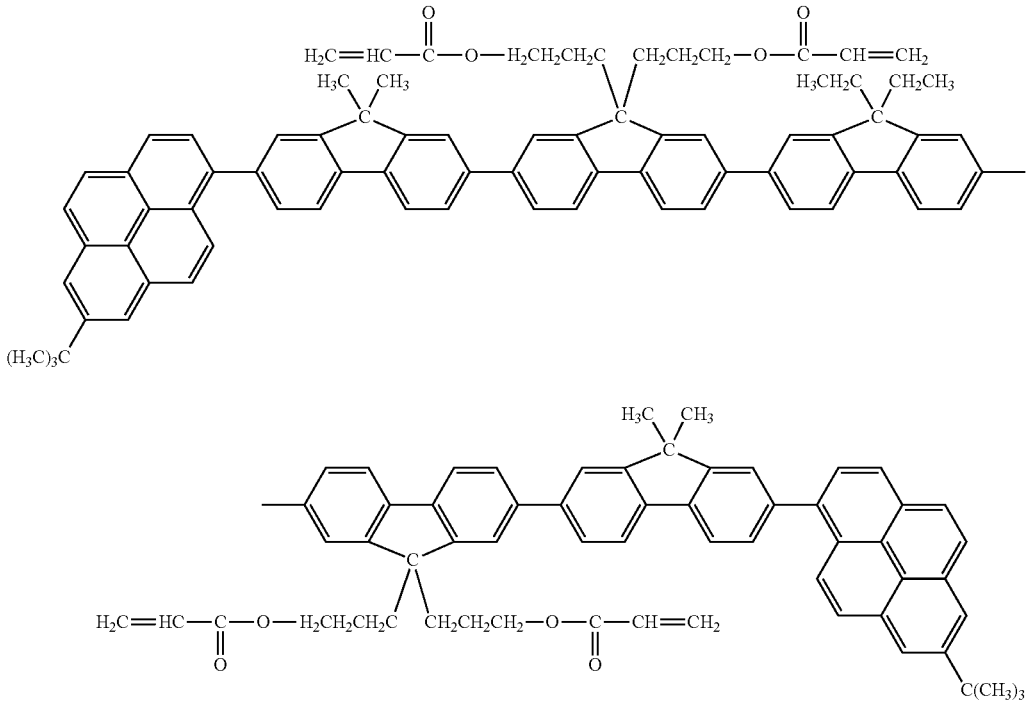
No. 242
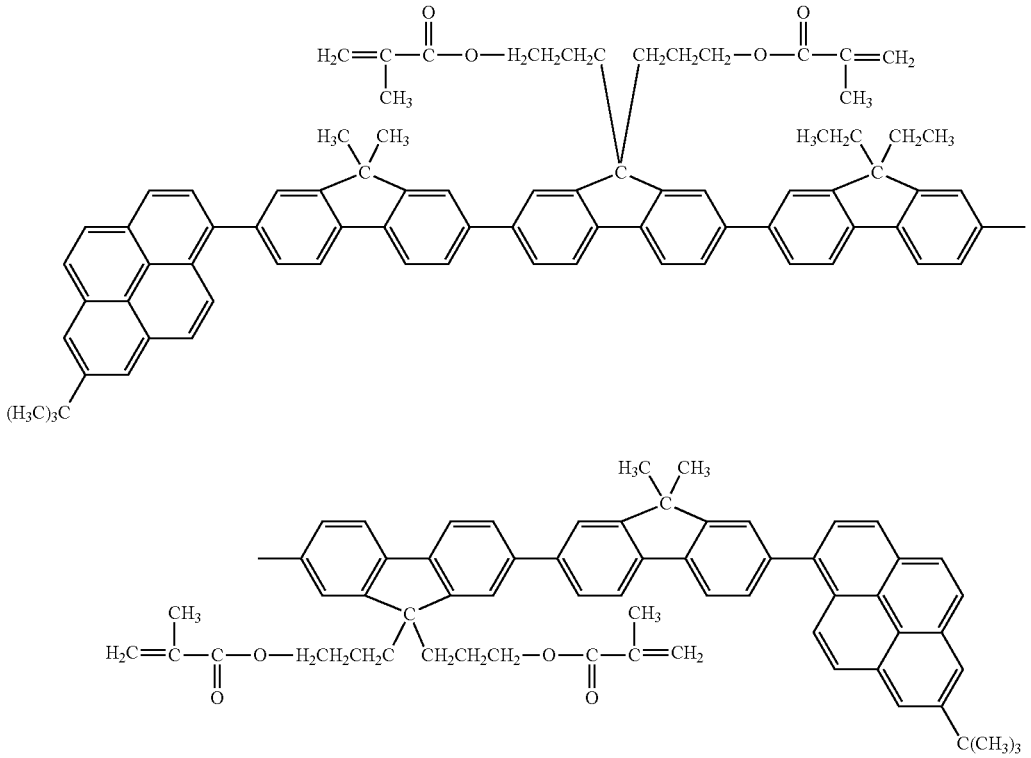
No. 243
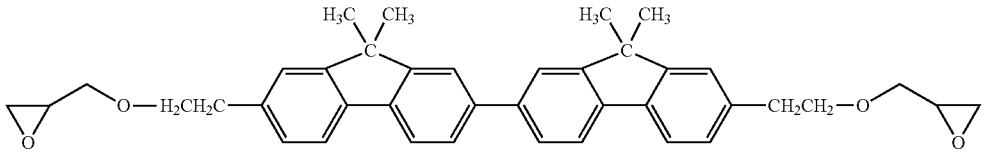

-continued
No. 244
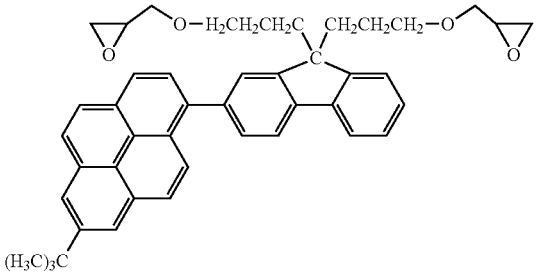
No. 245
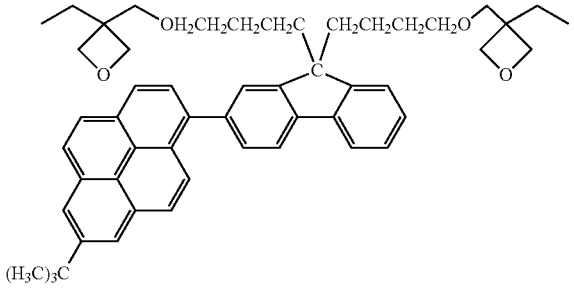
No. 246
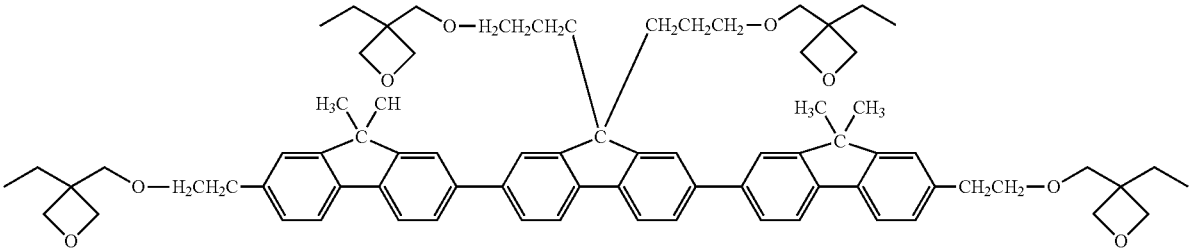
No. 247
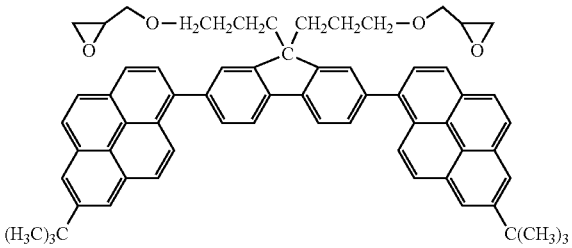
No. 248
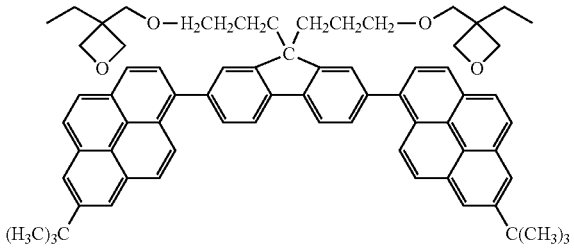
No. 249
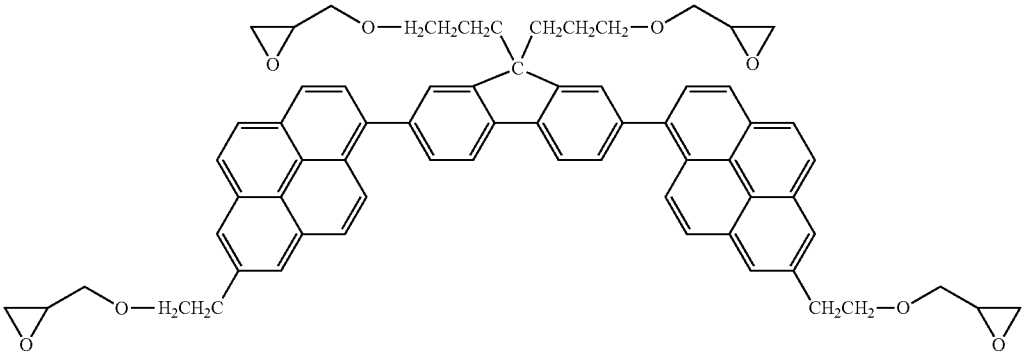
No. 250
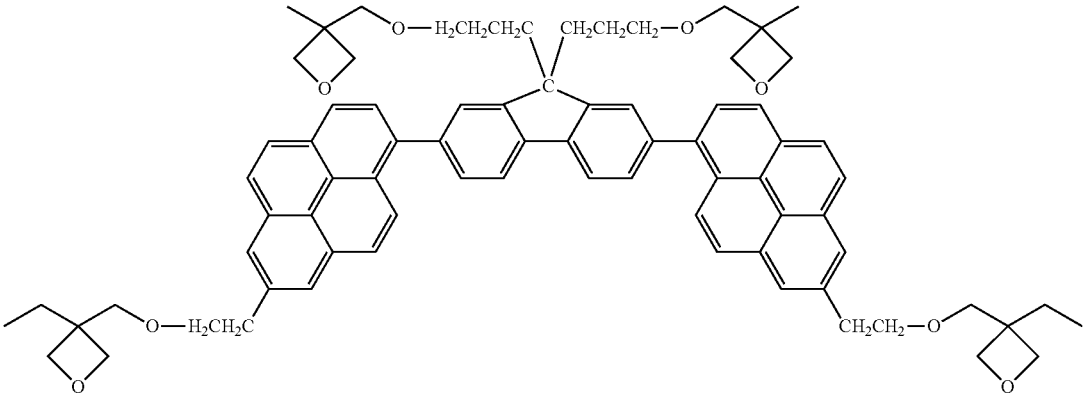

-continued
No. 251
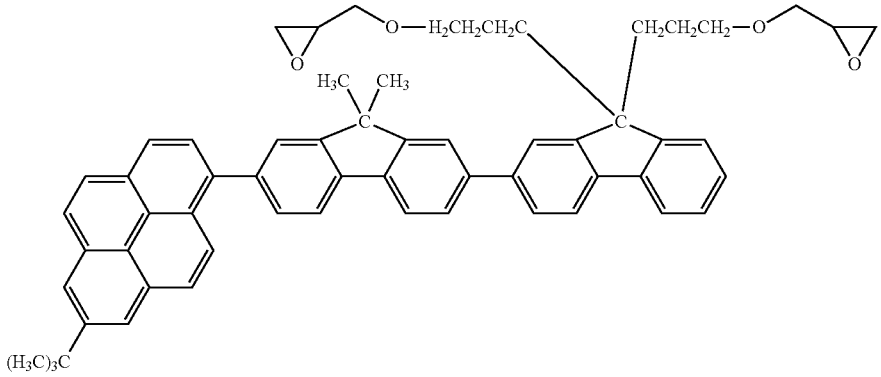
No. 252
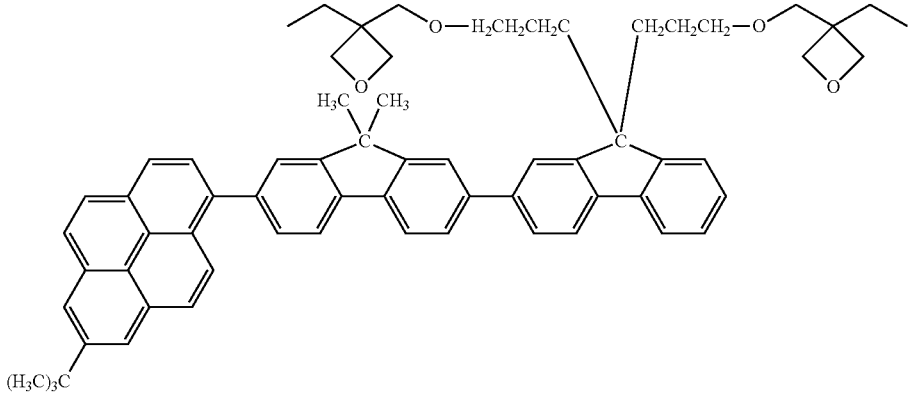
No. 253
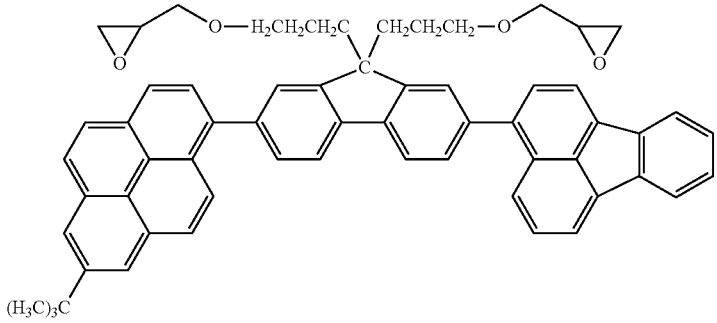
No. 254
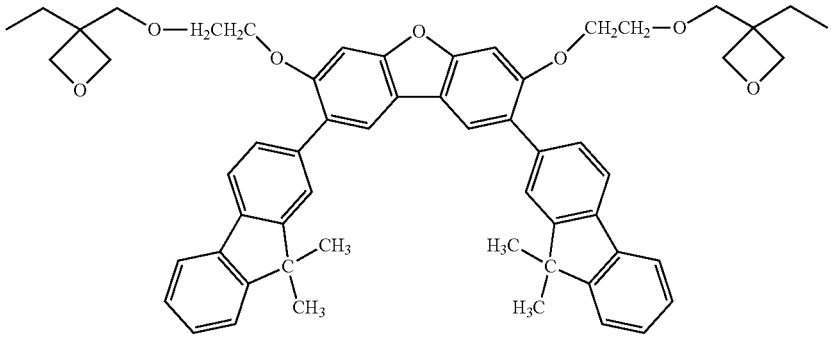

-continued
No. 255
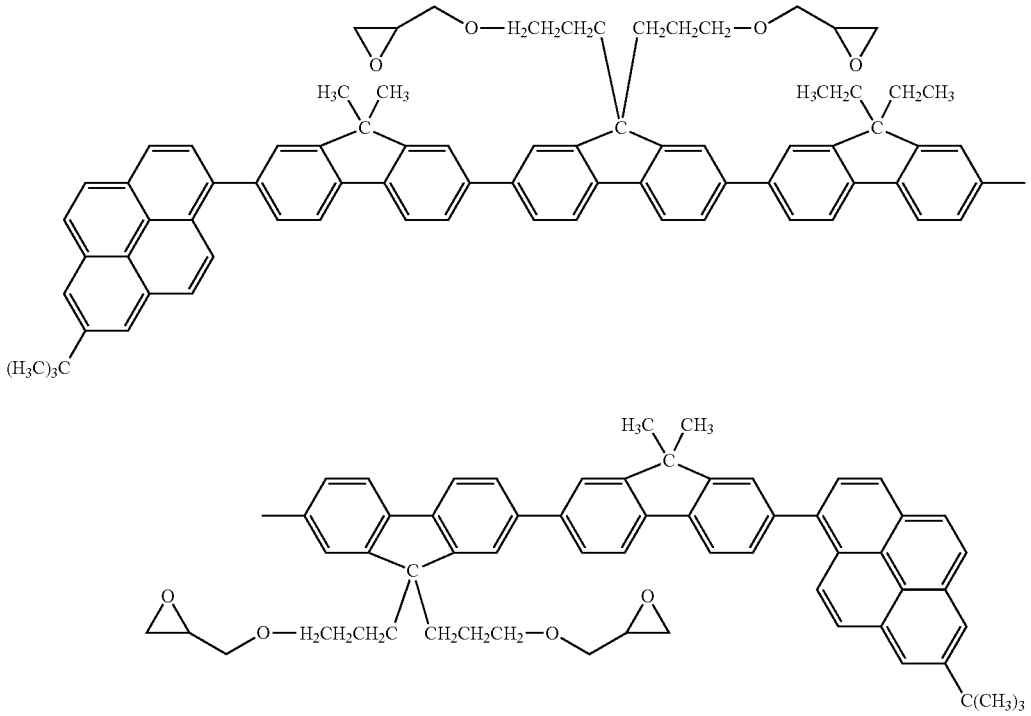
No. 256
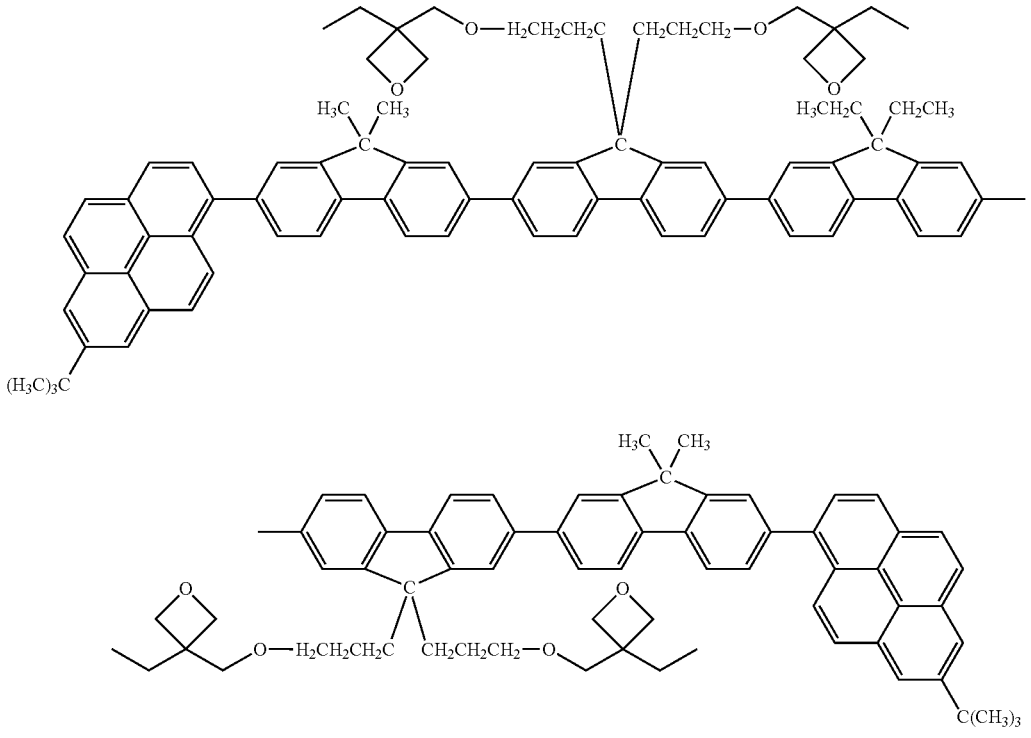
No. 257
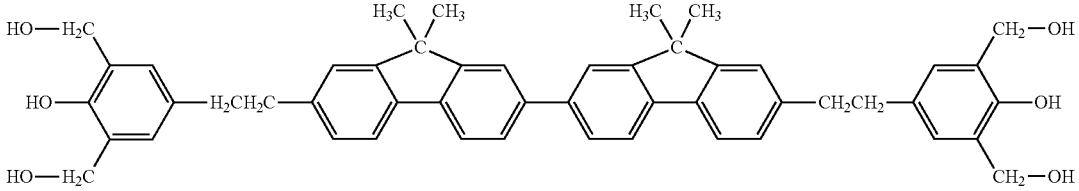

-continued
No. 258
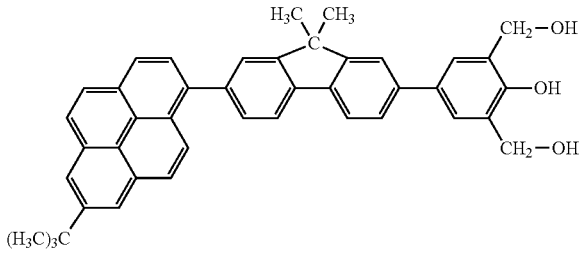
No. 259
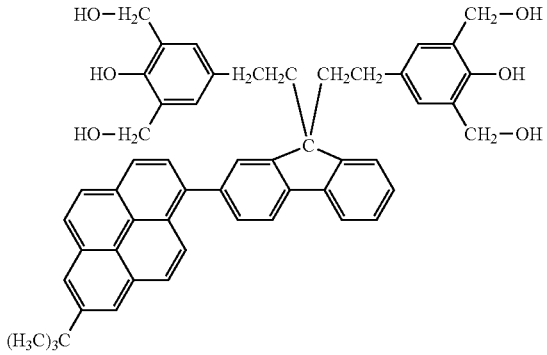
No. 260
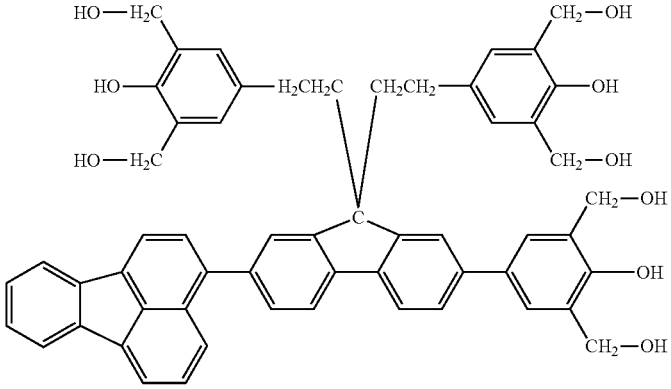
No. 261
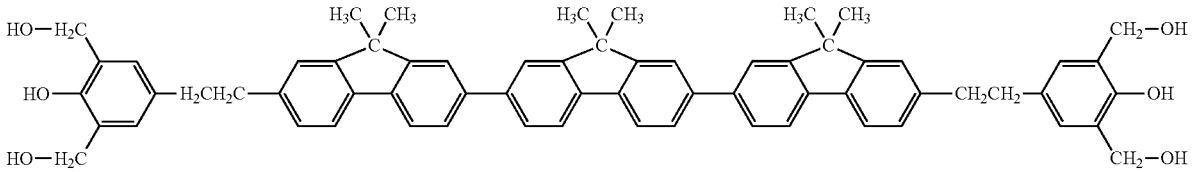
No. 262
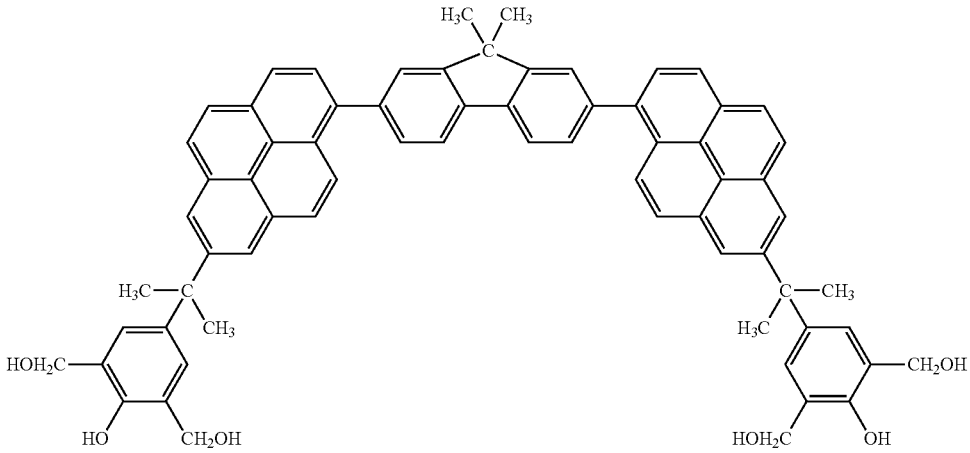

-continued
No. 263
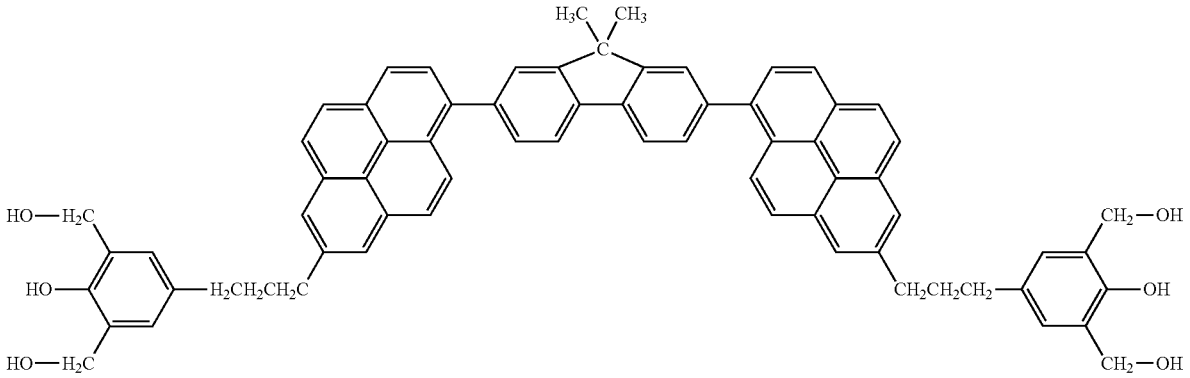
No. 264
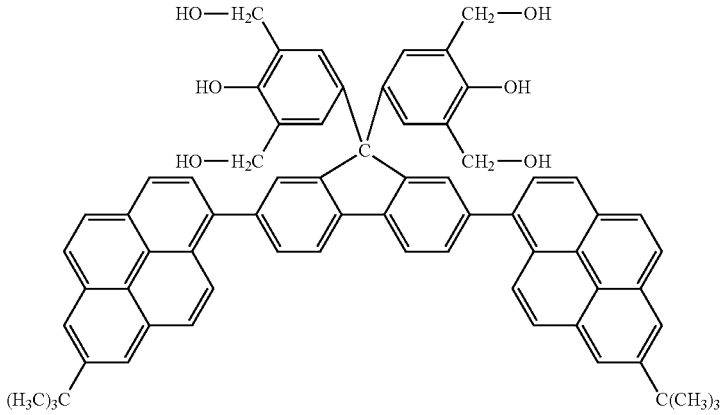
No. 265
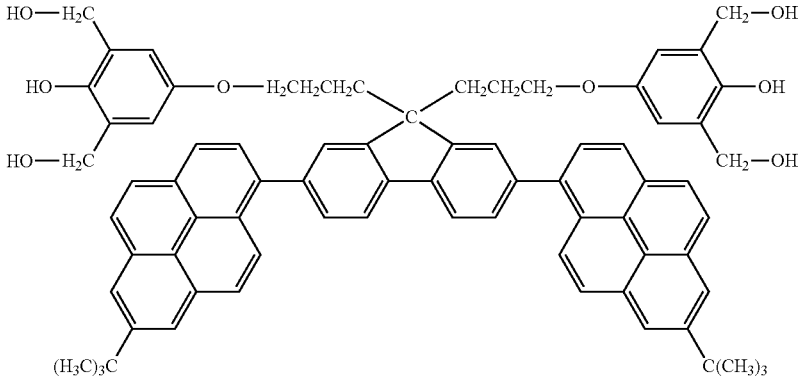
No. 266
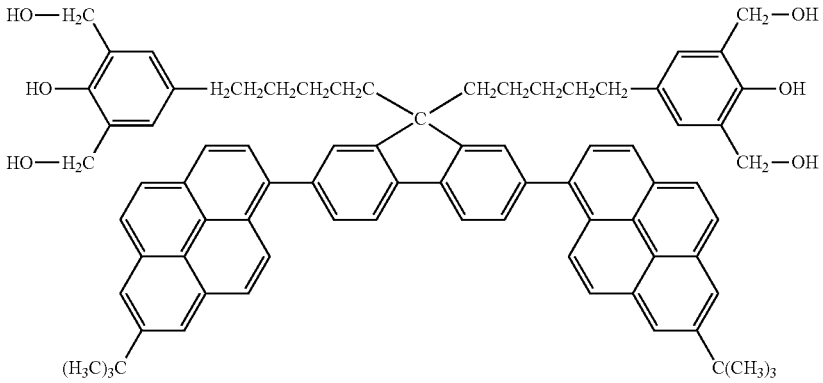

-continued
No. 267
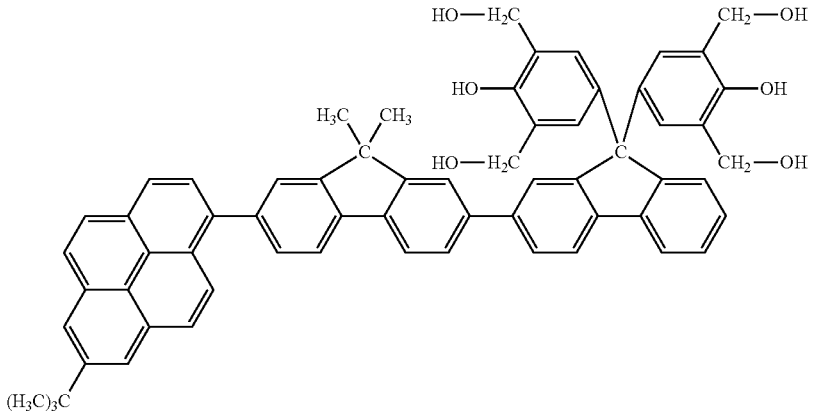
No. 268
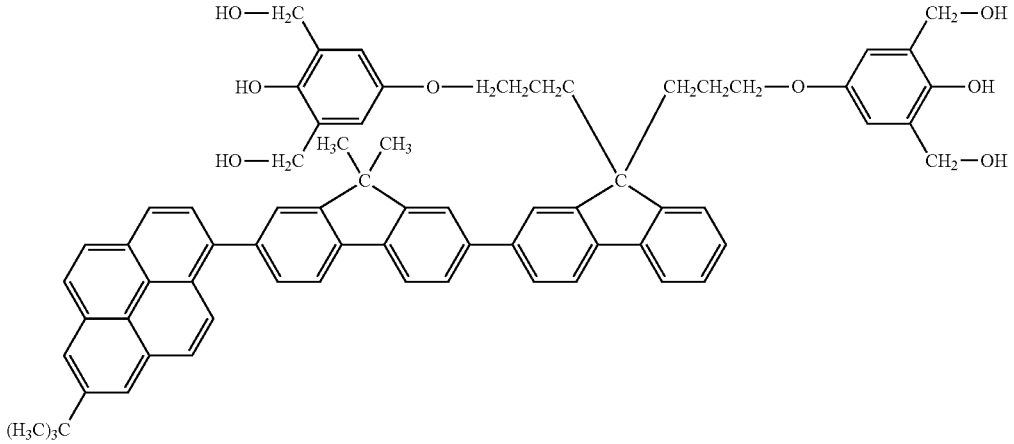
No. 269
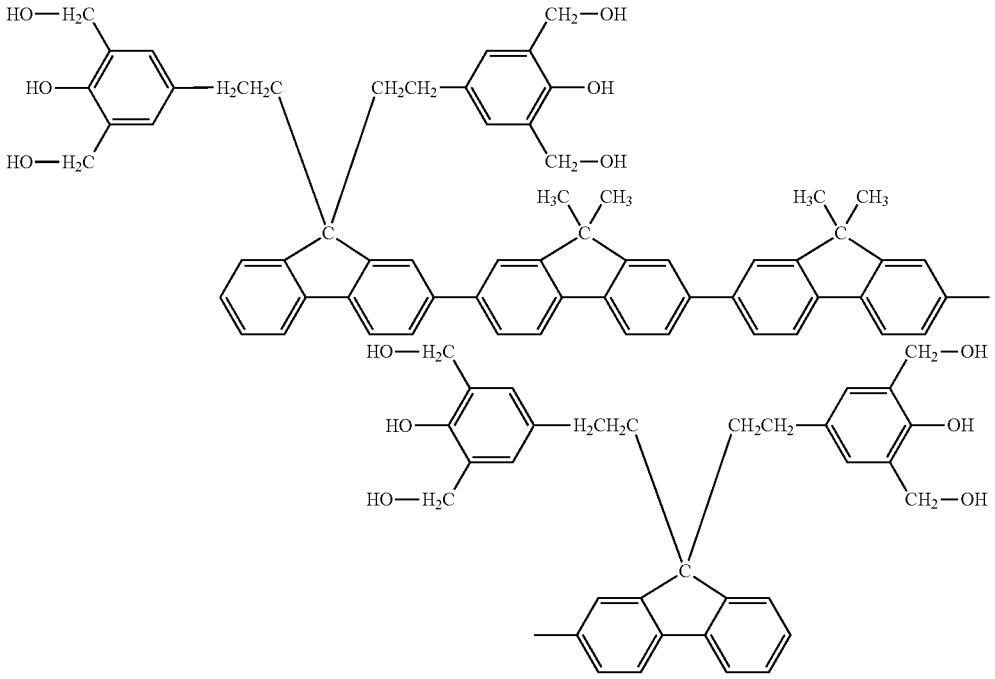

-continued

No. 270

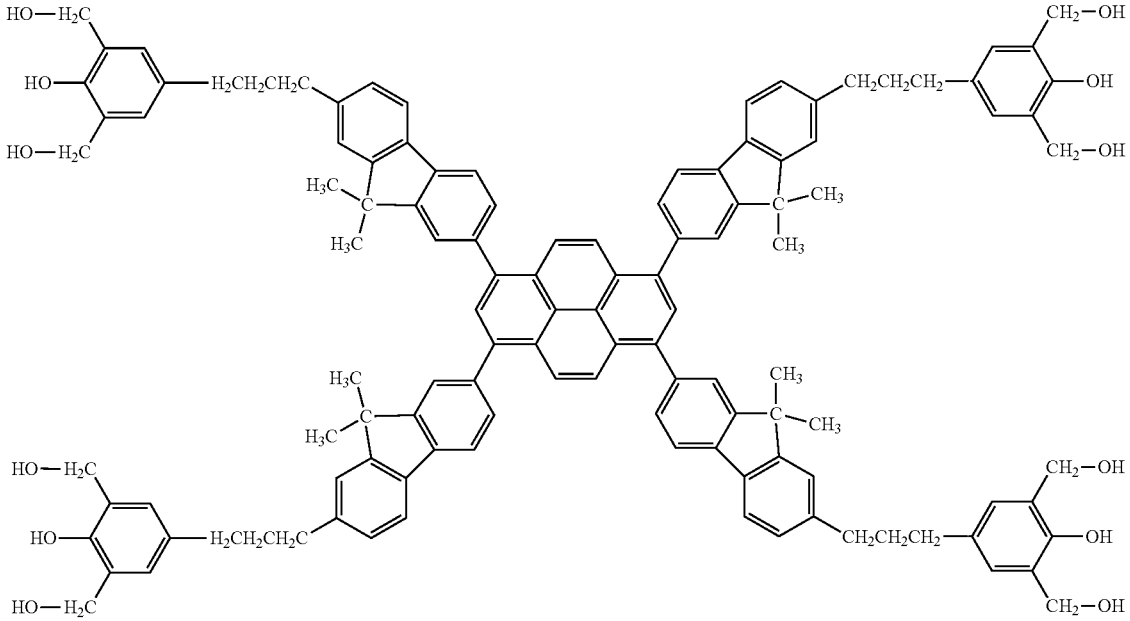

A representative synthesis example of the hole transporting substance to be used in the present invention is described below.

Exemplified Compound No. 56 was synthesized by a reaction represented by the following reaction formula [1]. A three-necked flask was mounted with a nitrogen introducing tube, a cooling tube, an inner temperature gauge, and the like. 350 Parts of toluene, 160 parts of ethanol, and 200 parts of a 10-mass % aqueous solution of sodium carbonate were mixed, and nitrogen replacement was performed by stirring the mixture with a mechanical stirrer for 30 minutes or more at room temperature well while performing nitrogen gas bubbling. Further, 22.4 parts of 1-boronic acid pinacol ester-7-tert-butylpyrene (Mw=384.32), 10.0 parts of 9,9-dimethyl-2,7-dibromofluorene (Mw=352.06), and 0.65 part of tetrakistriphenylphosphine palladium were loaded into the flask, and dissolution and nitrogen replacement were performed by further stirring the resultant at room temperature well.

Next, a coupling reaction was performed by heating the flask to a reflux temperature (about 74° C.). After the reaction had been performed for about 3 hours under a reflux condition, the reaction mixture was cooled to room temperature. An organic phase and an aqueous phase were separated from each other with a separating funnel, and the resultant organic phase was further washed with water. The organic phase was taken out and dehydrated with anhydrous magnesium sulfate. After magnesium sulfate had been removed, the organic solvent was removed from the organic phase. Thus, a crude product was obtained.

The crude product was subjected to column chromatography purification with silica gel. An impurity was removed by developing the crude product with a mixed solvent system of toluene and ethyl acetate, followed by the collection of a target product (Mw=706.95). The resultant target product was further recrystallized with a mixed solvent of toluene and n-heptane, and was filtered, followed by vacuum drying. Thus, the target product was obtained (yield: 17.1 parts, percent yield: 86%).

Reaction formula [1]

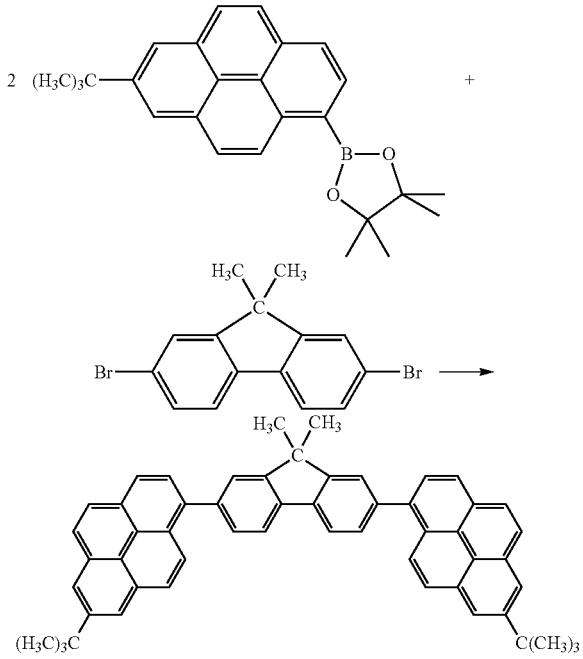

Hereinafter, the present invention is described in more detail by way of specific examples. It should be noted that the term "part(s)" in the examples refers to "part(s) by mass".

Example 1

An aluminum cylinder having an outer diameter of 30 mm, a length of 357.5 mm, and a thickness of 1 mm was used as a support (electro-conductive support).

Next, 100 parts of zinc oxide particles (specific surface area: 19 $m^2/g$, powder resistivity: $4.7\times10^6\Omega\cdot cm$) were mixed with 500 parts of toluene by stirring, and 0.8 part of a silane coupling agent was added to the mixture, followed by stirring for 6 hours. After that, toluene was removed by distillation under reduced pressure and the residue was dried by heating at 130° C. for 6 hours to provide surface-treated zinc oxide particles. KBM602 (compound name: N-2-(aminoethyl)-3-aminopropylmethyldimethoxysilane) manufactured by Shin-Etsu Chemical Co., Ltd. was used as the silane coupling agent.

Next, 15 parts of a polyvinyl butyral resin (weight-average molecular weight: 40,000, trade name: BM-1, manufactured by SEKISUI CHEMICAL CO., LTD.) and 15 parts of a blocked isocyanate (trade name: Sumidur 3175, manufactured by Sumika Bayer Urethane Co., Ltd.) were dissolved in a mixed solution of 73.5 parts of methyl ethyl ketone and 73.5 parts of 1-butanol. 80.8 Parts of the surface-treated zinc oxide particles and 0.8 part of 2,3,4-trihydroxybenzophenone (manufactured by Tokyo Chemical Industry Co., Ltd.) were added to the solution, and the mixture was dispersed with a sand mill apparatus using glass beads each having a diameter of 0.8 mm under an atmosphere having a temperature of 23±3° C. for 3 hours. After the dispersion, 0.01 part of silicone oil (trade name: SH28PA, manufactured by Dow Corning Toray Co., Ltd.) and 5.6 parts of crosslinked polymethyl methacrylate (PMMA) particles (trade name: TECHPOLYMER SSX-102, manufactured by SEKISUI PLASTICS CO., Ltd., average primary particle diameter: 2.5 μm) were added to the resultant, and the resultant was stirred to prepare an undercoat-layer coating solution.

The undercoat-layer coating solution was applied onto the support by dipping to form a coat, and the resultant coat was dried for 40 minutes at 160° C. to form an undercoat layer having a thickness of 18 μm.

Next, a hydroxygallium phthalocyanine crystal (charge generating substance) of a crystal form having peaks at Bragg angles 2θ±0.2° in CuKα characteristic X-ray diffraction of 7.4° and 28.2° was prepared. 20 Parts of the hydroxygallium phthalocyanine crystal, 0.2 part of a calixarene compound represented by the following formula (3), 10 parts of a polyvinyl butyral resin (trade name: S-LEC BX-1, manufactured by SEKISUI CHEMICAL CO., LTD.), and 600 parts of cyclohexanone were dispersed with a sand mill apparatus using glass beads each having a diameter of 1 mm for 4 hours. After that, 700 parts of ethyl acetate were added to the resultant to prepare a charge-generating-layer coating solution. The charge-generating-layer coating solution was applied onto the undercoat layer by dipping to form a coat, and the resultant coat was dried by heating at a temperature of 80° C. for 15 minutes to form a charge generating layer having a thickness of 0.17 μm.

(3)

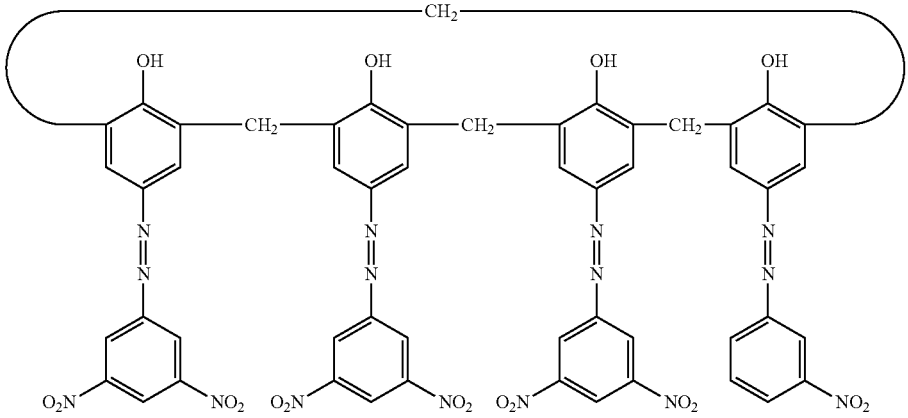

Next, 60 parts of a hole transporting substance represented by the following formula (4), 20 parts of a hole transporting substance represented by the following formula (5), and 100 parts of a polycarbonate resin (Iupilon 2400 manufactured by Mitsubishi Engineering-Plastics Corporation) were dissolved in a mixed solvent of 600 parts of monochlorobenzene and 200 parts of methylal to prepare a hole-transporting-layer coating solution. The hole-transporting-layer coating solution was applied onto the charge generating layer by dipping to form a coat, and the resultant coat was dried by heating at a temperature of 110° C. for 60 minutes to form a hole transporting layer having a thickness of 16 μm.

(4)

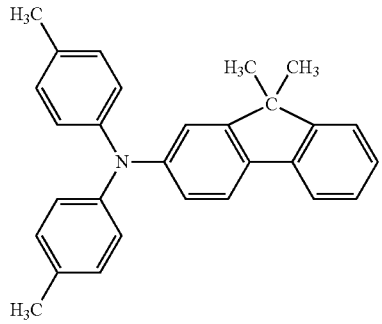

(5)

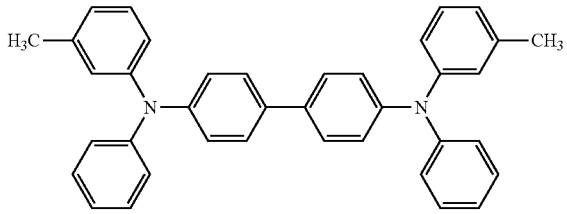

Next, 8 parts of the compound (hole transporting substance of the present invention) represented by Exemplified Compound No. 56, 10 parts of a polycarbonate resin (Iupilon 2800 manufactured by Mitsubishi Engineering-Plastics Corporation), 440 parts of monochlorobenzene, and 440 parts of tetrahydrofuran were mixed and stirred well. The mixture was filtered with a membrane filter to prepare a protective-layer (surface-layer) coating solution.

The protective-layer coating solution was applied onto the hole transporting layer by spraying to form a coat, and the resultant coat was dried by heating in an oven at a temperature of 110° C. for 30 minutes to form a protective layer (surface layer) having a thickness of 7 μm. The electrophotographic photosensitive member thus produced was subjected to the following evaluation.

(Evaluation of Electrophotographic Photosensitive Member)

A photosensitive member testing apparatus (CYNTHIA 59 manufactured by GEN-TECH, INC.) was used in the evaluation of the electrophotographic photosensitive member for its initial sensitivity and residual potential. First, a condition for a charging device was set so that the dark-area potential (Vd) of the electrophotographic photosensitive member became −700 (V) under a 23° C./50% RH environment. The photosensitive member was irradiated with monochromatic light having a wavelength of 780 nm, and the quantity of the light needed for reducing the potential of −700 (V) to −200 (V) was measured and defined as a sensitivity Δ500 (μJ/cm$^2$). Further, the potential of the electrophotographic photosensitive member when the photosensitive member was irradiated with light having a quantity of 20 (μJ/cm$^2$) was measured as a residual potential Vr (−V).

The produced electrophotographic photosensitive member was mounted onto the cyan station of a reconstructed machine of an electrophotographic copying machine (trade name: iR-ADV C5051) manufactured by Canon Inc. as an image evaluating apparatus, and was evaluated as described below.

First, a condition for a charging device was set so that the dark-area potential (Vd) of the electrophotographic photosensitive member became −700 (V) under a 23° C./50% RH environment. The photosensitive member was irradiated with laser light having a wavelength of 780 nm, the quantity of the light needed for reducing the potential of −700 (V) to −200 (V) was determined, and repeated image formation was performed by continuously outputting an evaluation chart, which was an A4 horizontal 5% image, on 5,000 sheets. The image formation was performed by reconstructing the electrophotographic apparatus so that the total quantity of a discharge current in its charging step became 300 (μA).

After the completion of the repeated image formation, the electrophotographic photosensitive member taken out of the image evaluating apparatus was immediately mounted onto the same photosensitive member testing apparatus as that described above, its sensitivity and residual potential were measured, and a variation between potentials before and after the repeated image formation was evaluated.

Next, an apparatus reconstructed so as to be capable of, for example, regulation and measurement so that image exposure laser power, the quantity of a current flowing from a charging roller to a support (hereinafter described as "total current"), and the DC component and AC component of a voltage to be applied to the charging roller could each be controlled was prepared as an electrophotographic apparatus. In addition, evaluation was performed while the power source of a heater accompanying the main body of the electrophotographic apparatus was turned off.

A cyan cartridge to be used in the electrophotographic apparatus was prepared, and the electrophotographic apparatus, the cartridge, and the electrophotographic photosensitive member were left to stand under a 30° C./80% RH environment for 24 hours or more. After that, the electrophotographic photosensitive member was mounted onto the cyan cartridge for image formation and evaluation. Then, an entire exposure image having a cyan color alone was output on A4 size plain paper and an image exposure light quantity was set so that a density on the paper measured with a spectral densitometer (trade name: X-Rite 504, manufactured by X-Rite Inc.) became 1.45.

Evaluation for image reproducibility was performed by setting the total quantity of a discharge current in the step of charging the electrophotographic photosensitive member to 300 (μA). A 5,000-sheet repeated image formation test was performed with a test chart having an image density ratio of 5% in this setting. After the completion of the repeated image formation, the electrophotographic photosensitive member was taken out of the electrophotographic apparatus together with the cartridge, and was left to stand under the same 30° C./80% RH environment in a dark place for 24 hours.

After that, the cartridge including the electrophotographic photosensitive member was mounted onto the same electrophotographic apparatus again, and an A4 horizontal 1-dot/1-space image having an output resolution of 600 dpi was formed. Then, the output image was visually observed, and image reproducibility on entire A4 paper in which image deletion was involved was evaluated by the following criteria.

Evaluation ranks were as described below.

<A>: When dots of the image are magnified and observed, none of the disturbance and scattering of the dots is present (that is, the image deletion is absent), and hence the image reproducibility is good.

<B>: When dots of the image are magnified and observed, the disturbance of part of the dots is observed but the scattering thereof is absent.

<C>: When dots of the image are magnified and observed, the disturbance, scattering, and disappearance of part of the dots occur.

<D>: When dots of the image are magnified and observed, the disturbance, scattering, and disappearance of the entire dots occur.

<E>: When dots of the image are magnified and observed, white voids occur on the image and hence the image reproducibility is low (the image deletion occurs on the entire image).

Table 1 shows the result of the evaluation for the electric potential variation due to repeated image formation, and the results of the evaluation for image characteristics under a high-temperature and high-humidity environment.

Examples 2 to 18

Electrophotographic photosensitive members were each produced and evaluated in the same manner as in Example 1 except that the hole transporting substance used in the protective layer of Example 1 was changed to a hole transporting substance shown in Table 1. Table 1 shows the results of the evaluation.

Example 19

The hole transporting substance used in the protective layer of Example 1 was changed as follows: 7.2 parts of the hole transporting substance represented by Exemplified Compound No. 56 and 0.8 part of the hole transporting substance represented by the formula (5) were used as a mixture. Further, 10 parts of the same polycarbonate resin as that of Example 1, 440 parts of monochlorobenzene, and 440 parts of tetrahydrofuran were mixed to prepare a protective-layer coating solution. A protective layer was formed and an electrophotographic photosensitive member was produced in the same manner as in Example 1 except the foregoing. Further, the electrophotographic photosensitive member was evaluated in the same manner as in Example 1. Table 1 shows the results of the evaluation.

Example 20

The hole transporting substance used in the protective layer of Example 1 was changed as follows: 6.4 parts of the hole transporting substance represented by Exemplified Compound No. 56 and 1.6 parts of the hole transporting substance represented by the formula (5) were used as a mixture. Further, 10 parts of the same polycarbonate resin as that of Example 1, 440 parts of monochlorobenzene, and 440 parts of tetrahydrofuran were mixed to prepare a protective-layer coating solution. A protective layer was formed and an electrophotographic photosensitive member was produced in the same manner as in Example 1 except the foregoing. Further, the electrophotographic photosensitive member was evaluated in the same manner as in Example 1. Table 1 shows the results of the evaluation.

Example 21

The hole transporting substance used in the surface layer of Example 1 was changed as follows: 4 parts of the hole transporting substance represented by Exemplified Compound No. 56 and 4 parts of the hole transporting substance represented by the formula (5) were used as a mixture. Further, 10 parts of the same polycarbonate resin as that of Example 1, 440 parts of monochlorobenzene, and 440 parts of tetrahydrofuran were mixed to prepare a protective-layer coating solution. An electrophotographic photosensitive member was produced in the same manner as in Example 1 except the foregoing. Further, the electrophotographic photosensitive member was evaluated in the same manner as in Example 1. Table 1 shows the results of the evaluation.

Example 22

An electrophotographic photosensitive member was produced and evaluated in the same manner as in Example 1 except that the hole transporting substance used in the protective layer of Example 1 was changed to a hole transporting substance shown in Table 1. Table 1 shows the results of the evaluation.

Comparative Example 1

An electrophotographic photosensitive member was produced in the same manner as in Example 1 except that the hole transporting substance used in the protective layer of Example 1 was changed to a hole transporting substance represented by the following formula (6), and the electrophotographic photosensitive member was similarly evaluated. Table 1 shows the results of the evaluation.

(6)

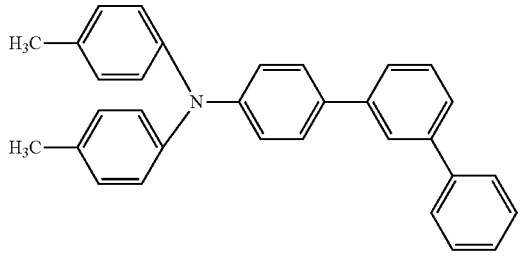

Comparative Example 2

An electrophotographic photosensitive member was produced in the same manner as in Example 1 except that the hole transporting substance used in the protective layer of Example 1 was changed to a hole transporting substance represented by the following formula (7), and the electrophotographic photosensitive member was similarly evaluated. Table 1 shows the results of the evaluation.

(7)

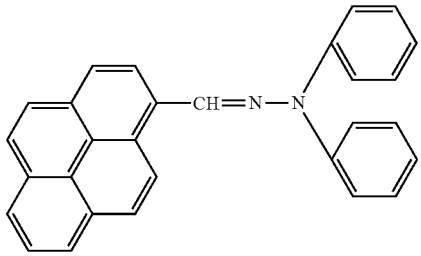

Comparative Example 3

An electrophotographic photosensitive member was produced in the same manner as in Example 1 except that the hole transporting substance used in the protective layer of Example 1 was changed to an aromatic compound represented by the following formula (8), and the electrophotographic photosensitive member was similarly evaluated. Table 1 shows the results of the evaluation.

(8)

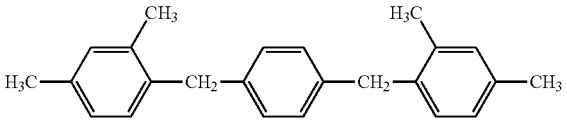

Comparative Example 4

An electrophotographic photosensitive member was produced in the same manner as in Example 1 except that the hole transporting substance used in the protective layer of Example 1 was changed to an aromatic compound represented by the following formula (9), and the electrophotographic photosensitive member was similarly evaluated. Table 1 shows the results of the evaluation.

(9)

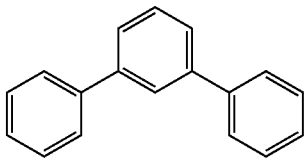

Comparative Example 5

An electrophotographic photosensitive member was produced in the same manner as in Example 1 except that the hole transporting substance used in the surface layer of Example 1 was changed to poly(9,9-dioctyl-9H-fluorene-2,7-diyl) represented by the following formula (10) (manufactured by TOSCO CO., LTD., polyfluorene compound; average molecular weight: 40,000), and the electrophotographic photosensitive member was similarly evaluated. Table 1 shows the results of the evaluation.

(10)

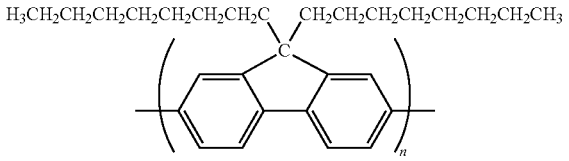

Comparative Example 6

An electrophotographic photosensitive member was produced in the same manner as in Example 1 except that the hole transporting substance used in the protective layer of Example 1 was changed to an aromatic compound represented by the following formula (11), and the electrophotographic photosensitive member was similarly evaluated. Table 1 shows the results of the evaluation.

(11)

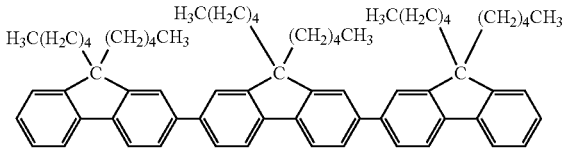

Comparative Example 7

An electrophotographic photosensitive member was produced in the same manner as in Example 1 except that the hole transporting substance used in the protective layer of Example 1 was changed to a compound represented by the following formula (12), and the electrophotographic photosensitive member was similarly evaluated. Table 1 shows the results of the evaluation.

(12)

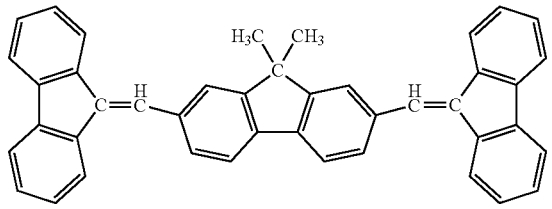

Comparative Example 8

An electrophotographic photosensitive member was produced in the same manner as in Example 1 except that the hole transporting substance used in the protective layer of Example 1 was changed to a compound represented by the following formula (13), and the electrophotographic photosensitive member was similarly evaluated. Table 1 shows the results of the evaluation.

(13)

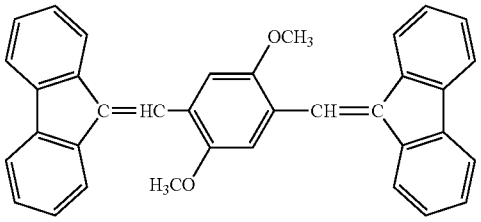

TABLE 1

| | Hole transporting substance | | | | Initial potential at 23° C./50% RH | | Potential after 5,000-sheet endurance at 23° C./50% RH | | 5,000-Sheet endurance under high temperature and high humidity |
|---|---|---|---|---|---|---|---|---|---|
| No. | Kind of compound | Number of $sp^2$ carbon atoms that form conjugation | Ratio of $sp^2$ carbon atoms (%) | Ratio of $sp^3$ carbon atoms (%) | Sensitivity Δ500 (μJ/cm$^2$) | Residual potential (−V) | Sensitivity Δ500 (μJ/cm$^2$) | Residual potential (−V) | Image evaluation |
| Example 1 | Exemplified Compound 56 | 44 | 80 | 20 | 0.25 | 60 | 0.26 | 64 | A |
| Example 2 | Exemplified Compound 15 | 28 | 80 | 20 | 0.29 | 63 | 0.31 | 67 | A |
| Example 3 | Exemplified Compound 40 | 36 | 71 | 29 | 0.31 | 65 | 0.32 | 68 | A |
| Example 4 | Exemplified Compound 42 | 36 | 61 | 39 | 0.36 | 73 | 0.39 | 79 | A |
| Example 5 | Exemplified Compound 44 | 36 | 55 | 45 | 0.38 | 79 | 0.40 | 86 | B |
| Example 6 | Exemplified Compound 57 | 44 | 77 | 23 | 0.26 | 63 | 0.27 | 69 | A |
| Example 7 | Exemplified Compound 58 | 44 | 75 | 25 | 0.28 | 65 | 0.28 | 69 | A |
| Example 8 | Exemplified Compound 63 | 40 | 80 | 20 | 0.26 | 62 | 0.27 | 68 | A |
| Example 9 | Exemplified Compound 66 | 40 | 69 | 31 | 0.29 | 69 | 0.31 | 74 | A |
| Example 10 | Exemplified Compound 78 | 38 | 81 | 19 | 0.28 | 68 | 0.29 | 70 | A |
| Example 11 | Exemplified Compound 82 | 38 | 86 | 14 | 0.32 | 62 | 0.34 | 66 | A |
| Example 12 | Exemplified Compound 90 | 38 | 88 | 12 | 0.31 | 67 | 0.35 | 84 | A |
| Example 13 | Exemplified Compound 108 | 36 | 57 | 43 | 0.37 | 77 | 0.39 | 82 | B |
| Example 14 | Exemplified Compound 112 | 48 | 63 | 37 | 0.34 | 66 | 0.35 | 70 | A |
| Example 15 | Exemplified Compound 125 | 50 | 81 | 19 | 0.30 | 60 | 0.32 | 67 | A |
| Example 16 | Exemplified Compound 146 | 108 | 58 | 42 | 0.47 | 85 | 0.52 | 94 | B |
| Example 17 | Exemplified Compound 166 | 36 | 78 | 22 | 0.40 | 56 | 0.45 | 67 | B |
| Example 18 | Exemplified Compound 177 | 40 | 82 | 18 | 0.36 | 55 | 0.38 | 65 | A |
| Example 19 | Exemplified Compound 56 | 44 | 80 | 20 | 0.26 | 69 | 0.30 | 83 | A |

TABLE 1-continued

| No. | Kind of compound | Number of $sp^2$ carbon atoms that form conjugation | Ratio of $sp^2$ carbon atoms (%) | Ratio of $sp^3$ carbon atoms (%) | Initial potential at 23° C./50% RH Sensitivity Δ500 (μJ/cm²) | Initial potential at 23° C./50% RH Residual potential (−V) | Potential after 5,000-sheet endurance at 23° C./50% RH Sensitivity Δ500 (μJ/cm²) | Potential after 5,000-sheet endurance at 23° C./50% RH Residual potential (−V) | 5,000-Sheet endurance under high temperature and high humidity Image evaluation |
|---|---|---|---|---|---|---|---|---|---|
| | Hole transporting substance | | | | | | | | |
| Example 20 | Exemplified Compound 56 | 44 | 80 | 20 | 0.28 | 76 | 0.37 | 88 | B |
| Example 21 | Exemplified Compound 56 | 44 | 80 | 20 | 0.35 | 84 | 0.41 | 101 | D |
| Example 22 | Exemplified Compound 36 | 36 | 77 | 23 | 0.35 | 65 | 0.38 | 87 | C |
| Comparative Example 1 | Structural formula (6) | 30 | 94 | 6 | 0.28 | 37 | 0.37 | 89 | E |
| Comparative Example 2 | Structural formula (7) | 29 | 100 | 0 | 0.29 | 32 | 0.41 | 106 | E |
| Comparative Example 3 | Structural formula (8) | 18 | 75 | 25 | Unable to measure sensitivity | — | — | — | — |
| Comparative Example 4 | Structural formula (9) | 18 | 100 | 0 | Unable to measure sensitivity | — | — | — | — |
| Comparative Example 5 | Structural formula (10) | — | 43 | 57 | 0.63 | 104 | Unable to measure sensitivity | — | — |
| Comparative Example 6 | Structural formula (11) | 36 | 52 | 48 | 0.52 | 90 | 0.66 | 143 | D |
| Comparative Example 7 | Structural formula (12) | 40 | 93 | 7 | 0.66 | 205 | Unable to measure sensitivity | — | — |
| Comparative Example 8 | Structural formula (13) | 34 | 95 | 5 | Unable to measure sensitivity | — | — | — | — |

The foregoing results show that when a molecule of a hole transporting substance is formed of a compound consisting of a carbon atom and a hydrogen atom, or consisting of a carbon atom, a hydrogen atom, and an oxygen atom, an image defect such as image deletion under high-temperature and high-humidity conditions is efficiently suppressed. Further, an electrophotographic photosensitive member using a hole transporting substance free of any oxygen atom was more excellent.

In the results of the measurement of the sensitivity and the residual potential, Examples 1, 2, 3, 6, 8, 11, and 15 showed relatively good results. This is probably because the number of $sp^2$ carbon atoms involved in conjugation was relatively large, and the ratios of the number of $sp^2$ carbon atoms and $sp^3$ carbon atoms were suitable.

In the same mixed surface layer of a hole transporting substance and an amine-based hole transporting substance as that of Example 1, a good result is obtained when the hole transporting substance of the present invention is incorporated at about 80 mass %.

Example 23

The aluminum cylinder used in Example 1 was used as a support. Next, 60 parts of barium sulfate particles covered with tin oxide (trade name: Passtran PC1, manufactured by MITSUI MINING & SMELTING CO., LTD.), 15 parts of titanium oxide particles (trade name: TITANIX JR, manufactured by TAYCA), 43 parts of a resole-type phenol resin (trade name: PHENOLITE J-325, manufactured by DIC Corporation, solid content: 70%), 0.015 part of silicone oil (trade name: SH28PA, manufactured by Dow Corning Toray Co., Ltd.), and 3.6 parts of silicone resin particles (trade name: TOSPEARL 120, manufactured by Momentive Performance Materials Inc.) were mixed in a mixed solvent of 50 parts of 2-methoxy-1-propanol and 50 parts of methanol, and the mixture was dispersed with a ball mill for about 20 hours to prepare a conductive-layer coating solution. The conductive-layer coating solution was applied onto the support by dipping, and the resultant coat was cured by heating for 1 hour at 140° C. to form a conductive layer having a thickness of 15 μm.

Next, 10 parts of a copolymerized nylon resin (trade name: AMILAN CM8000, manufactured by TORAY INDUSTRIES, INC.) and 30 parts of a methoxymethylated 6-nylon resin (trade name: TORESIN EF-30T, manufactured by Nagase ChemteX Corporation) were dissolved in a mixed solvent of 400 parts of methanol and 200 parts of n-butanol to prepare an undercoat-layer coating solution. The undercoat-layer coating solution was applied onto the conductive layer by dipping, and the resultant coat was dried by heating at a temperature of 100° C. for 30 minutes to form an undercoat layer having a thickness of 0.45 μm.

Next, the same charge generating layer as that of Example 1 was formed on the undercoat layer.

Next, 70 parts of the hole transporting substance represented by Exemplified Compound No. 56 and 100 parts of a polycarbonate resin (Iupilon 2800 manufactured by Mitsubishi Engineering-Plastics Corporation) were dissolved in 1,240 parts of monochlorobenzene to prepare a hole-transporting-layer coating solution. The hole-transporting-layer coating solution was applied onto the charge generating layer by dipping to form a coat, and the resultant coat was dried by heating at a temperature of 100° C. for 60 minutes to form a hole transporting layer (surface layer) having a thickness of 7 μm.

(Evaluation of Electrophotographic Photosensitive Member)

The same photosensitive member testing apparatus as that of Example 1 was used in the evaluation of the electrophotographic photosensitive member for its initial sensitivity and residual potential. First, a condition for a charging device was set so that the dark-area potential (Vd) of the electrophotographic photosensitive member became −600 (V) under a 23° C./50% RH environment. The photosensitive member was irradiated with monochromatic light having a wavelength of 780 nm, and the quantity of the light needed for reducing the potential of −600 (V) to −200 (V) was measured and defined as a sensitivity Δ400 (μJ/cm$^2$). Further, the potential of the electrophotographic photosensitive member when the photosensitive member was irradiated with light having a quantity of 40 (μJ/cm$^2$) was measured as a residual potential Vr (−V).

The electrophotographic photosensitive member was mounted onto the cyan station of a reconstructed machine of an electrophotographic copying machine (trade name: iR-ADV C5051) manufactured by Canon Inc. as an image evaluating apparatus, and was evaluated as described below.

First, a condition for a charging device was set so that the dark-area potential (Vd) of the electrophotographic photosensitive member became −600 (V) under a 23° C./50% RH environment. The photosensitive member was irradiated with laser light having a wavelength of 780 nm, the quantity of the light needed for reducing the potential of −600 (V) to −200 (V) was determined, and repeated image formation was performed by continuously outputting an evaluation chart, which was an A4 horizontal 5% image, on 1,000 sheets. The image formation was performed by setting the total quantity of a discharge current in the charging step to 350 (μA).

After the completion of the repeated image formation, the electrophotographic photosensitive member taken out of the image evaluating apparatus was immediately mounted onto the same photosensitive member testing apparatus as that described above, its sensitivity and residual potential were measured, and a variation between potentials before and after the repeated image formation was evaluated.

Next, an electrophotographic apparatus reconstructed so as to be capable of, for example, regulation and measurement so that the total current, and the DC component and AC component of a voltage to be applied to the charging roller could each be controlled was prepared as an electrophotographic apparatus. In addition, evaluation was performed while the power source of a heater accompanying the main body of the electrophotographic apparatus was turned off.

A cyan cartridge to be used in the electrophotographic apparatus was prepared, and the electrophotographic apparatus, the cartridge, and the electrophotographic photosensitive member were left to stand under a 30° C./80% RH environment for 24 hours or more. After that, the electrophotographic photosensitive member was mounted onto the cyan cartridge for image formation and evaluation. Then, an entire exposure image having a cyan color alone was output on A4 size plain paper and an image exposure light quantity was set so that a density on the paper measured with a spectral densitometer (trade name: X-Rite 504, manufactured by X-Rite Inc.) became 1.45.

Evaluation for image reproducibility was performed by setting the total quantity of a discharge current in the step of charging the electrophotographic photosensitive member to 350 (μA). A 1,000-sheet repeated image formation test was performed with a test chart having an image density ratio of 5% in this setting. After the completion of the repeated image formation, the electrophotographic photosensitive member was taken out of the electrophotographic apparatus together with the cartridge, and was left to stand under the same 30° C./80% RH environment in a dark place for 24 hours.

After that, the cartridge including the electrophotographic photosensitive member was mounted onto the same electrophotographic apparatus again, an A4 horizontal 1-dot/1-space image having an output resolution of 600 dpi was formed, and the same evaluation as that of Example 1 was performed.

Table 2 shows the result of the evaluation for the electric potential variation due to repeated image formation, and the results of the evaluation for image characteristics under a high-temperature and high-humidity environment.

Examples 24 to 40

Electrophotographic photosensitive members were each produced and evaluated in the same manner as in Example 23 except that the hole transporting substance used in the hole transporting layer of Example 23 was changed to a hole transporting substance shown in Table 2. Table 2 shows the results of the evaluation.

Example 41

The hole transporting substance of Example 23 was changed as follows: 63 parts of the hole transporting substance represented by Exemplified Compound No. 56 and 7 parts of the hole transporting substance represented by the formula (5) were used as a mixture. Further, 100 parts of the same polycarbonate resin as that of Example 23 were dissolved in 1,240 parts of monochlorobenzene to prepare a hole-transporting-layer coating solution. An electrophotographic photosensitive member was produced in the same manner as in Example 23 except the foregoing. Further, the electrophotographic photosensitive member was evaluated in the same manner as in Example 23. Table 2 shows the results of the evaluation.

Example 42

The hole transporting substance of Example 23 was changed as follows: 56 parts of the hole transporting substance represented by Exemplified Compound No. 56 and 14 parts of the hole transporting substance represented by the formula (5) were used as a mixture. Further, 100 parts of the same polycarbonate resin as that of Example 23 were dissolved in 1,240 parts of monochlorobenzene to prepare a hole-transporting-layer coating solution. An electrophotographic photosensitive member was produced in the same manner as in Example 23 except the foregoing. Further, the electrophotographic photosensitive member was evaluated in the same manner as in Example 23. Table 2 shows the results of the evaluation.

Example 43

The hole transporting substance of Example 23 was changed as follows: 35 parts of the hole transporting substance represented by Exemplified Compound No. 56 and 35 parts of the hole transporting substance represented by the formula (5) were used as a mixture. Further, 100 parts of the same polycarbonate resin as that of Example 23 were dissolved in 1,240 parts of monochlorobenzene to prepare a hole-transporting-layer coating solution. An electrophotographic photosensitive member was produced in the same manner as in Example 23 except the foregoing. Further, the electrophotographic photosensitive member was evaluated in the same manner as in Example 23. Table 2 shows the results of the evaluation.

Comparative Example 9

An electrophotographic photosensitive member was produced in the same manner as in Example 23 except that the hole transporting substance of Example 23 was changed to the hole transporting substance represented by the formula (6), and the electrophotographic photosensitive member was similarly evaluated. Table 2 shows the results of the evaluation.

Comparative Example 10

An electrophotographic photosensitive member was produced in the same manner as in Example 23 except that the hole transporting substance of Example 23 was changed to the hole transporting substance represented by the formula (7), and the electrophotographic photosensitive member was similarly evaluated. Table 2 shows the results of the evaluation.

Comparative Example 11

An electrophotographic photosensitive member was produced in the same manner as in Example 23 except that the hole transporting substance of Example 23 was changed to the aromatic compound represented by the formula (8), and the electrophotographic photosensitive member was similarly evaluated. Table 2 shows the results of the evaluation.

Comparative Example 12

An electrophotographic photosensitive member was produced in the same manner as in Example 23 except that the hole transporting substance of Example 23 was changed to the aromatic compound represented by the formula (9), and the electrophotographic photosensitive member was similarly evaluated. Table 2 shows the results of the evaluation.

Comparative Example 13

An electrophotographic photosensitive member was produced in the same manner as in Example 23 except that the hole transporting substance of Example 23 was changed to the polyfluorene compound represented by the formula (10), and the electrophotographic photosensitive member was similarly evaluated. Table 2 shows the results of the evaluation.

Comparative Example 14

An electrophotographic photosensitive member was produced in the same manner as in Example 23 except that the hole transporting substance of Example 23 was changed to the aromatic compound represented by the formula (11), and the electrophotographic photosensitive member was similarly evaluated. Table 2 shows the results of the evaluation.

Comparative Example 15

An electrophotographic photosensitive member was produced in the same manner as in Example 23 except that the hole transporting substance of Example 23 was changed to the compound represented by the formula (12), and the electrophotographic photosensitive member was similarly evaluated. Table 2 shows the results of the evaluation.

Comparative Example 16

An electrophotographic photosensitive member was produced in the same manner as in Example 23 except that the hole transporting substance of Example 23 was changed to the aromatic compound represented by the formula (13), and the electrophotographic photosensitive member was similarly evaluated. Table 2 shows the results of the evaluation.

TABLE 2

| | Hole transporting substance | | | | Initial potential at 23° C./50% RH | | Potential after 1,000-sheet endurance at 23° C./50% RH | | 1,000-Sheet endurance under high temperature and high humidity |
|---|---|---|---|---|---|---|---|---|---|
| No. | Kind of compound | Number of $sp^2$ carbon atoms that form conjugation | Ratio of $sp^2$ carbon atoms (%) | Ratio of $sp^3$ carbon atoms (%) | Sensitivity Δ400 (μJ/cm$^2$) | Residual potential (−V) | Sensitivity Δ400 (μJ/cm$^2$) | Residual potential (−V) | Image evaluation |
| Example 23 | Exemplified Compound 56 | 44 | 80 | 20 | 0.65 | 63 | 0.65 | 66 | A |
| Example 24 | Exemplified Compound 17 | 28 | 72 | 28 | 0.74 | 67 | 0.76 | 70 | A |
| Example 25 | Exemplified Compound 24 | 28 | 76 | 24 | 0.77 | 84 | 0.78 | 89 | A |
| Example 26 | Exemplified Compound 42 | 36 | 61 | 39 | 0.82 | 83 | 0.82 | 97 | B |
| Example 27 | Exemplified Compound 58 | 44 | 75 | 25 | 0.65 | 64 | 0.67 | 69 | A |
| Example 28 | Exemplified Compound 63 | 40 | 80 | 20 | 0.66 | 62 | 0.66 | 64 | A |
| Example 29 | Exemplified Compound 64 | 40 | 74 | 26 | 0.69 | 68 | 0.71 | 77 | A |
| Example 30 | Exemplified Compound 67 | 40 | 69 | 31 | 0.73 | 75 | 0.75 | 83 | A |
| Example 31 | Exemplified Compound 72 | 40 | 74 | 26 | 0.68 | 69 | 0.70 | 74 | A |
| Example 32 | Exemplified Compound 85 | 38 | 76 | 24 | 0.66 | 60 | 0.68 | 64 | A |
| Example 33 | Exemplified Compound 92 | 44 | 83 | 17 | 0.69 | 82 | 0.70 | 88 | A |
| Example 34 | Exemplified Compound 115 | 48 | 63 | 37 | 0.77 | 71 | 0.80 | 81 | B |
| Example 35 | Exemplified Compound 119 | 44 | 76 | 24 | 0.73 | 72 | 0.74 | 77 | A |
| Example 36 | Exemplified Compound 127 | 68 | 73 | 27 | 0.66 | 64 | 0.68 | 70 | A |
| Example 37 | Exemplified Compound 176 | 40 | 85 | 15 | 0.70 | 66 | 0.72 | 69 | B |
| Example 38 | Exemplified Compound 180 | 40 | 82 | 18 | 0.71 | 62 | 0.72 | 65 | A |
| Example 39 | Exemplified Compound 191 | 40 | 77 | 23 | 0.73 | 66 | 0.75 | 68 | B |
| Example 40 | Exemplified Compound 210 | 44 | 77 | 23 | 0.70 | 65 | 0.71 | 68 | B |
| Example 41 | Exemplified Compound 56 | 44 | 80 | 20 | 0.65 | 66 | 0.66 | 78 | B |
| Example 42 | Exemplified Compound 56 | 44 | 80 | 20 | 0.67 | 74 | 0.70 | 79 | B |
| Example 43 | Exemplified Compound 56 | 44 | 80 | 20 | 0.82 | 82 | 0.83 | 96 | C |
| Comparative Example 9 | Structural formula (6) | 30 | 94 | 6 | 0.65 | 16 | 0.70 | 87 | E |
| Comparative Example 10 | Structural formula (7) | 29 | 100 | 0 | 0.67 | 12 | 0.81 | 131 | E |

TABLE 2-continued

| No. | Kind of compound | Hole transporting substance: Number of $sp^2$ carbon atoms that form conjugation | Ratio of $sp^2$ carbon atoms (%) | Ratio of $sp^3$ carbon atoms (%) | Initial potential at 23° C./50% RH: Sensitivity Δ400 (μJ/cm²) | Initial potential: Residual potential (−V) | Potential after 1,000-sheet endurance at 23° C./50% RH: Sensitivity Δ400 (μJ/cm²) | Potential after 1,000-sheet endurance: Residual potential (−V) | 1,000-Sheet endurance under high temperature and high humidity Image evaluation |
|---|---|---|---|---|---|---|---|---|---|
| Comparative Example 11 | Structural formula (8) | 18 | 75 | 25 | Unable to measure sensitivity | — | — | — | — |
| Comparative Example 12 | Structural formula (9) | 18 | 100 | 0 | Unable to measure sensitivity | — | — | — | — |
| Comparative Example 13 | Structural formula (10) | — | 43 | 57 | Unable to measure sensitivity | — | — | — | — |
| Comparative Example 14 | Structural formula (11) | 36 | 52 | 48 | Unable to measure sensitivity | — | — | — | — |
| Comparative Example 15 | Structural formula (12) | 40 | 93 | 7 | Unable to measure sensitivity | — | — | — | — |
| Comparative Example 16 | Structural formula (13) | 34 | 95 | 5 | Unable to measure sensitivity | — | — | — | — |

The foregoing results show that when a hole transporting substance to be used in a surface layer (hole transporting layer) consists of a carbon atom and a hydrogen atom, or consists of a carbon atom, a hydrogen atom, and an oxygen atom, image deletion under high-temperature and high-humidity conditions is efficiently suppressed. Further, the use of a hole transporting substance consisting of a carbon atom and a hydrogen atom was more excellent.

In the results of the measurement of the sensitivity and the residual potential, Examples 23, 24, 32, 37, and 38 showed good results. This is probably because the number of $sp^2$ carbon atoms involved in conjugation was large, and the ratios of the number of $sp^2$ carbon atoms and $sp^3$ carbon atoms were suitable.

Example 44

The aluminum cylinder used in Example 1 was used as a support.

Next, the conductive-layer coating solution used in Example 23 was applied onto the support by dipping, and was cured in the same manner as in Example 23 to form a conductive layer having a thickness of 15 μm.

Next, the undercoat-layer coating solution used in Example 23 was applied onto the conductive layer by dipping, and was dried by heating in the same manner as in Example 23 to form an undercoat layer having a thickness of 0.45 μm.

Next, 4.6 parts of a bisazo pigment represented by the following formula (14) as a charge generating substance and 2 parts of a butyral resin (butyralization degree: 68 mol %, weight-average molecular weight: 35,000) were mixed in 95 parts of cyclohexanone, and the mixture was dispersed with a sand mill for 36 hours to prepare a charge-generating-layer coating solution. The charge-generating-layer coating solution was applied onto the undercoat layer by dipping, and the resultant coat was dried by heating at a temperature of 80° C. for 15 minutes to form a charge generating layer having a thickness of 0.20 μm.

(14)

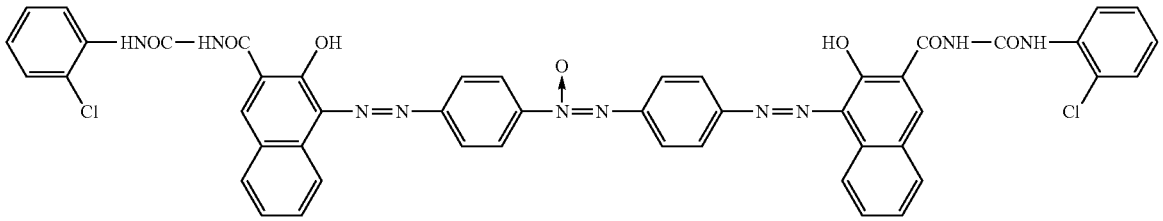

Next, 80 parts of the hole transporting substance represented by Exemplified Compound No. 56 and 100 parts of a polycarbonate resin (Iupilon 2400) were dissolved in 600 parts of monochlorobenzene and 200 parts of tetrahydrofuran to prepare a hole-transporting-layer coating solution. The hole-transporting-layer coating solution was applied onto the charge generating layer by dipping, and the resultant coat was dried by heating at a temperature of 110° C. for 60 minutes to form a hole transporting layer having a thickness of 25 μm.

(Evaluation of Electrophotographic Photosensitive Member)

The electrophotographic photosensitive member of Example 44 was evaluated as described below.

A photosensitive member testing apparatus (CYNTHIA59) was used in the evaluation of the electrophotographic photosensitive member for its initial sensitivity and residual potential. First, a condition for a charging device was set so that the dark-area potential (Vd) of the electrophotographic photosensitive member became −700 (V) under a 23° C./50% RH environment. The photosensitive member was irradiated with monochromatic light having a wavelength of 530 nm, and the quantity of the light needed for reducing the potential of −700 (V) to −200 (V) was measured and defined as a sensitivity Δ500 (μJ/cm$^2$). Further, the potential of the electrophotographic photosensitive member when the photosensitive member was irradiated with light having a quantity of 60 (μJ/cm$^2$) was measured as a residual potential Vr (−V).

The electrophotographic photosensitive member was mounted onto the cyan station of a reconstructed machine of an electrophotographic copying machine (trade name: iR-ADV C5051) manufactured by Canon Inc. as an image evaluating apparatus, and was evaluated as described below.

First, a condition for a charging device was set so that the dark-area potential (Vd) of the electrophotographic photosensitive member became −700 (V) under a 23° C./50% RH environment. Reconstruction was performed so as to allow the photosensitive member to be irradiated with laser light having a wavelength of 530 nm as a light source for image exposure. The photosensitive member was irradiated with laser light, and the quantity of the light needed for reducing the potential of −700 (V) to −200 (V) was determined. After that, repeated image formation was performed by continuously outputting an evaluation chart, which was an A4 horizontal 5% image, on 1,000 sheets. The image formation was performed by setting the total quantity of a discharge current in the charging step to 300 (μA).

After the completion of the repeated image formation, the electrophotographic photosensitive member taken out of the image evaluating apparatus was immediately mounted onto the same photosensitive member testing apparatus as that described above, its sensitivity and residual potential were measured, and a variation between potentials before and after the repeated image formation was evaluated.

Next, an electrophotographic apparatus reconstructed so as to be capable of, for example, regulation and measurement so that the total current, and the DC component and AC component of a voltage to be applied to the charging roller could each be controlled was prepared as an electrophotographic apparatus. In addition, evaluation was performed while the power source of a heater accompanying the main body of the electrophotographic apparatus was turned off.

A cyan cartridge to be used in the electrophotographic apparatus was prepared, and the electrophotographic apparatus, the cartridge, and the electrophotographic photosensitive member were left to stand under a 30° C./80% RH environment for 24 hours or more. After that, the electrophotographic photosensitive member was mounted onto the cyan cartridge for image formation and evaluation. Then, an entire exposure image having a cyan color alone was output on A4 size plain paper. After that, an image exposure light quantity was set so that a density on the output image measured with a spectral densitometer (trade name: X-Rite 504, manufactured by X-Rite Inc.) became 1.45.

Evaluation for image reproducibility was performed by setting the total quantity of a discharge current in the step of charging the electrophotographic photosensitive member to 300 (μA). A 1,000-sheet repeated image formation test was performed with a test chart having an image density ratio of 5% in this setting. After the completion of the repeated image formation, the electrophotographic photosensitive member was taken out of the electrophotographic apparatus together with the cartridge, and was left to stand under the same 30° C./80% RH environment in a dark place for 24 hours.

After that, the cartridge was mounted onto the same electrophotographic apparatus again, an A4 horizontal 1-dot/1-space image having an output resolution of 600 dpi was formed, and the same evaluation as that of Example 1 was performed.

Table 3 shows the result of the evaluation for the electric potential variation due to repeated image formation, and the results of the evaluation for image characteristics under a high-temperature and high-humidity environment.

TABLE 3

| | Hole transporting substance | | | | Initial potential at 23° C./50% RH | | Potential after 1,000-sheet endurance at 23° C./50% RH | | 1,000-Sheet endurance under high temperature and high humidity |
|---|---|---|---|---|---|---|---|---|---|
| No. | Kind of compound | Number of sp$^2$ carbon atoms that form conjugation | Ratio of sp$^2$ carbon atoms (%) | Ratio of sp$^3$ carbon atoms (%) | Sensitivity Δ500 (μJ/cm$^2$) | Residual potential (−V) | Sensitivity Δ500 (μJ/cm$^2$) | Residual potential (−V) | Image evaluation |
| Example 44 | Exemplified Compound 56 | 44 | 80 | 20 | 0.95 | 40 | 0.95 | 41 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-045715, filed Mar. 7, 2013, and No. 2014-032962, filed Feb. 24, 2014 which are hereby incorporated by reference herein in their entirety.

What is claimed is:

1. An electrophotographic photosensitive member comprising:

a support; and a photosensitive layer formed on the support, wherein the photosensitive layer comprises a charge generating layer and a surface layer, wherein, the charge generating layer contains at least one charge generating substance selected from the group consisting of hydroxygallium phthalocyanine, oxytitanium phthalocyanine, and chlorogallium phthalocyanine, the surface layer contains a hole transporting substance represented by the following formula (1)":

(1)″

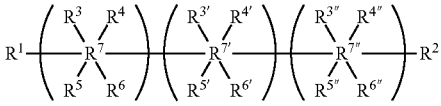

in the formula (1)″, $R^1$ to $R^6$, $R^{3'}$ to $R^{6'}$, and $R^{3''}$ to $R^{6''}$ each independently represents a hydrogen atom or an alkyl group, $R^7$ represents a group derived from a pyrene, $R^{7'}$ represents a group derived from a fluorene or an anthracene, and $R^{7''}$ represents a group derived from a fluorene, a pyrene, an anthracene, a phenanthrene, or a fluoranthene, a ratio of a number of $sp^3$ carbon atoms is 15% or more and 35% or less based on a total number of carbon atoms in the hole transporting substance, and a thickness of the photosensitive layer is 5 μm or more and 10 μm or less.

2. An electrophotographic apparatus comprising: the electrophotographic photosensitive member according to claim 1; a charging device; an exposing device; a developing device; and a transferring device.

3. A process cartridge detachably mountable to a main body of an electrophotographic apparatus, wherein the process cartridge integrally supports: the electrophotographic photosensitive member according to claim 1; and at least one device selected from the group consisting of a charging device, a developing device, and a cleaning device.

4. The electrophotographic photosensitive member according to claim 1, wherein in the formula (1)″, $R^1$ represents a tert-butyl group, $R^2$ to $R^6$, $R^{3'}$ to $R^{6'}$, and $R^{3''}$ to $R^{6''}$ each independently represents a hydrogen atom or an alkyl group, $R^7$ represents a group derived from a pyrene, $R^{7'}$ represents a group derived from a fluorene, and $R^{7''}$ represents a group derived from a fluorene or a pyrene.

5. The electrophotographic photosensitive member according to claim 1, wherein the charge generating layer contains hydroxygallium phthalocyanine.

6. The electrophotographic photosensitive member according to claim 5, wherein the hydroxygallium phthalocyanine is a hydroxygallium phthalocyanine crystal of a crystal form which has peaks at Bragg angles 2θ in CuKα characteristic X-ray diffraction of 7.4°±0.3° and 28.2°±0.3°.

7. The electrophotographic photosensitive member according to claim 1, wherein the thickness of the photosensitive layer is 5 μm or more and 8 μm or less.

8. The electrophotographic photosensitive member according to claim 1, wherein the hole transporting substance is represented by the following formula No. 56:

No. 56

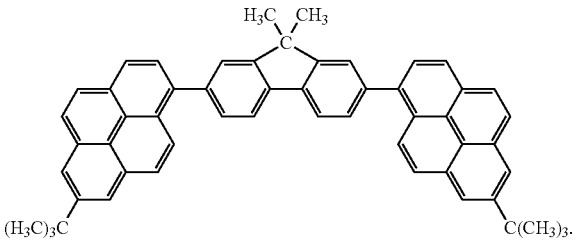

* * * * *